US006012964A

United States Patent [19]

Arai et al.

[11] Patent Number: 6,012,964

[45] Date of Patent: Jan. 11, 2000

[54] CARRIER AND CMP APPARATUS

[75] Inventors: Hatsuyuki Arai; Shigeto Izumi; Xu-Jin Wang; Misuo Sugiyama; Hisato Matsubara; Hideo Tanaka; Toshikuni Shimizu, all of Ayase, Japan

[73] Assignee: SpeedFam Co., Ltd, Tokyo, Japan

[21] Appl. No.: 09/149,501

[22] Filed: Sep. 8, 1998

[30] Foreign Application Priority Data

Dec. 11, 1997 [JP] Japan ..... 9-362047
May 7, 1998 [JP] Japan ..... 10-140466

[51] Int. Cl.[7] ..... B24B 1/00

[52] U.S. Cl. ..... 451/5; 451/41; 451/9; 451/288; 451/287

[58] Field of Search ..... 451/5, 41, 9, 63, 451/53, 285–289

[56] References Cited

U.S. PATENT DOCUMENTS

| | | | |
|---|---|---|---|
| 5,423,176 | 6/1995 | Strausbaugh | 451/388 |
| 5,584,751 | 12/1996 | Kobayashi et al. | 451/41 |
| 5,624,299 | 4/1997 | Shendon | 451/28 |
| 5,681,215 | 10/1997 | Sherwood et al. | 451/288 |
| 5,791,973 | 8/1998 | Nishio | 451/288 |
| 5,795,215 | 8/1998 | Guthrie et al. | 451/41 |
| 5,879,220 | 3/1999 | Hasegawa et al. | 451/288 |
| 5,938,884 | 8/1999 | Hoshizaki et al. | 451/288 |

FOREIGN PATENT DOCUMENTS

| | | |
|---|---|---|
| 0653270 A1 | 5/1995 | European Pat. Off. . |
| 0747167 A2 | 12/1996 | European Pat. Off. . |
| 7-171757 | 7/1995 | Japan . |
| 8-229808 | 9/1996 | Japan . |

OTHER PUBLICATIONS

European Search Report Mar. 19, 1999.

*Primary Examiner*—Robert A. Rose
*Assistant Examiner*—George Nguyen
*Attorney, Agent, or Firm*—Fitch, Even, Tabin & Flannery

[57] ABSTRACT

A carrier and CMP apparatus which improve the uniformity of polishing in a wafer or other workpiece and increase the margin of the amount of wear of the retainer ring to improve the operating rate of the CMP apparatus. A carrier 1 is constituted by a housing 10, a carrier base 11, a retainer ring 12, a sheet supporter 13, a hard sheet 18, and a soft backing sheet 19. The sheet supporter 13 is formed by a supporter body portion 14 having an air opening 14*a* communicating with an air outlet/inlet 11*b* of the carrier base 11, a flexible diaphragm 15, and an edge ring 16. Therefore, a wafer W is uniformly pressed by the air pressure in the pressure chamber R and fluctuation in the force pressing against the outer peripheral rim of the wafer W caused by the wear of the retainer ring 12 is countered by the diaphragm 15.

56 Claims, 32 Drawing Sheets

CARRIER AND CMP APPARATUS

BACKGROUND OF THE INVENTION

1. Field of the Invention

The present invention relates to a carrier and a chemical mechanical polishing (CMP) apparatus for rotating and uniformly polishing a surface of a wafer or other workpiece while pressing it against a polishing pad of a platen.

2. Description of the Related Art

FIG. 41 is a sectional view of essential portions of a general CMP apparatus.

As shown in FIG. 41, this CMP apparatus is provided with a carrier 100 and a platen 110 on which a polishing pad 111 is attached. It is structured to polish the surface of a wafer W by the polishing pad 111 by making the carrier 100 and the platen 110 rotate by a not shown rotating mechanism while supplying a not shown polishing fluid in a state pressing the wafer W to the platen 110 side by a carrier base 101 of the carrier 100.

This CMP apparatus polishes the wafer W by the rear face reference polishing system, so a backing pad 102 is attached to the carrier base 101 and the surface of the wafer W is polished in a state with the backing pad 102 abutting against the back surface of the wafer W.

Meanwhile, uniformly polishing the surface of the wafer W requires that the sectional shapes of the backing pad 102 and the polishing pad 111 be uniform and that there be no variations in the thickness or the sectional shape.

Manufacturing a backing pad 102 or a polishing pad 111 with completely uniform sectional shapes, however, is difficult in practice. The backing pad 102 and the polishing pad 111 which are manufactured have considerable unevenness.

Accordingly, the distribution of pressure applied to the wafer W as a whole at the time of polishing is no longer uniform and the surface of the wafer W is not uniformly polished.

Further, even if the backing pad 102 and the polishing pad 111 are uniform in sectional shape, warping and waviness sometimes occur in the wafer W itself. As opposed to this, the CMP apparatus shown in FIG. 41 is not constructed to deal with such warping or waviness in the wafer W, so uneven polishing of the wafer W due to this warping and waviness occurs and it is not possible to uniformly polish the surface of the wafer W as a whole.

Further, when a disk shaped wafer W is pressed by the carrier 100, the pressure applied to the outer peripheral rim of the wafer W inevitably becomes larger than the pressure applied to other portions. This results in over polishing of the edges of the wafer W and a resultant poorer yield.

Therefore, as shown in FIG. 41, a retainer ring 103 is arranged at the outside of the wafer W and part of the pressure applied to the outer peripheral rim of the wafer W is relieved to the retainer ring 103 side so as to make the distribution of pressure applied to the wafer W as a whole uniform and try to improve the yield.

Whether or not the pressure at the outer peripheral rim of the wafer W becomes equal to the pressure at other portions, however, is determined by the amount of projection Δ of the wafer W from the retainer ring 103.

Accordingly, it is necessary to adjust in advance the amount of projection of the retainer ring 103 from the carrier base 101 so that the amount of projection Δ of the wafer W becomes the optimal value before polishing the wafer W.

When the polishing work is continued for a certain time, however, the retainer ring 103 in contact with the polishing pad 111 is worn down and the amount of projection Δ starts to differ from the initial value. Therefore, it is necessary to stop the operation of the CMP apparatus each time and finely adjust the amount of projection of the retainer ring 103 so that the amount of projection Δ becomes the optimal value. This has caused a decline in the operating rate.

As explained above, in a general CMP apparatus shown in FIG. 41, there were problems in the uniformity of polishing of the wafer W and the operating rate of the CMP apparatus due to the work for adjusting the retainer ring 103. Therefore, various types of CMP apparatuses have been considered to try to overcome these problems as much as possible using air pressure.

FIG. 42 is a sectional view of an air pressure type CMP apparatus according to a first example of the related art, FIG. 43 is a sectional view of an air pressure type CMP apparatus according to a second example of the related art; and FIG. 45 is a sectional view of an air pressure type CMP apparatus according to a third example of the related art.

The carrier 200 of the CMP apparatus according to the first example of the related art, as shown in FIG. 42, is constructed with a pressure chamber 202 provided below a carrier base 201.

Specifically, a ring-shaped narrow width abutment 203 is provided at a position inside the retainer ring 103 to define the pressure chamber 202. A silicone rubber sheet 204 at the lower surface of the abutment 203 abuts against the outer peripheral rim of the wafer W. In that state, air of a predetermined pressure is introduced into the pressure chamber 202.

Due to this, a uniform air pressure is applied to the wafer W to polish the wafer W by the front face reference polishing system.

Further, the carrier 300 of the CMP apparatus according to the second example of the related art, as shown in FIG. 43, is constructed with a ring-shaped projection 302 provided at an outer periphery of the lower surface of a carrier base 301, with a porous ceramic plate 303 attached to the inside of the projection 302, and with a perforated hard sheet 305 attached to the lower surface of the projection 302 by a two-sided adhesive tape 301 so as to define a pressure chamber 306. Further, a perforated backing pad 307 is adhered to the lower surface of the perforated sheet 305 and the retainer ring 103 is adhered to a portion of the lower surface of the perforated sheet 305 corresponding to the projection 302 by a two-sided adhesive tape 308.

By this construction, the air passing through the air holes in the carrier base 301 is introduced through the perforated ceramic plate 303 to the pressure chamber 306. The air pressure in the pressure chamber 306 uniformly presses against the wafer W through the perforated sheet 305 and the backing pad 307.

Further, the CMP apparatus according to the third example of the related art is the art disclosed in Japanese Patent Laid-Open No. 7-171757. A carrier 400, as shown in FIG. 45, is constructed with a flexible thin sheet 402 attached to the bottom part of a wafer holding member 401 and with the wafer holding member 401 suspended from a housing 405 through an expandable cylindrical member 403 and a high flexibility support member 404. Due to this construction, the inside of the wafer support member 401 is pressurized at positive pressure and a uniform air pressure is applied to the wafer W in the state with the wafer W sucked against the flexible thin sheet 402 by a flexible hose 406.

The CMP apparatuses of the above related art, however, suffered from the following problems:

In the carrier 200 of the CMP apparatus according to the first example of the related art shown in FIG. 42, a uniform air pressure was applied to the upper surface of the wafer W to polish the wafer W by the front face reference polishing system, so there was almost no effect received due to the sectional shape of the polishing pad 111 or warping etc. of the wafer W and the surface of the wafer W could be polished uniformly.

This CMP apparatus, however, sets the lateral width of the abutment 203 small so as to secure a pressurization area for the air. Accordingly, the area of contact between the outer peripheral rim of the wafer W and the silicone rubber sheet 204 becomes smaller, air in the pressure chamber 202 leaks from below the silicone rubber sheet 204, the pressure applied to the outer peripheral rim of the wafer W becomes uneven, and this portion is not uniformly polished.

Further, in this CMP apparatus, the margin of the amount of projection Δ of the wafer W is too small.

That is, the amount of projection of the retainer ring 103 from the carrier base 201 is determined so that the amount of projection Δ of the wafer W becomes the optimal value, but the retainer ring 103 is worn down along with the polishing work. When the retainer ring 103 is worn down by as much as 1 μm from the optimal value, it is not enough to immediately adjust the amount of projection of the retainer ring 103.

That is, there is an allowable range (margin) to the amount of wear of the retainer ring 103. So long as the amount of wear is within this allowable range, the amount of over polishing of the outer peripheral rim of the wafer W is small and it is possible to prevent a reduction in the yield.

In the carrier 200 of this CMP apparatus, however, the outer peripheral rim of the wafer W is pushed in by the narrow width abutment 203, so the margin of the amount of wear of the retainer ring 103 is a small 10 μm and it is necessary to adjust the amount of projection of the retainer ring 103 in a short time. Proposals for improving on this have been awaited.

Further, in the carrier 300 of the CMP apparatus according to the second example of the related art shown in FIG. 43, it is possible to apply pressure to the entire surface of the wafer W by a uniform air pressure, but the range of over polishing at the outer peripheral rim of the wafer W is large and the yield becomes remarkably poor.

FIG. 44 is an enlarged sectional view of the state of over polishing. As shown in FIG. 44, the carrier 300 is constructed with the projection 302 of the carrier base 301 and the retainer ring 103 gripping the outer periphery of the perforated sheet 305 covering the wafer W, so the outer periphery of the perforated sheet 305 is pulled downward during the polishing work.

Accordingly, a tension T occurs at the outer periphery of the perforated sheet 305 and a pressure of a vertical component T1 of the tension T is applied to the outer peripheral rim of the wafer W in addition to the air pressure P.

As a result, the polishing rate of the outer peripheral rim of the wafer W becomes remarkably larger than the polishing rate of other portions, the range of over polishing L becomes as high as 10 mm to 20 mm, and the yield of the wafer W ends up becoming remarkably poor.

Further, while probably due to this, the margin of the amount of wear of the retainer ring 103 also is a small 20 μm or so.

In addition, in the carrier 400 of the CMP apparatus according to the third example of the related art shown in FIG. 45, since it is not possible to apply a positive pressure in the wafer holding member 401 to the center of the flexible thin sheet 402 where the flexible hose 406 is attached, application of completely uniform air pressure is not possible. Further, since a center hole 402*a* of the flexible thin sheet 402 is negative in pressure, uneven polishing occurs at the center of the wafer W.

Further, since the wafer holding member 401 is constructed to be suspended from the housing 405, the carrier 400 ends up becoming large in size. Further, it is necessary to balance the air pressure inside the wafer holding member 401 and the weight of the wafer holding member 401 to eliminate any effect of the weight of the wafer holding member 401, so it is not possible to freely adjust the air pressure in the wafer holding member 401. As a result, slight fluctuations in the air inside the wafer holding member 401 end up having a large effect on the uniformity of polishing of the wafer W.

Further, the carrier 400, like the carrier 200 shown in FIG. 43, has the outer periphery of the flexible thin sheet 402 pulled downward, so the tension of the flexible thin sheet 402 causes the polishing rate of the outer peripheral rim of the wafer W to become remarkably larger than the polishing rate of the other portions.

SUMMARY OF THE INVENTION

The present invention was made so as to solve the above problems and has as its object to provide a carrier and CMP apparatus which improve the uniformity of polishing in a wafer or other workpiece and increase the margin of the amount of wear of the retainer ring to improve the operating rate of the CMP apparatus.

To achieve this object, according to one aspect of the invention, a carrier comprises: a carrier base having a fluid outlet/inlet; a retainer ring attached to an outer periphery of the carrier base and defining a space for holding a workpiece; a sheet supporter having a body having at least one fluid opening communicating with the fluid outlet/inlet and provided inside the space for holding the workpiece, a flexible outer diaphragm extending from an outer peripheral surface of the body to a position corresponding to the outer peripheral rim of the workpiece, and a ring-shaped outer edge projecting from an outer rim of the outer diaphragm to the outer peripheral rim of the workpiece; and a flexible sheet with an outer peripheral rim air-tightly affixed to an end of the outer edge and defining a pressure chamber communicating with the fluid opening together with the sheet supporter.

According to this construction, if the carrier is pressed against in the state with the workpiece on the platen held in the space for holding the workpiece of the carrier, the sheet will contact substantially the entire surface of the workpiece following warping etc. and the outer edge of the sheet supporter will be positioned at the outer peripheral rim of the workpiece. If fluid of a desired pressure is supplied from the fluid outlet/inlet of the carrier base in this state, the fluid will flow through the fluid opening of the body of the sheet supporter to fill the pressure chamber and substantially the entire surface of the workpiece will receive a uniform fluid pressure through the sheet.

Further, if the carrier is pressed against, a large pressing force will act on the outer peripheral rim of the workpiece through the outer edge, but the flexible outer diaphragm will bend and relieve the pressing force. Accordingly, by setting the amount of projection of the workpiece from the retainer ring in advance so that substantially uniform pressure will be applied across the entire surface of the workpiece, including the outer peripheral rim, based on the flexing of the outer diaphragm, uniform polishing of the workpiece becomes possible.

Further, when the retainer ring wears down during polishing of the workpiece, the pressing force applied to the outer peripheral rim of the workpiece increases in accordance with the wear, but this pressing force is also relieved by the flexing of the outer diaphragm, so the rate of increase of the polishing rate of the outer peripheral rim of the workpiece to the amount of wear of the retainer ring is small.

Further, another aspect of the invention, a seal member allowing movement of the outer edge is interposed between the outer edge and the retainer ring or carrier base so as to make air-tight the space existing at the opposite side of the pressure chamber from the outer diaphragm and wherein holes are formed in the outer diaphragm to communicate the space and pressure chamber.

According to this construction, the pressure chamber and the space are communicated through the holes of the outer diaphragm, so the pressure of the fluid inside the pressure chamber and the pressure of the fluid inside the space can be made equal.

Further, another aspect of the invention, a seal member allowing movement of the outer edge is interposed between the outer edge and the retainer ring or carrier base so as to make air-tight the space existing at the opposite side of the pressure chamber from the outer diaphragm and wherein a fluid outlet/inlet communicating with the space is provided at either of the carrier base or the body of the sheet supporter.

According to this construction, it is possible to adjust the fluid pressure in the space to control the pressure difference between the fluid pressure in the space and the fluid pressure in the pressure chamber. Further, another aspect of the invention, an inner hole of a predetermined diameter is provided at a center of the body of the sheet supporter and wherein inside the inner hole there are formed a flexible inner diaphragm extending from the inner circumferential surface of the inner hole toward the center and a ring-shaped inner edge projecting from the inner rim of the inner diaphragm to the sheet side and air-tightly fixed at its end to the sheet.

According to this construction, it is possible to form an air-tight chamber defined by the outer diaphragm and the inner diaphragm at the outside of the center pressure chamber.

Further, another aspect of the invention, at least two sheet supports with different diameters are arranged concentrically so that the inner edge of one does not contact the outer edge of the other.

According to this construction, it is possible to form a plurality of concentric air-tight chambers defined by the outer diaphragm and the inner diaphragm at the outside of the center pressure chamber.

Note that as the sheet, various types of flexible sheets can be used. Therefore, the sheet is formed by a single hard sheet or soft sheet and wherein the outer periphery of the upper surface of the hard sheet or soft sheet is air-tightly affixed to the lower surface of the outer edge of the sheet supporter.

Further, another aspect of the invention, a soft sheet is bonded to the lower surface of the hard sheet.

Further, another aspect of the invention, the hard sheet and soft sheet are bonded via an intermediate sheet having an adhesive at its upper and lower surfaces.

If the fluid is supplied inside a rotating air-tight pressure chamber, however, the centrifugal force may result in the fluid pressure at the outer periphery of the pressure chamber becoming different from the fluid pressure of the other portions.

Therefore, another aspect of the invention, a through hole communicating the pressure chamber and outside is provided at an outer edge positioned at the outer peripheral side of the workpiece.

According to this construction, the fluid flowing from the fluid outlet/inlet to the inside of the pressure chamber flows from the through hole to the outside whereby the flow in the pressure chamber is stabilized and the uniformity of the distribution of pressure applied to the workpiece is further improved.

Further, another aspect of the invention, a tube inserted through a hole passing through the retainer ring in the width direction is inserted into a through hole of the outer edge air-tightly.

According to this construction, the fluid in the pressure chamber flows out through the tube to the outside of the carrier.

Further, another aspect of the invention, a hole is provided in the outer diaphragm positioned at the outer peripheral side of the workpiece and a through hole is provided in the carrier base communicating to the outside and wherein a tube inserted through a through hole of the carrier base is inserted into a hole of the outer diaphragm air-tightly.

Further, another aspect of the invention, the portion above the outer diaphragm positioned at the outer peripheral side of the workpiece is covered by a flexible ring member to define an air-tight space and wherein a hole communicating with the space is provided in the outer diaphragm, a hole is provided in a portion of the ring member in contact with the lower surface of the carrier base, and a through hole communicating the hole and the outside is provided in the carrier base.

Further, another aspect of the invention, a valve for controlling the flow rate of a fluid is attached at the fluid outflow side end of the tube.

According to this construction, it is possible to correct error in the distribution of pressure by adjusting the flow rate of the fluid flowing from the pressure chamber to the outside of the carrier by a valve.

Further, another aspect of the invention, the sheet is provided with at least one hole communicating with the pressure chamber and wherein the fluid in the pressure chamber is made to flow out from the at least one hole to between the sheet and workpiece.

According to this construction, a stable layer of fluid is formed between the sheet and the workpiece.

Further, another aspect of the invention, the at least one hole of the sheet is arranged to be substantially facing the pressure side opening of at least one fluid opening provided at the body of the sheet supporter.

According to this construction, the majority of the fluid from the fluid openings provided in the body enters the holes in the sheet.

Further, another aspect of the invention, part of the holes of the sheet are communicated through tubes with part of the fluid openings provided in the body of the sheet supporter.

According to this construction, the fluid from the fluid openings in the body directly enter the holes in the sheet.

Further, another aspect of the invention, the centers of the hard sheet and the soft sheet are partially bonded together, wherein at least one hole communicating with the pressure chamber is provided in the soft sheet, and wherein the fluid in the pressure chamber is made to flow out from the at least one hole to between the hard sheet and the soft sheet.

According to this construction, a stable layer of fluid is formed between the hard sheet and the soft sheet.

Further, another aspect of the invention, a carrier comprises: a carrier base having a fluid outlet/inlet; a retainer ring attached to an outer periphery of the carrier base and defining a space for holding a workpiece; a sheet supporter having a ring-shaped body arranged in the space for holding the workpiece, a flexible diaphragm for holding the body, and a ring-shaped edge projecting from an outer rim of the body to the outer peripheral rim side of the workpiece; and a flexible sheet with an outer peripheral rim air-tightly affixed to an end of the edge and defining a pressure chamber communicating with the fluid outlet/inlet.

According to this construction, if the carrier is pressed against in the state with the workpiece on the platen held in the space for holding the workpiece of the carrier, the sheet will contact substantially the entire surface of the workpiece following warping etc. and the edge of the sheet supporter will be positioned at the outer peripheral rim of the workpiece. If fluid of a desired pressure is supplied from the fluid outlet/inlet of the carrier base in this state, the fluid will fill the pressure chamber and substantially the entire surface of the workpiece will receive a uniform fluid pressure through the sheet.

Further, if the carrier is pressed against, a large pressing force starting to act on the edge of the sheet supporter will be relieved by the flexing of the diaphragm. Accordingly, just the pressure of the fluid in the pressure chamber will be applied uniformly to the workpiece.

Further, another aspect of the invention, the sheet is formed by a single hard sheet or soft sheet and wherein the outer periphery of the upper surface of the hard sheet or soft sheet is air-tightly affixed to the lower surface of the edge of the sheet supporter.

Further, another aspect of the invention, a soft sheet is bonded to the lower surface of the hard sheet.

Further, another aspect of the invention, the hard sheet and soft sheet are bonded via an intermediate sheet having an adhesive at its upper and lower surfaces.

Further, another aspect of the invention, a through hole communicating the pressure chamber and outside is provided at the edge.

Further, another aspect of the invention, a tube inserted through a hole passing through the retainer ring in the width direction is inserted into a through hole of the edge air-tightly.

Further, another aspect of the invention, a valve for controlling the flow rate of a fluid is attached at the fluid outflow side end of the tube.

Further, another aspect of the invention, the sheet is provided with at least one hole communicating with the pressure chamber and wherein the fluid in the pressure chamber is made to flow out from the at least one hole to between the sheet and workpiece.

Further, another aspect of the invention, the at least one hole of the sheet is arranged to be substantially facing the pressure side opening of at least one fluid opening provided at the carrier-base.

Further, another aspect of the invention, part of the holes of the sheet are communicated through tubes with part of the fluid openings provided in the carrier base.

Further, another aspect of the invention, the centers of the hard sheet and the soft sheet are partially bonded together, wherein at least one hole communicating with the pressure chamber is provided in the soft sheet, and wherein the fluid in the pressure chamber is made to flow out from the at least one hole to between the hard sheet and the soft sheet.

Note that CMP apparatuses using the carriers according to the above aspects of the invention can stand as inventions as well.

Therefore, another aspect of the invention, a CMP apparatus comprises: a platen having a polishing pad attached to its surface; a carrier rotatable in a state holding a workpiece on the polishing pad of the platen; a fluid supplying means able to supply a fluid of a desired pressure to the carrier; and a rotational driving means for rotating the carrier while pressing against it; the carrier comprising a carrier base having a fluid outlet/inlet through which a fluid supplied from the fluid supply means can flow; a retainer ring attached to an outer periphery of the carrier base and defining a space for holding a workpiece; a sheet supporter having a body having at least one fluid opening communicating with the fluid outlet/inlet and provided inside the space for holding the workpiece, a flexible outer diaphragm extending from an outer peripheral surface of the body to a position corresponding to the outer peripheral rim of the workpiece, and a ring-shaped outer edge projecting from an outer rim of the outer diaphragm to the outer peripheral rim of the workpiece; and a flexible sheet with an outer peripheral rim air-tightly affixed to an end of the outer edge and defining a pressure chamber communicating with the fluid opening together with the sheet supporter.

Further, another aspect of the invention, a seal member allowing movement of the outer edge of the seal supporter in the carrier is interposed between the outer edge and the retainer ring or carrier base so as to make air-tight the space existing at the opposite side of the pressure chamber from the outer diaphragm and holes are formed in the outer diaphragm to communicate the space and pressure chamber.

Further, another aspect of the invention, a seal member allowing movement of the outer edge is interposed between the outer edge and the retainer ring or carrier base so as to make air-tight the space existing at the opposite side of the pressure chamber from the outer diaphragm and wherein a fluid outlet/inlet communicating with the space is provided at either of the carrier base or the body of the sheet supporter.

Further, another aspect of the invention, an inner hole of a predetermined diameter is provided at a center of the body of the sheet supporter in the carrier, wherein inside the inner hole there are formed a flexible inner diaphragm extending from the inner circumferential surface of the inner hole toward the center and a ring-shaped inner edge projecting from the inner rim of the inner diaphragm to the sheet side and air-tightly fixed at its end to the sheet; and wherein fluid of a desired pressure is supplied from the fluid supply means to each of the plurality of chambers defined by the sheet supporter, carrier base, retainer ring, and sheet.

Further, another aspect of the invention, at least two sheet supports with different diameters in the carrier are arranged concentrically so that the inner edge of one does not contact the outer edge of the other and wherein fluid of a desired pressure is supplied from the fluid supply means to each of the plurality of chambers defined by the sheet supporter, carrier base, retainer ring, and sheet.

Further, another aspect of the invention, a through hole communicating the pressure chamber and outside is provided at an outer edge positioned at the outer peripheral side of the workpiece held by the carrier and the fluid in the pressure chamber is leaked to the outside through the through hole.

Further, another aspect of the invention, a tube inserted through a hole passing through the retainer ring of the carrier in the width direction is inserted into a through hole of the outer edge air-tightly and the fluid in the pressure chamber is leaked to the outside through the tube.

Further, another aspect of the invention, a hole is provided in the outer diaphragm positioned at the outer peripheral side of the workpiece held in the carrier and a through hole is provided in the carrier base communicating to the outside and wherein a tube inserted through a through hole of the carrier base is inserted into a hole of the outer diaphragm air-tightly.

Further, another aspect of the invention, the portion above the outer diaphragm positioned at the outer peripheral side of the workpiece held in the carrier is covered by a flexible ring member to define an air-tight space and wherein a hole communicating with the space is provided in the outer diaphragm, a hole is provided in a portion of the ring member in contact with the lower surface of the carrier base, a through hole communicating the hole and the outside is provided in the carrier base, and the fluid in the pressure chamber is leaked to the outside through the hole of the outer diaphragm, the hole of the ring member, and the through hole of the carrier base.

Further, another aspect of the invention, a valve for controlling the flow rate of a fluid is attached at the fluid outflow side end of the tube of the carrier.

Further, another aspect of the invention, the sheet of the carrier is provided with at least one hole communicating with the pressure chamber and wherein the fluid in the pressure chamber of the carrier is made to flow out from the at least one hole to between the sheet and workpiece.

Further, another aspect of the invention, the at least one hole of the sheet of the carrier is arranged to be substantially facing the pressure side opening of at least one fluid opening provided at the body of the sheet supporter.

Further, another aspect of the invention, part of the holes of the sheet of the carrier are communicated through tubes with part of the fluid openings provided in the body of the sheet supporter.

Further, another aspect of the invention, the sheet of the carrier is made a double layer structure of a hard sheet and a soft sheet, the hard sheet is provided with at least one hole communicating with the pressure chamber and the outer periphery of the upper surface is air-tightly affixed to the lower surface of the outer edge of the sheet supporter, the centers of the hard sheet and the soft sheet are partially bonded together, and the fluid in the pressure chamber is made to flow out from the at least one hole to between the hard sheet and the soft sheet.

Further, another aspect of the invention, further comprises: a manometer attached to the carrier for detecting a fluid pressure in the pressure chamber; a comparator/controller for comparing the detected output value of the manometer and a reference output value determined in advance, outputting a pressure reduction signal indicating the pressure difference when the detected pressure value is larger than the reference pressure value, and outputting a pressure increase signal indicating the pressure difference when the detected output value is smaller than the reference pressure value; and a pressure regulator for reducing the fluid pressure by the fluid supply means by exactly a pressure corresponding to the pressure difference indicated by the pressure reduction signal when the pressure reduction signal is input and increasing the fluid pressure by the fluid supply means by exactly a pressure difference indicated by the pressure increase signal when the pressure increase signal is input.

Further, another aspect of the invention, further comprises: a display for displaying the fluid output value detected by the pressure regulator.

Further, another aspect of the invention, the comparator/controller sends out an alarm or stops the rotational driving means when the fluid pressure value is at least a first pressure level higher than the reference pressure value or not more than a second pressure level lower than the reference pressure value.

Further, CMP apparatuses utilizing the carriers according to the above aspects of the invention also can stand as inventions.

Therefore, another aspect of the invention, a CMP apparatus comprises: a platen having a polishing pad attached to its surface; a carrier rotatable in a state holding a workpiece on the polishing pad of the platen; a fluid supplying means able to supply a fluid of a desired pressure to the carrier; and a rotational driving means for rotating the carrier while pressing against it; the carrier comprising a carrier base having a fluid outlet/inlet through which a fluid supplied from the fluid supply means can flow; a retainer ring attached to an outer periphery of the carrier base and defining a space for holding a workpiece; a sheet supporter having a ring-shaped body arranged in the space for holding the workpiece, a flexible diaphragm for holding the body, and a ring-shaped edge projecting from an outer rim of the body to the outer peripheral rim side of the workpiece; and a flexible sheet with an outer peripheral rim air-tightly affixed to an end of the edge and defining a pressure chamber communicating with the fluid outlet/inlet.

Further, another aspect of the invention, a through hole communicating the pressure chamber and outside is provided at the edge of the carrier.

Further, another aspect of the invention, a tube inserted through a hole passing through the retainer ring of the carrier in the width direction is inserted into a through hole of the edge air-tightly.

Further, another aspect of the invention, a valve for controlling the flow rate of a fluid is attached at the fluid outflow side end of the tube of the carrier.

Further, another aspect of the invention, the sheet of the carrier is provided with at least one hole communicating with the pressure chamber and wherein the fluid in the pressure chamber is made to flow out from the at least one hole to between the sheet and workpiece.

Further, another aspect of the invention, the at least one hole of the sheet of the carrier is arranged to be substantially facing the pressure side opening of at least one fluid opening provided at the carrier base.

Further, another aspect of the invention, part of the holes of the sheet of the carrier are communicated through tubes with part of the fluid openings provided in the carrier base.

Further, another aspect of the invention, the sheet of the carrier is made a double layer structure of a hard sheet and a soft sheet, wherein the hard sheet is provided with at least one hole communicating with the pressure chamber and the outer periphery of the upper surface is air-tightly affixed to the lower surface of the outer edge of the sheet supporter, wherein the centers of the hard sheet and the soft sheet are partially bonded together, and wherein the fluid in the pressure chamber is made to flow out from the at least one hole to between the hard sheet and the soft sheet.

Further, another aspect of the invention, further comprises: a manometer attached to the carrier for detecting a fluid pressure in the pressure chamber; a comparator/controller for comparing the detected output value of the manometer and a reference output value determined in advance, outputting a pressure reduction signal indicating the pressure difference when the detected pressure value is larger than the reference pressure value, and outputting a pressure increase signal indicating the pressure difference when the detected output value is smaller than the reference pressure value; and a pressure regulator for reducing the fluid pressure by the fluid supply means by exactly a pressure corresponding to the pressure difference indicated by the pressure reduction signal when the pressure reduction signal is input and increasing the fluid pressure by the fluid supply means by exactly a pressure difference indicated by the pressure increase signal when the pressure increase signal is input.

Further, another aspect of the invention, further comprises: a display for displaying the fluid output value detected by the pressure regulator.

Further, another aspect of the invention, the comparator/controller sends out an alarm or stops the rotational driving means when the fluid pressure value is at least a first pressure level higher than the reference pressure value or not more than a second pressure level lower than the reference pressure value.

BRIEF DESCRIPTION OF THE DRAWINGS

The above and other objects, features, and advantages of the present invention will become more readily apparent from the following description of presently preferred embodiments of the invention taken in conjunction with the accompanying drawings, in which.

DESCRIPTION OF THE PREFERRED EMBODIMENTS

Preferred embodiments of the present invention will be explained below with reference to the drawings.

(First Embodiment)

Figure 1:
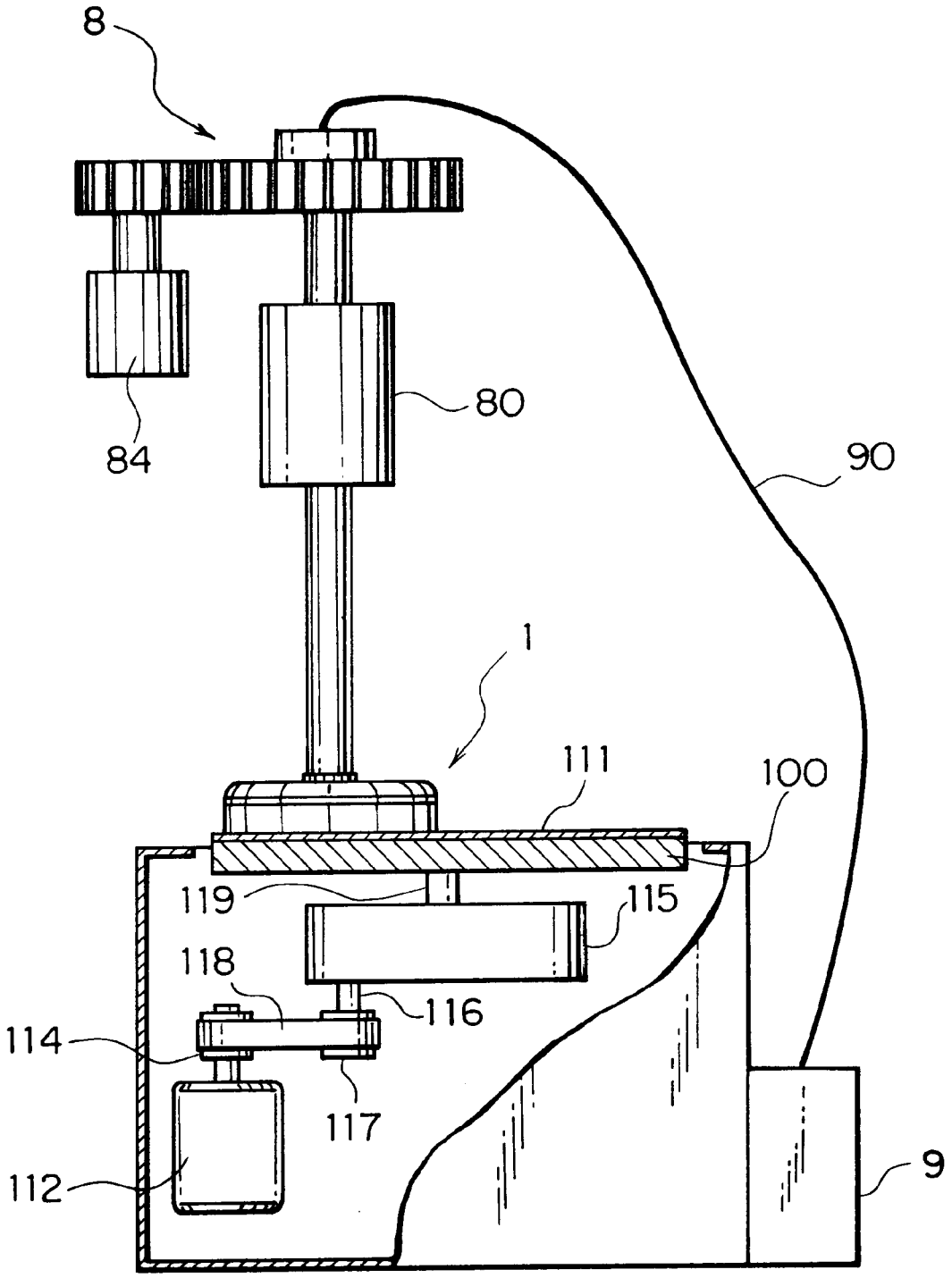
FIG. 1 is a partially cutaway front view of a CMP apparatus according to a first embodiment of the present invention.

FIG. 1 is a partially cutaway front view of a CMP apparatus according to a first embodiment of the present invention.

As shown in FIG. 1, the CMP apparatus is provided with a platen 110 to the surface of which is attached a polishing pad 111, a carrier 1, a rotational drive mechanism 8 as a rotational driving means for the carrier 1, and an air pump 9 as a fluid supply means.

The platen 110 is designed to be driven to rotate by a main motor 112 in the apparatus housing.

That is, a belt 118 is wrapped around a pulley 114 attached to the main motor 112 and a pulley 117 attached to an input shaft 116 of a transmission 115. The platen 110 is attached to an output shaft 119 of the transmission 115.

Due to this, the rotation of the main motor 112 is transmitted to the pulley 117, the rotation of the pulley 117 is converted in speed by the transmission 115 and transmitted to the output shaft 119, and the platen 110 rotates at a predetermined speed.

The rotational drive mechanism 8 is a mechanism for rotating the carrier 1 while pressing it against the platen 110 and is provided with a cylinder 80 and a motor 84.

Figure 2:
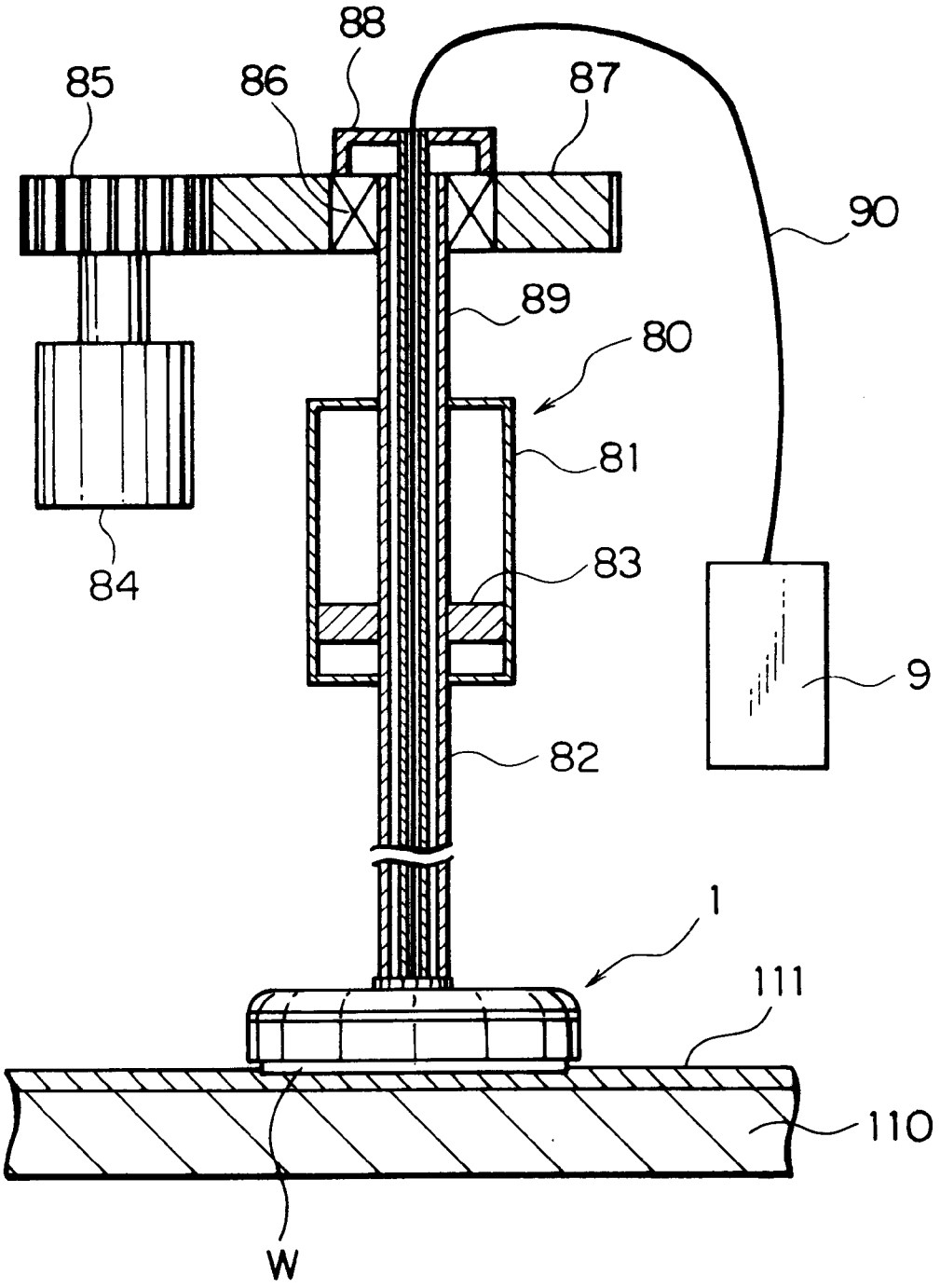
FIG. 2 is a sectional view of a rotational drive mechanism.

FIG. 2 is a sectional view of the rotational drive mechanism 8.

As shown in FIG. 2, the cylinder 80 is comprised of a piston rod 82 passing through a cylinder body 80 and a piston 83 fitting air-tightly in the cylinder body 81 in a state affixed to the outside of the piston rod 82.

Due to this, by adjusting the air pressure in the cylinder body 81, it is possible to move the piston rod 82 up and down together with the piston 83 and thereby adjust the force pressing against the carrier 1.

On the other hand, the motor 84 is attached to the piston rod 82 of the cylinder 80. That is, a gear 85 of the shaft of the motor 84 is engaged with a gear 87 attached to the upper part of the piston rod 82 through a bearing 86. Further, the upper end of a cylindrical inner rod 89 is affixed to a support member 88 fixed to the upper surface of the gear 87.

Due to this, when the motor 84 is driven, its rotation is transmitted through the gears 85 and 87 and the support member 88 to the inner rod 89 and the inner rod 89 rotates in the piston rod 82 at a predetermined speed.

The carrier 1 is constructed to be able to rotate in a state holding the wafer W on the polishing pad 111 of the platen 110 and is attached to the lower end of the piston rod 82.

Figure 3:
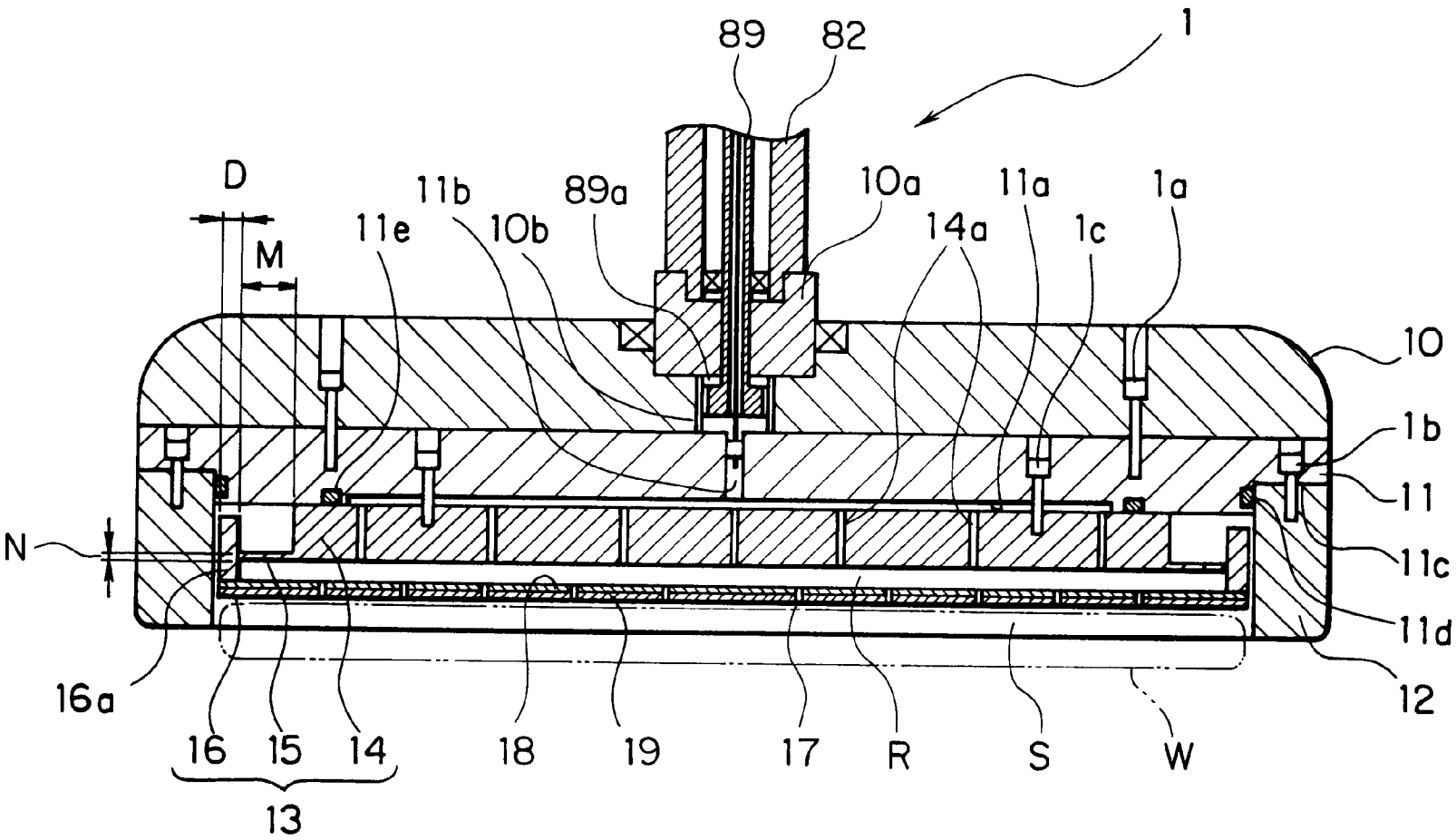
FIG. 3 is a sectional view of the structure of a carrier.
Figure 4:
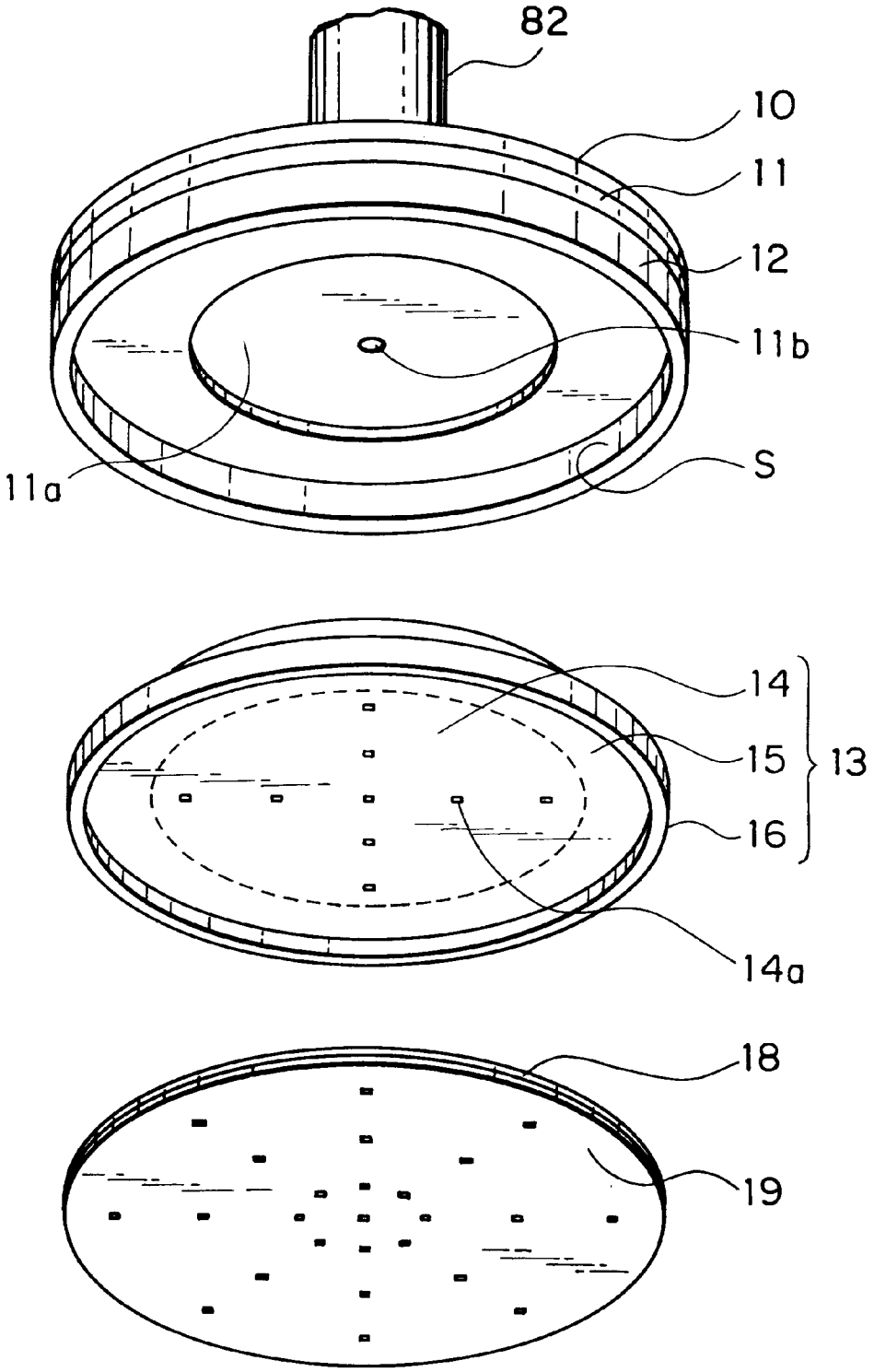
FIG. 4 is a disassembled perspective view of the carrier.

FIG. 3 is a sectional view of the structure of the carrier 1, while FIG. 4 is a disassembled perspective view of the same.

As shown in FIG. 3 and FIG. 4, the carrier 1 is provided with a housing 10, a carrier base 11, a retainer ring 12, a sheet supporter 13, a hard sheet 18, and a soft backing sheet 19.

The housing 10, as shown in FIG. 3, has at its center a freely rotatable connecting member 10*a*. The lower end of the piston rod 82 is connected to this connecting member 10*a*. Further, the housing 10 has an internal gear 10*b* at the lower side of the connecting member 10*a*. The internal gear 10*b* engages with an external gear 10*a* formed at the lower end of the inner rod 89 passing through a center hole of the connecting member 10*a*.

Due to this, when the inner rod 89 rotates driven by the motor 84, the engagement of the internal gear 10*b* and the external gear 89*a* causes the rotational force of the motor 84 to be applied to the housing 10.

The carrier base 11 is affixed by screws 1*a* to the lower surface of the housing 10. A shallow depression 11*a* is formed in its lower surface. At the center of this depression 11*a* is formed an air outlet/inlet 11*b* for allowing the entry and exit of air of the air pump 9, explained later.

The retainer ring 12 is attached to the lower side of the outer periphery of the carrier base 11.

Specifically, a depression 11*c* of the same width as the retainer ring 12 is cut into the lower surface of the outer periphery of the carrier base 11. The upper part of this retainer ring 12 is fit into this depression 11*c*. The retainer ring 12 is affixed in this state by the screws 1*b*. An O-ring 11*d* is fit between the retainer ring 12 and the carrier base 11 whereby the air-tightness is maintained.

Due to this, as shown in FIG. 4 as well, an air-tight space S for holding the wafer W is defined at the inside of the retainer ring 12.

The sheet supporter 13 is formed by for example PVC (polyvinyl chloride). As shown in FIG. 3, the sheet supporter 13 is affixed to the lower surface of the carrier 11 dy screws 1*c* in a state arranged in the space S or holding the wafer W.

The sheet supporter 13 is formed by a supporter body 14 (body), a diaphragm 15 (outer diaphragm), and an edge ring 16 (outer edge).

Specifically, the supporter body 14 is directly affixed to the lower surface of the carrier base 11 by screws 1*c*. A plurality of air holes 14*a* (fluid openings) formed in the supporter body 14 are communicated through the depression 11*a* to the air outlet/inlet 11*b*. Further, an O-ring 11*e* is fit at the outside of the depression 11*a*, whereby the air-tightness between the carrier base 11 and supporter body 14 is held and the air in the depression ila is prevented from leaking to the outside.

The diaphragm 15 extends substantially horizontally from the lower end of the outer peripheral surface of the supporter body 14 to the outer peripheral rim side of the wafer W. The extension length M of the diaphragm 15 is set to be a value from 10 mm to 50 mm. Further, the thickness N of the diaphragm 15 is set to a value in the range of 0.5 mm to 2.0 mm. The diaphragm 15 is given flexibility.

The edge ring 16 is formed in a ring shape along the outer rim of the diaphragm 15 and has a width D set to a value in the range from 1 mm to 10 mm. This edge ring 16 projects vertically and has a lower projection 16*a* which is positioned at the outermost peripheral rim of the wafer W. That is, it is set so that the diameter of the edge ring 16 becomes substantially equal to the diameter of the wafer W.

The hard sheet 18 is formed by a vinyl chloride resin, a polyethylene resin, an acrylic resin, a polycarbonate resin, or another fusible material and has a thickness set to a value in the range of 0.1 mm to 0.5 mm.

Further, the soft backing sheet 19 is formed by a silicone rubber, a polyurethane resin foam material, a fluororubber, or nitrile rubber, or other soft material and has a thickness set to a value in the range from 0.1 mm to 2.0 mm.

The hard sheet 18 and the soft backing sheet 19 are bonded in a state with the hard sheet 18 at the top and are shaped as disks with diameters substantially the same as the diameter of the edge ring 16.

Further, the outer peripheral rim of the top hard sheet 18 is affixed air-tightly to the lower surface of the lower side projection 16*a* of the edge ring 16 by a nonfusible adhesive or a fusible adhesive.

Due to this, a pressure chamber R communicating with the air holes 14*a* of the supporter body 14 is defined between the hard sheet 18 and the sheet supporter 13. When the soft backing sheet 19 contacts the wafer W, the hard sheet 18 and the soft backing sheet 19 flex following the warping or waviness etc. of the wafer W.

Note that the reference numeral 17 shows a wafer suction hole formed passing through the hard sheet 18 and the soft backing sheet 19.

On the other hand, the air pump 9 shown in FIG. 1 and FIG. 2 is a device for supplying air of a desired pressure into the pressure chamber R to make the inside of the pressure chamber R a positive pressure or sucking air out from the pressure chamber 1*a* to make the pressure chamber R a negative pressure. Specifically, an air hose 90 is passed through the inner rod 89 and, as shown in FIG. 3, the front end thereof is fit into the air outlet/inlet 11*b* of the carrier base 11.

Next, the operation of the CMP apparatus of this embodiment will be explained.

Figure 5:
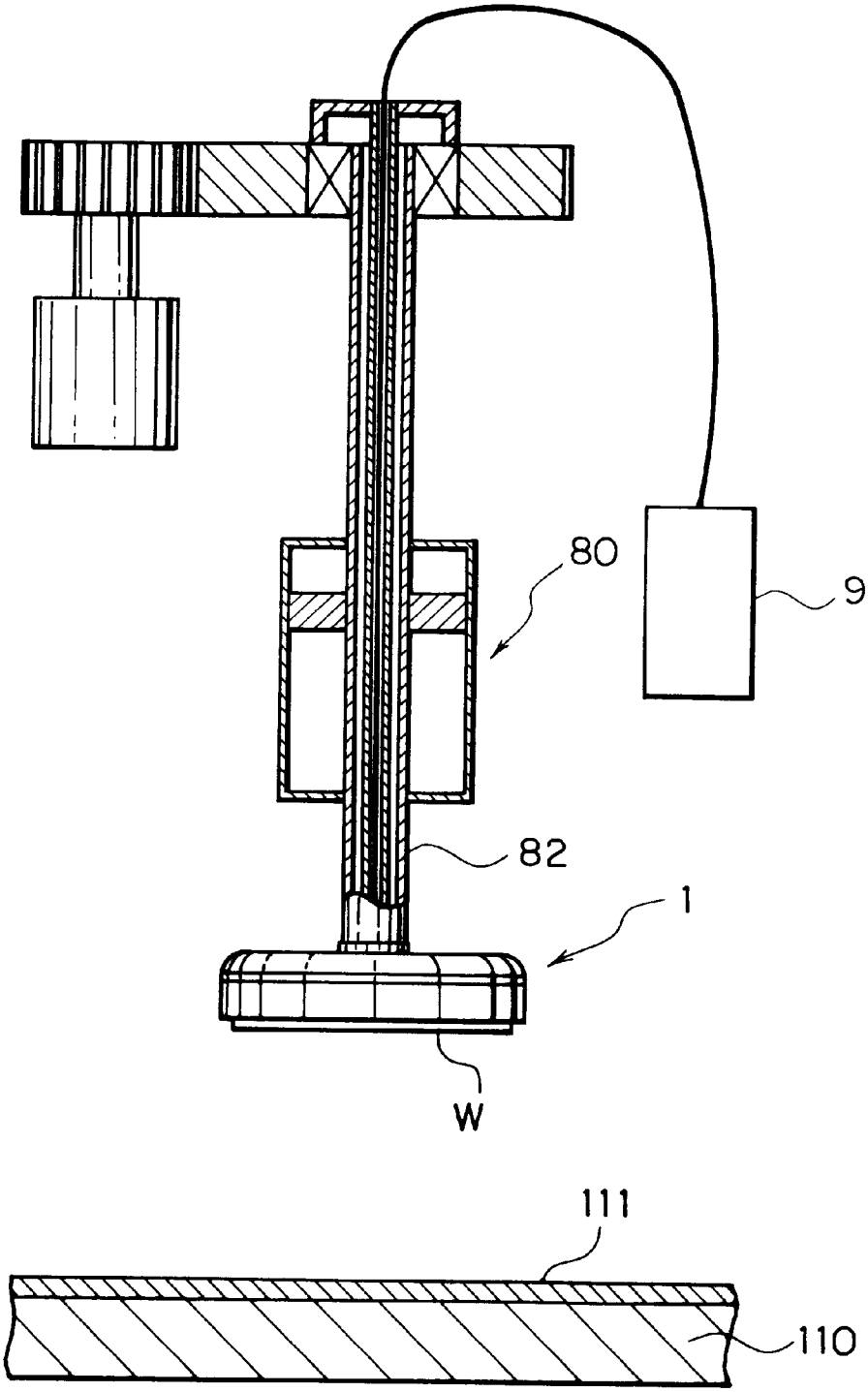
FIG. 5 is a front view of the state where the wafer is sucked to the platen.
Figure 6:
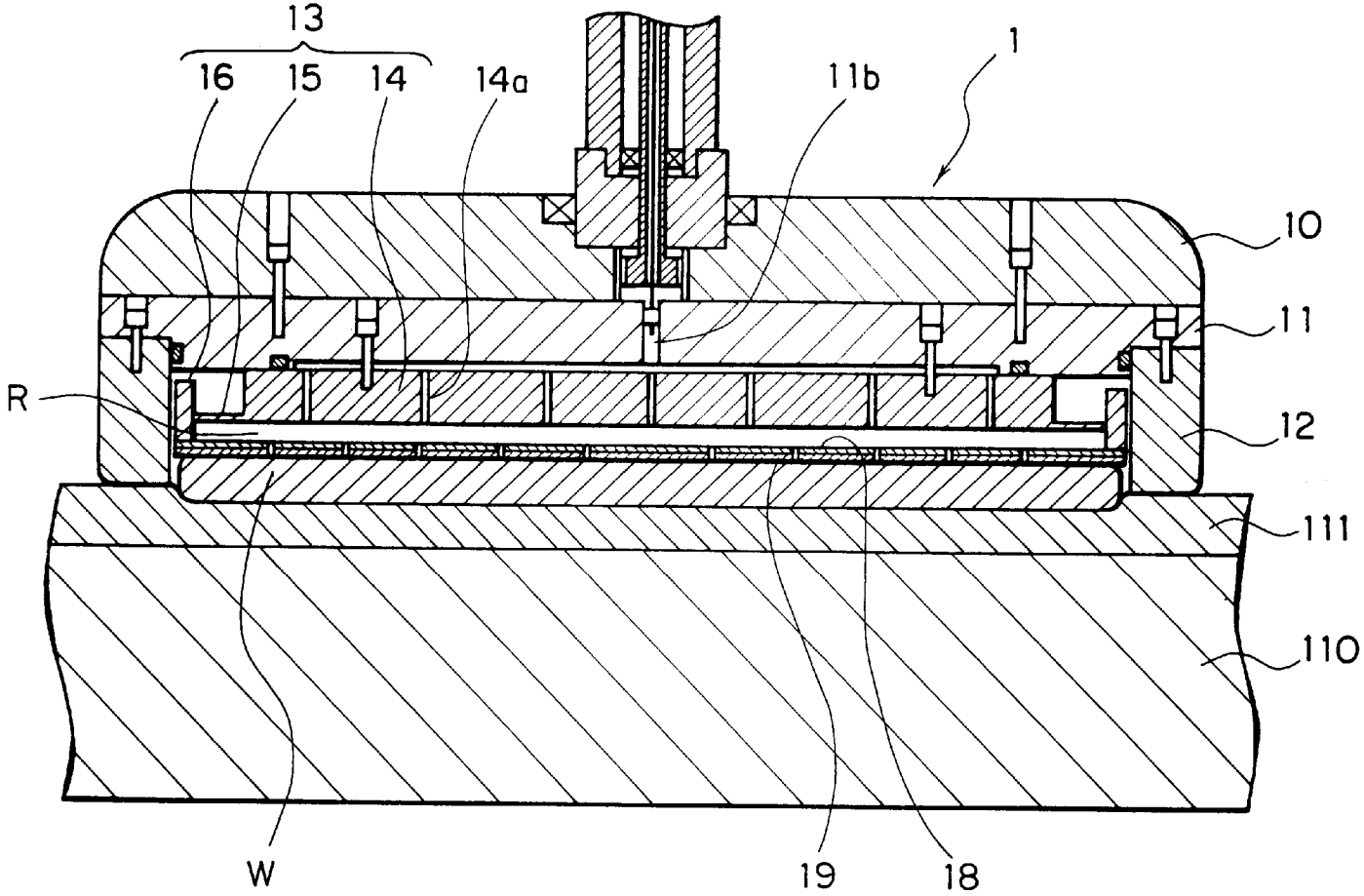
FIG. 6 is a sectional view of the state where the wafer is being pressed against.

To hold the wafer W by the carrier 1 and transport it to the polishing pad 111 of the platen 110, as shown in FIG. 5, the wafer W is made to abut against the lower surface of the soft backing sheet 19 and the air pump 9 is driven to suck air out in that state.

This being done, the air in the pressure chamber R and suction hole 17 of the carrier 1 shown in FIG. 3 is sucked out, the inside of the pressure chamber R becomes a negative pressure, and the wafer W is sucked to the soft backing sheet 19 through the suction hole 17.

Figure 8:
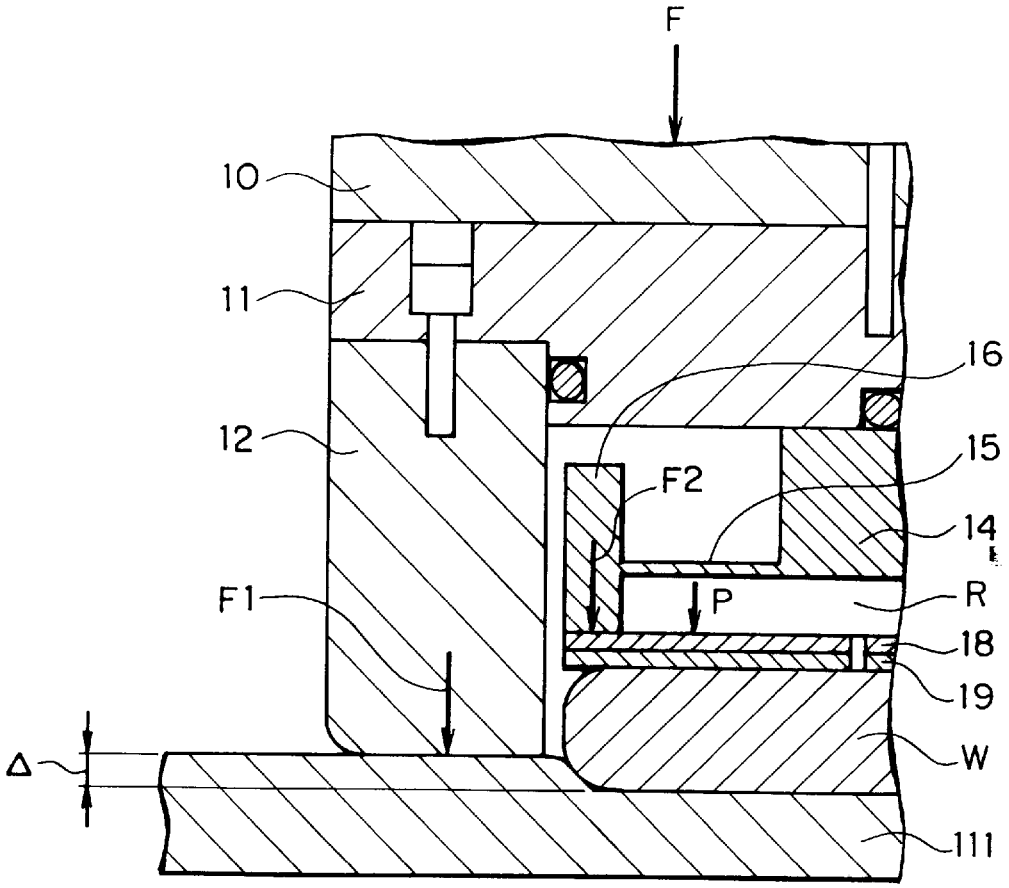
FIG. 8 is a sectional view of the pressing force applied to the retainer ring and edge ring.

In this state, the cylinder 80 is driven and the piston rod 82 is made to descend until the wafer W contacts the polishing pad 111, the, as shown in FIG. 8, the wafer W is pressed against the top of the polishing pad 111 by a predetermined pressing force F.

Suitably thereafter, the air pump 9 is driven to supply air, air is supplied from the air hose 90 to the pressure chamber R, and the pressure chamber R is made a positive pressure.

Figure 7:
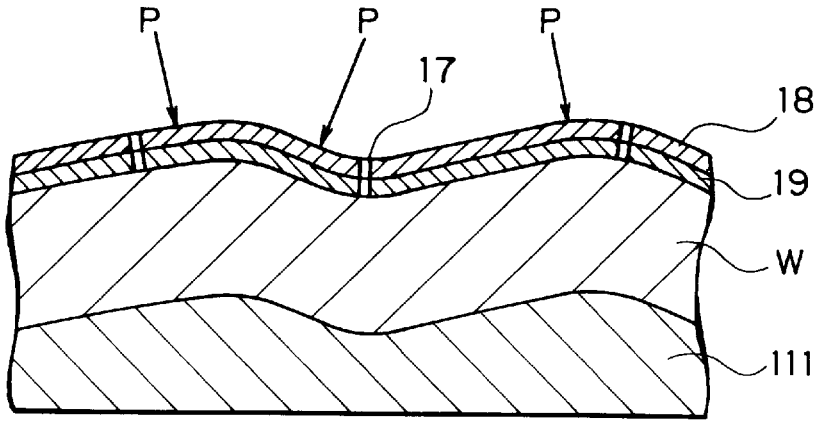
FIG. 7 is a sectional view of the state where the hard sheet and soft backing sheet follow unevenness of the wafer.

This being done, as shown in FIG. 7, the hard sheet 18, the soft backing sheet 19, and the polishing pad 111 deform following the unevenness etc. of the wafer W, a uniform air pressure P is applied to substantially the entire upper surface of the wafer W, and the polishing pad 111 follows the unevenness etc. of the lower surface of the wafer W.

At this time, the soft backing sheet 19 presses against the wafer W across substantially the entire lower surface. Further, the area of contact of the soft backing sheet 19 with the wafer W is extremely large. Therefore, the compressed air in the suction hole 17 does not escape outside through the area between the soft backing sheet 19 and the wafer W.

In this state, if the motors 84 and 112 shown in FIG. 1 are driven to supply the not shown polishing fluid and make the carrier 1 and the platen 110 rotate in opposite directions to each other, the lower surface of the wafer W will be polished by the rotating polishing pad 111.

At the time of such polishing, the pressing force F applied by the cylinder 80 to the carrier 1, as shown in FIG. 8, becomes the sum of the pressing force F1 and the pressing force F2, where the pressing force to the retainer ring 12 is F1 and the pressing force to the edge ring 16 is F2.

Therefore, the pressing force F2 applied to the edge ring 16 is decreased or increased by the increase or decrease of the pressing force F1.

Further, the pressing force F1 to the retainer ring 12 is considered to be substantially inversely proportional to the amount of projection Δ of the wafer W from the retainer ring 12.

Accordingly, the pressing force F2 to the edge ring 16 is considered to become larger as the amount of projection Δ of the wafer W becomes larger.

Therefore, in the initial state, the amount of projection Δ is set so that the pressure resulting from dividing the pressing force F2 to the edge ring 16 by the sectional area of the edge ring 16 becomes substantially equal to the air pressure P in the pressure chamber R so as to make the polishing rate of the outer peripheral rim of the wafer W substantially equal to the polishing rate of the other portions of the wafer W.

By setting the initial conditions in this way, a uniform pressure is applied to the entire surface of the wafer W and the wafer W becomes uniformly polished.

If the polishing work is continued for a long period of time, however, the lower surface of the retainer ring 12 is worn down by the friction with the polishing pad 111 and the amount of projection Δ of the wafer W becomes larger than the initial state. As a result, the pressing force F1 to the retainer ring 12 is reduced and the pressing force F2 to the edge ring 16 is increased.

Figure 9:
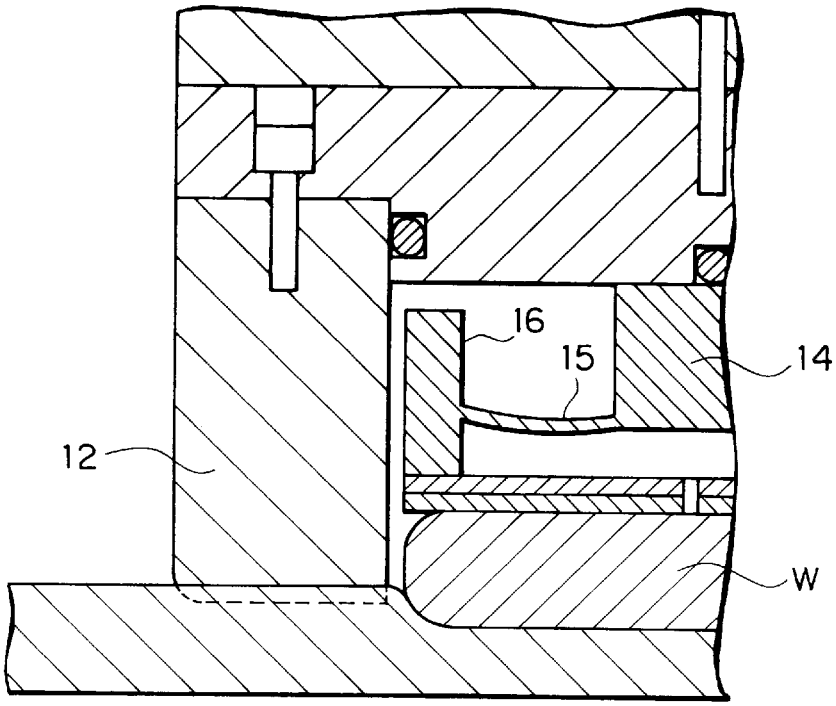
FIG. 9 is a sectional view of the state of flexing of the diaphragm.

Since the diaphragm 15 connecting the edge ring 16 and the supporter body 14 has flexibility, however, when the pressing force F2 to the edge ring 16 starts to increase, as shown in FIG. 9, the diaphragm 15 flexes concavely and acts to relieve the increase of the pressing force F2.

As a result, the pressing force F2 to the edge ring 16 never sharply increases as in the first to third examples of the related art. That is, even if the retainer ring 12 is worn by more than 20 $\mu$m from the initial state, the polishing rate of the outer peripheral rim of the wafer W does not become so large and the uniformity of polishing of the wafer W is maintained.

The present inventors conducted the following three types of experiments to give evidence of this point.

Figure 10:
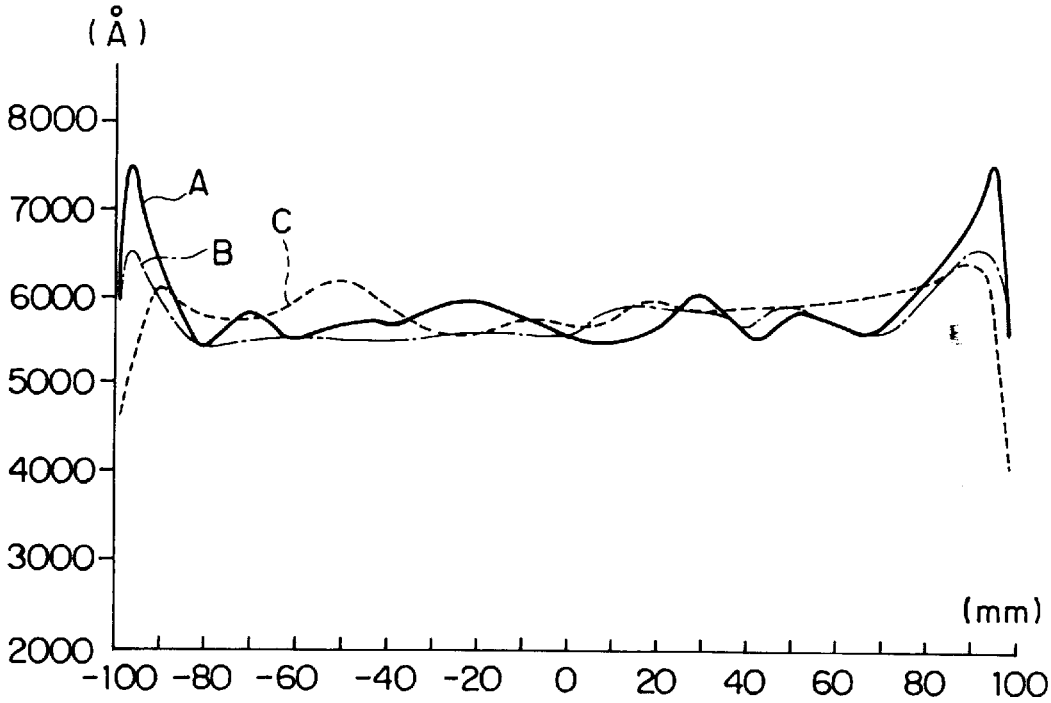
FIG. 10 is a graph of experimental data.

FIG. 10 is a graph of experimental data. The abscissa shows the diameter of the wafer W, while the ordinate shows the thickness of the oxide film of the wafer W.

The experiments were performed setting the thickness N of the diaphragm 15 to 1 mm and polishing an unpolished wafer W having a diameter of 200 mm and having an oxide film of a thickness of 10000 angstroms on its surface under conditions of a pressing force F of 207 kg and an air pressure P of 0.4 kg/cm$^2$ for 3 minutes.

First, the retainer ring 12 was adjusted to give an amount of projection Δ of the wafer W of 150 $\mu$m to polish the oxide film of the wafer W. This being done, as shown by the solid line A of FIG. 10, the center of the oxide film of the wafer W was polished to about 5500 angstroms, while the outer peripheral rim of the oxide film was only polished to about 7500 angstroms. Next, the amount of projection Δ of the wafer W is adjusted to 200 μm to polish the oxide film of the unpolished wafer W, whereupon as shown by the dot-dash line B in FIG. 10, the center of the oxide film is polished to about 5500 angstroms and the outer peripheral rim is polished to about 6600 angstroms.

Finally, the amount of projection Δ of the wafer W is adjusted to 250 μm to polish the oxide film of the unpolished wafer W, whereupon as shown by the broken line C in FIG. 10, the center of the oxide film is polished to about 5500 angstroms and, further, the outer peripheral rim is polished to about 6100 angstroms.

When the center of the oxide film is polished to about 5500 angstroms and the outer periphery is polished to about 6600 angstroms as shown by the dot-dash line B of FIG. 10 and when the center of the oxide film is polished to about 5500 angstroms and the outer periphery is polished to about 6100 angstroms as shown by the broken line C of FIG. 10, it is deemed that there is uniformity in polishing and the polishing is in the allowable range.

Accordingly, by initially setting the amount of projection Δ of the wafer W to 200 μm, it is possible to obtain a margin of 50 μm for the amount of wear of the retainer ring 12. Further, from the results of the above experiments, it is deduced that by setting the amount of projection Δ of the wafer W to 300 μm, the thickness of the oxide film at the outer peripheral rim of the wafer W becomes about 5200 to about 6000 angstroms. If the amount of projection Δ becomes much over 300 μm, the thickness of the outer peripheral rim of the wafer W becomes remarkably smaller than the thickness of the center and so called facial sagging occurs.

As a result, the allowable range of the amount of projection Δ of the wafer W for securing uniformity of polishing is deduced to be about 200 μm to about 300 μm and it is understood that it is possible to obtain an extremely large margin of about 100 μm for the amount of wear of the retainer ring 12.

Accordingly, when operating the CMP apparatus of this embodiment under the above experimental conditions, when initially setting the amount of projection Δ of the wafer W to 200 μm and adjusting the retainer ring 12 when the amount of projection Δ reaches about 300 μm to reset the initial conditions, whereby it is possible to uniformly polish a large number of wafers W.

That is, since the retainer ring 12 does not have to be adjusted until the retainer ring 12 is worn about 100 μm from the initial setting, the frequency of adjustment of the retainer ring 12 becomes less than the examples of the related art explained above and it is possible to raise the operating rate of the CMP apparatus by that amount.

In this way, according to the CMP apparatus of this embodiment, since the rate of increase of the polishing rate of the outer peripheral rim of the wafer W with respect to the amount of wear of the retainer ring 12 is extremely small, it is possible to obtain a large margin of the amount of wear of the retainer ring 12 and it is possible to improve the operating rate of the CMP apparatus.

Further, since the hard sheet 18 and the soft backing sheet 19 are fused to the edge ring 16 and not the retainer ring 12, the hard sheet 18 and the soft backing sheet 19 are not pulled and will not detach from the edge ring 16.

Further, since superfluous members are not provided at the center of the pressure chamber R etc., it is possible to maintain uniformity of the air pressure. Also, since the CMP apparatus is constructed with the retainer ring 12 attached to the outer periphery of the carrier base 11 and with the sheet supporter 13 arranged at the inside of the retainer ring 12 in the state with the housing 10 and the carrier 11 abutting against each other and with the hard sheet 18 and the soft backing sheet 19 attached to the lower side of the sheet supporter 13 to form the pressure chamber R, it is possible to make the CMP apparatus small in size and possible to freely adjust the air pressure in the retainer ring 12 by the air pump 9.

(Second Embodiment)

Figure 11:
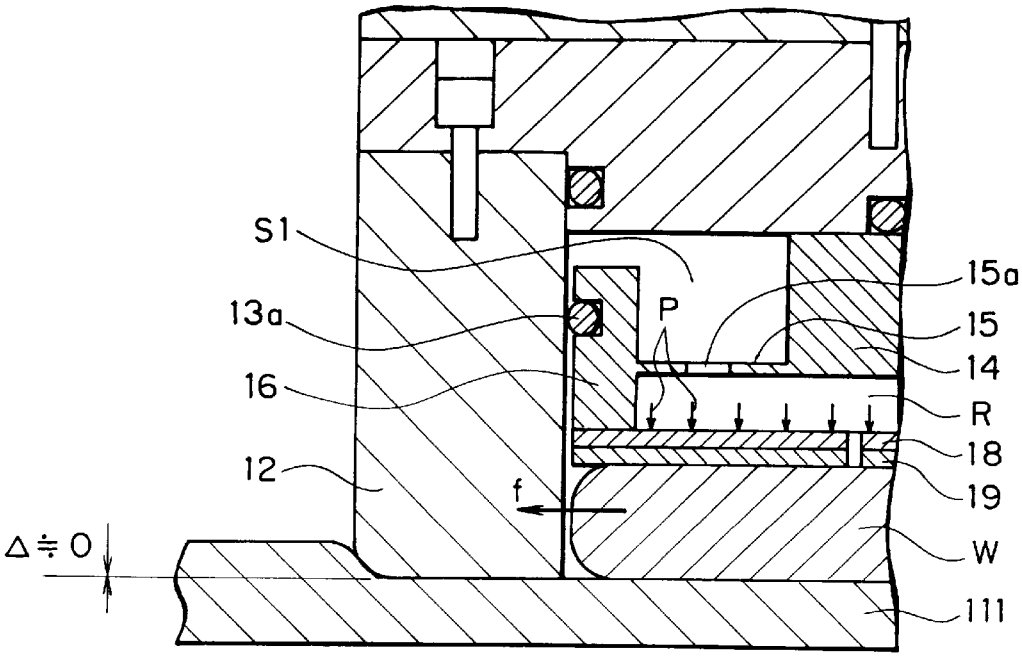
FIG. 11 is a sectional view of essential portions of a CMP apparatus according to a second embodiment of the present invention.

FIG. 11 is a sectional view of essential portions of a CMP apparatus according to a second embodiment of the present invention.

This embodiment differs from the first embodiment in the point that the effect of the air pressure on the diaphragm 15 is eliminated and the initial amount of projection of the wafer W is made substantially zero.

Specifically, as shown in FIG. 11, an O-ring 13*a* (seal member) allowing vertical motion of the edge ring 16 is attached to the outer peripheral surface of the edge ring 16 to make the space between the retainer ring 12 and the edge ring 16 air-tight and thereby define the space S1 at the upper side of the diaphragm 15. A small hole 15*a* is formed in the diaphragm 15 to communicate the space S1 and the pressure chamber R.

Due to this, the pressure inside the pressure chamber R and the pressure inside the space S1 become equal and the air pressures above and below the diaphragm 15 become equal.

That is, the smaller the thickness the diaphragm 15 is set at, the better the diaphragm 15 flexes and the better the pressing force applied to the edge ring 16 by the wear of the retainer ring 12 is absorbed. Accordingly, by setting the thickness of the diaphragm 15 small, the margin of the amount of wear of the retainer ring 12 becomes further larger.

Further, as shown in FIG. 11, if the initial amount of projection Δ of the wafer W is set to zero, the edge ring 16 does not receive the upward force from the outer peripheral rim of the wafer W. Therefore, there is no elastic deformation of the diaphragm 15 and the outer peripheral rim of the wafer W is not pressed by the edge ring 16. Therefore, by setting the amount of projection Δ of the wafer W to zero, only the air pressure P in the pressure chamber R is uniformly applied to the entire surface of the wafer W and the uniformity of polishing of the wafer W is improved.

Figure 12:
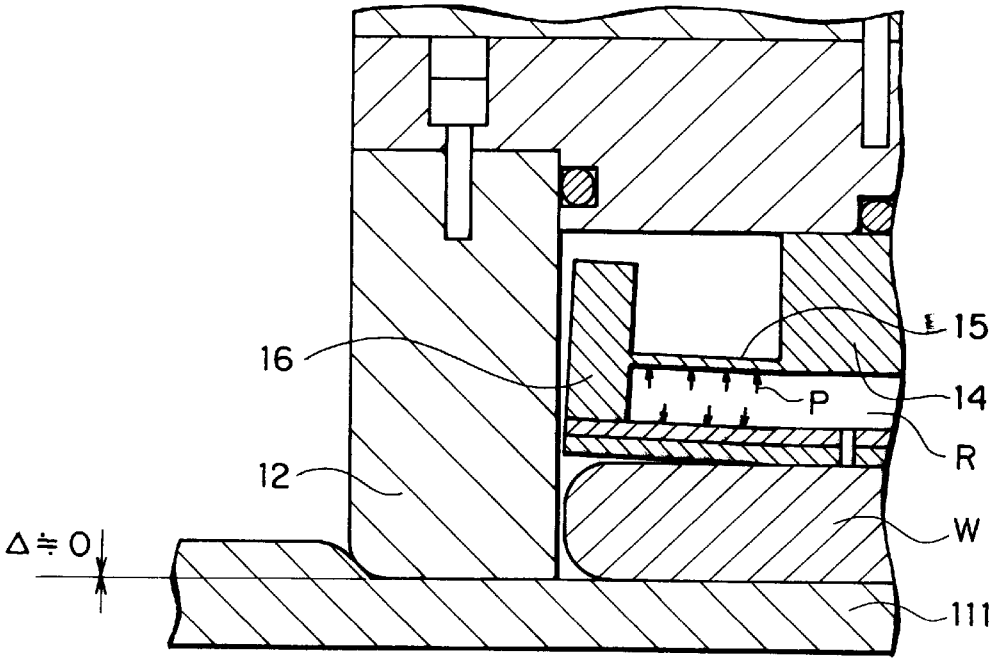
FIG. 12 is a sectional view of a state of flexing of the diaphragm by the air pressure in the pressure chamber.

In the above first embodiment, however, as shown in FIG. 12, since the air pressure P in the pressure chamber R is applied to push the diaphragm 15 upward, if the diaphragm 15 is made thin, the diaphragm 15 will easily deform upward and the outer peripheral rim of the hard sheet 18 and the soft backing sheet 19 will be pulled upward by the edge ring 16. As a result, the air pressure P will no longer act on the outer peripheral rim of the wafer W and it will become impossible to polish the outer peripheral rim of the wafer W.

As opposed to this, in this embodiment, since a small hole 15*a* is formed in the diaphragm 15, the pressures above and below the diaphragm 15 become equal and the diaphragm 15 will not be affected by the air pressure P in the pressure chamber R. As a result, a uniform air pressure P will be applied to the entire surface of the wafer W, including the outer peripheral rim, and it will become possible to uniformly polish the entire surface of the wafer W.

Figure 13:
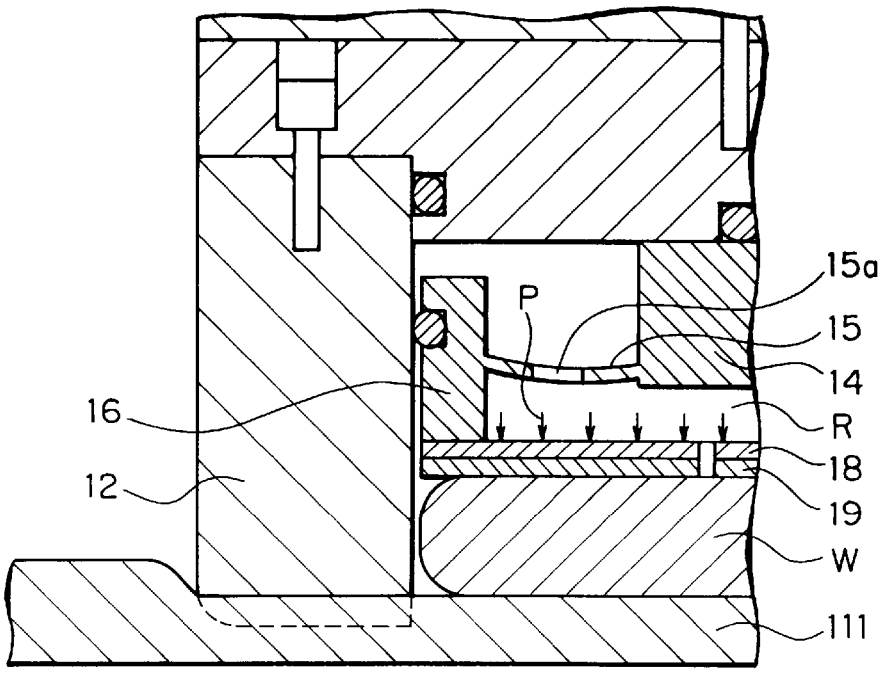
FIG. 13 is a sectional view of a state of flexing of the diaphragm concavely in accordance with an amount of wear of the retainer ring.

Further, as shown in FIG. 13, if the retainer ring 12 becomes worn, the edge ring 16 will receive the force from the wafer W and the diaphragm 15 will deform concavely in accordance with the amount of wear of the retainer ring 12. That is, the diaphragm 15 will function to relieve the increase in the pressing force on the edge ring 16 caused by the wear of the retainer ring 12.

In this way, according to the CMP apparatus of this embodiment, it is possible to make the thickness of the diaphragm 15 smaller and make the margin of the amount of wear of the retainer ring 12 larger and it becomes possible to press against the entire surface of the wafer W by only the air pressure P in the pressure chamber R.

Meanwhile, it is also conceivable that a large lateral force f will be applied to the workpiece W at the time of polishing and that this thin lateral direction force f will be transmitted through the hard sheet 18 and the soft backing sheet 19 to the edge ring 16 resulting in the edge ring 16 contacting the retainer ring 12.

The diaphragm 15, however, is shaped with a straight cross-section extending substantially horizontally from the supporter body 14 and is resistant to the lateral direction force f, so the situation where the diaphragm 15 extends to the retainer ring 12 side and the edge ring 16 contacts the retainer ring 12 never occurs.

The rest of the configuration, action, and effect are the same as the first embodiment, so explanations thereof will be omitted.

Figure 14:
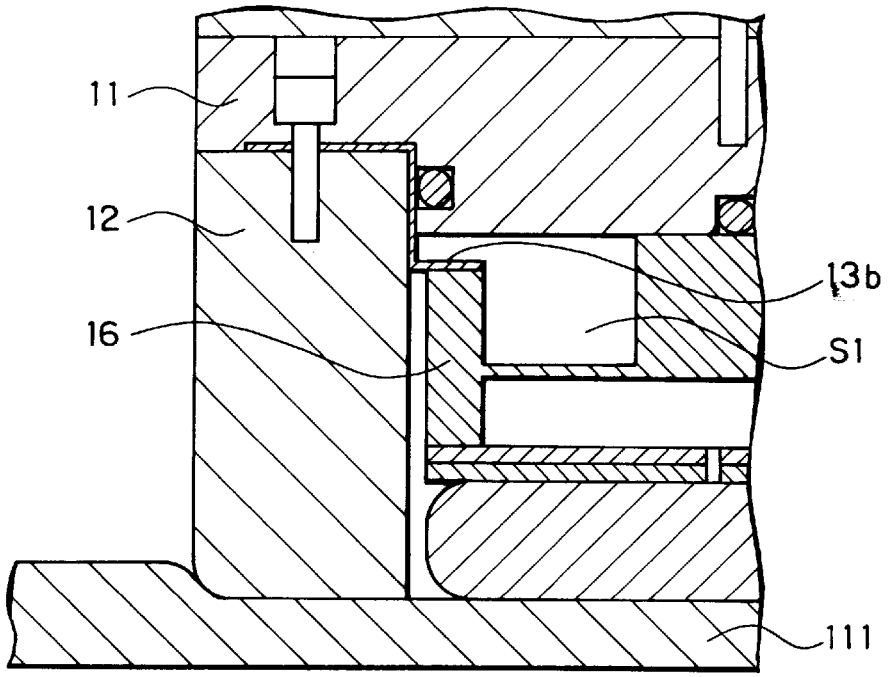
FIG. 14 is a sectional view of a modification of the second embodiment.

Note that in this embodiment, an O-ring 13*a* was used as the seal member to define the air-tight space S1, but as shown in FIG. 14, it is also possible to grip a flexible ring-shaped diaphragm 13*b* by the carrier base 11 and the retainer ring 12 and affix the upper surface of the edge ring 16 to the lower surface of the diaphragm 13*b* to define the air-tight space S1.

(Third Embodiment)

Figure 15:
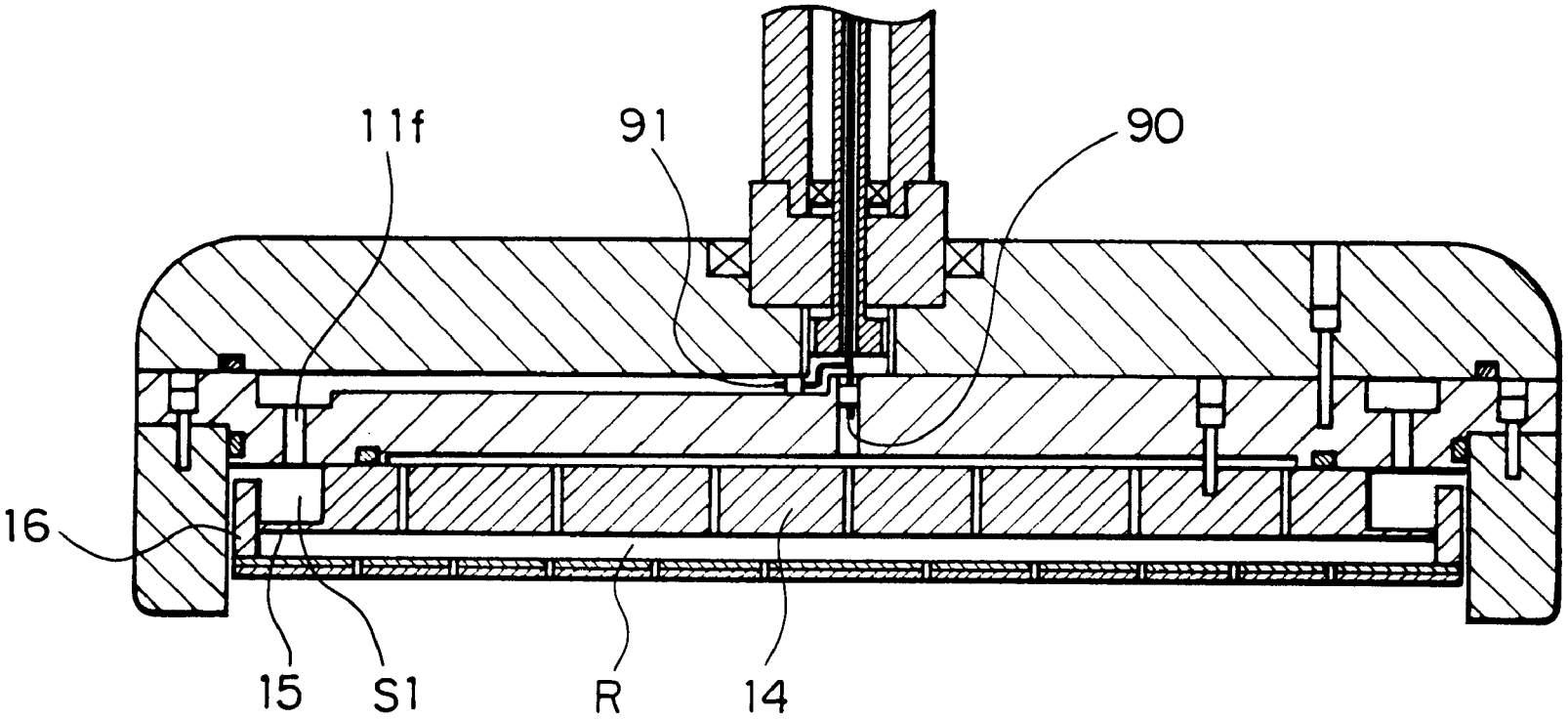
FIG. 15 is a sectional view of a carrier of a CMP apparatus according to a third embodiment of the present invention.

FIG. 15 is a sectional view of a carrier of a CMP apparatus according to a third embodiment of the present invention.

This embodiment differs from the first and the second embodiments in the point that the space S1 is separate from the pressure chamber R and the air pressure of the space S1 is independently adjustable.

That is, a small hole is not formed in the diaphragm and the diaphragm 15 is used to separate the space S1 and the pressure chamber R and also the air outlet/inlet 11*f* communicating with the space S1 is formed in the carrier base 11. Further, the air hose 91 from the air pump 9 is inserted through the air outlet/inlet 11*f*.

Due to this, air of a different pressure is supplied from the air pump 9 shown in FIG. 1 through the air hoses 90 and 91 to the pressure chamber R and the space S1 and the pressure difference between the air pressure inside the pressure chamber R and the air pressure inside the space S1 acts on the diaphragm 15.

Accordingly, by making the air pressure inside the space S1 larger than the air pressure inside the pressure chamber R, it is possible to make the diaphragm 15 flex concavely. Further, by adjusting the magnitude of the air pressure inside the space S1, it is possible to adjust the amount of flexing of the diaphragm 15. Conversely, by making the air pressure inside the space S1 smaller than the air pressure inside the pressure chamber R, it is possible to make the diaphragm 15 flex convexly. Further, by adjusting the air pressure inside the space S1, it is possible to adjust the amount of flexing of the convex diaphragm 15.

That is, by adjusting the flexing direction and the flexing amount of the diaphragm 15 in this way, it is possible to adjust the pressing force applied to the edge ring 16 and as a result it is possible to freely control the polishing rate of the outer peripheral rim of the wafer W.

The rest of the configuration, action, effect, and modifications are the same as the first and second embodiments, so explanations thereof will be omitted.

(Fourth Embodiment)

Figure 16:
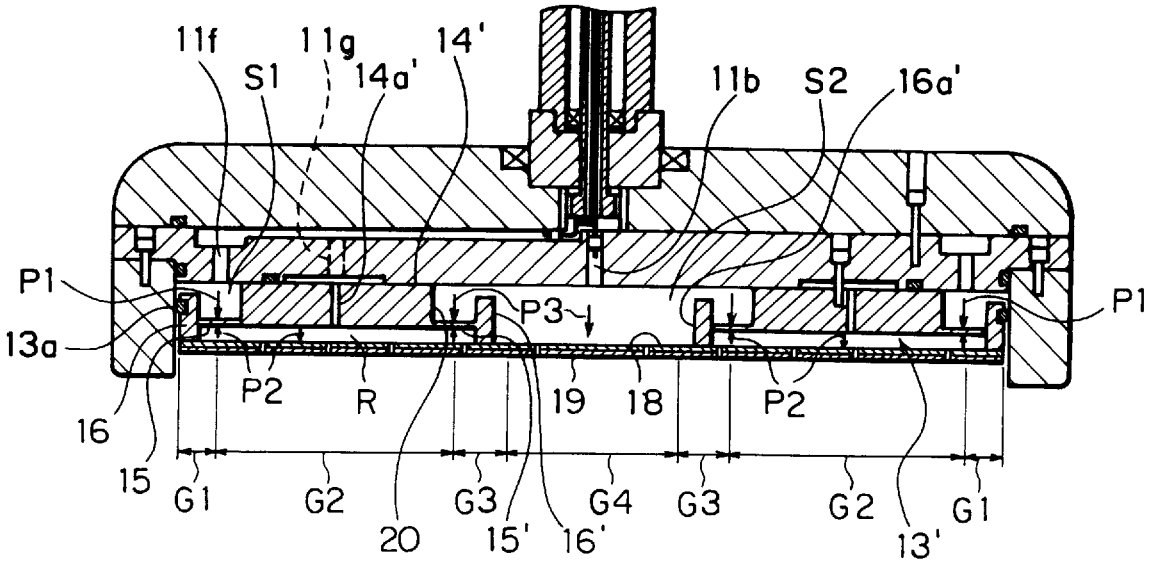
FIG. 16 is a sectional view of a carrier of a CMP apparatus according to a fourth embodiment of the present invention.
Figure 17:
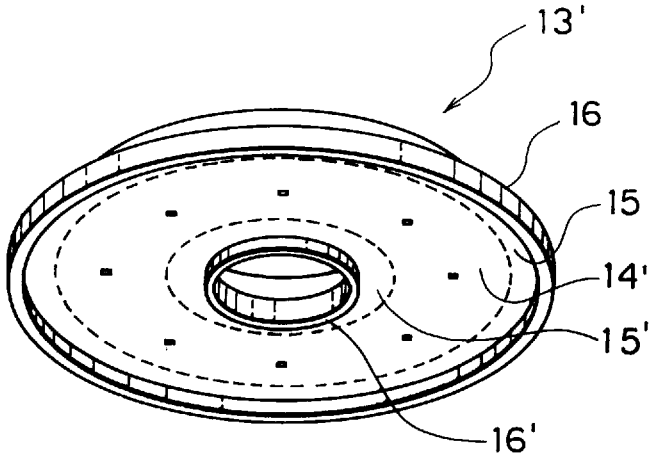
FIG. 17 is a perspective view of a sheet supporter applied in the fourth embodiment.

FIG. 16 is a sectional view of a carrier of a CMP apparatus according to a fourth embodiment of the present invention, while FIG. 17 is a perspective view of a sheet supporter applied in the fourth embodiment.

This embodiment differs from the first to third embodiments in the point of forming a plurality of pressure chambers.

As shown in FIG. 16, the sheet supporter 13' of this embodiment has a diaphragm 15 and an edge ring 16 at an outer periphery of a ring-shaped supporter body 14'. An O-ring 13*a* defines the space S1 as the pressure chamber. A pressure chamber R is arranged at the lower side of the supporter body 14. In the inner hole 20 of the support body 14' are further provided a diaphragm 15' (inner diaphragm) and edge ring 16' (inner edge).

Specifically, the diaphragm 15' extends substantially horizontally from the lower end of the inner periphery of the inner hole 20, and a ring-shaped edge ring 16' is formed at the inner rim of the diaphragm 15'. This edge ring 16' also projects vertically. The lower side projection 16*a'* is fused to the hard sheet 18 by a fusing material.

In this way, pressure chambers S1, R, and S2 are defined at the outside, lower side, and inside, respectively of the supporter body 14'.

Further, air hoses are inserted into the air outlet/inlet 11*f* communicating with the pressure chamber S1, the air outlet/inlet 11*g* communicating with the pressure chamber R through the through hole 14*a'*, and the air outlet/inlet 11*b* communicating with the pressure chamber S2 so that compressed air is independently supplied to the pressure chambers S1, R, and S2.

By this configuration, a pressing force corresponding to the pressure difference between the air pressure P1 of the pressure chamber S1 and the air pressure P2 of the pressure chamber R is applied to the region G1 of the outer periphery of the pressure chamber R. A pressing force corresponding to the air pressure P2 of the pressure chamber R is applied to the region G2 at the lower side of the pressure chamber R. A pressing force corresponding to the pressure difference between the air pressure P2 of the pressure chamber R and the air pressure P3 of the pressure chamber S2 is applied to the region G3 of the inner periphery of the pressure chamber R. And a pressing force corresponding to the air pressure P3 of the pressure chamber S2 is applied to the region G4 of the center of the pressure chamber S2.

Accordingly, by adjusting the air pressures P1, P2, and P3 of the pressure chamber S1, pressure chamber R, and pressure chamber S2, it is possible to control the polishing rate of the surface of the wafer W corresponding to the regions G1 to G4.

The rest of the configuration, action, effect, and modifications are the same as the first to third embodiments, so explanations thereof will be omitted.

(Fifth Embodiment)

Figure 18:
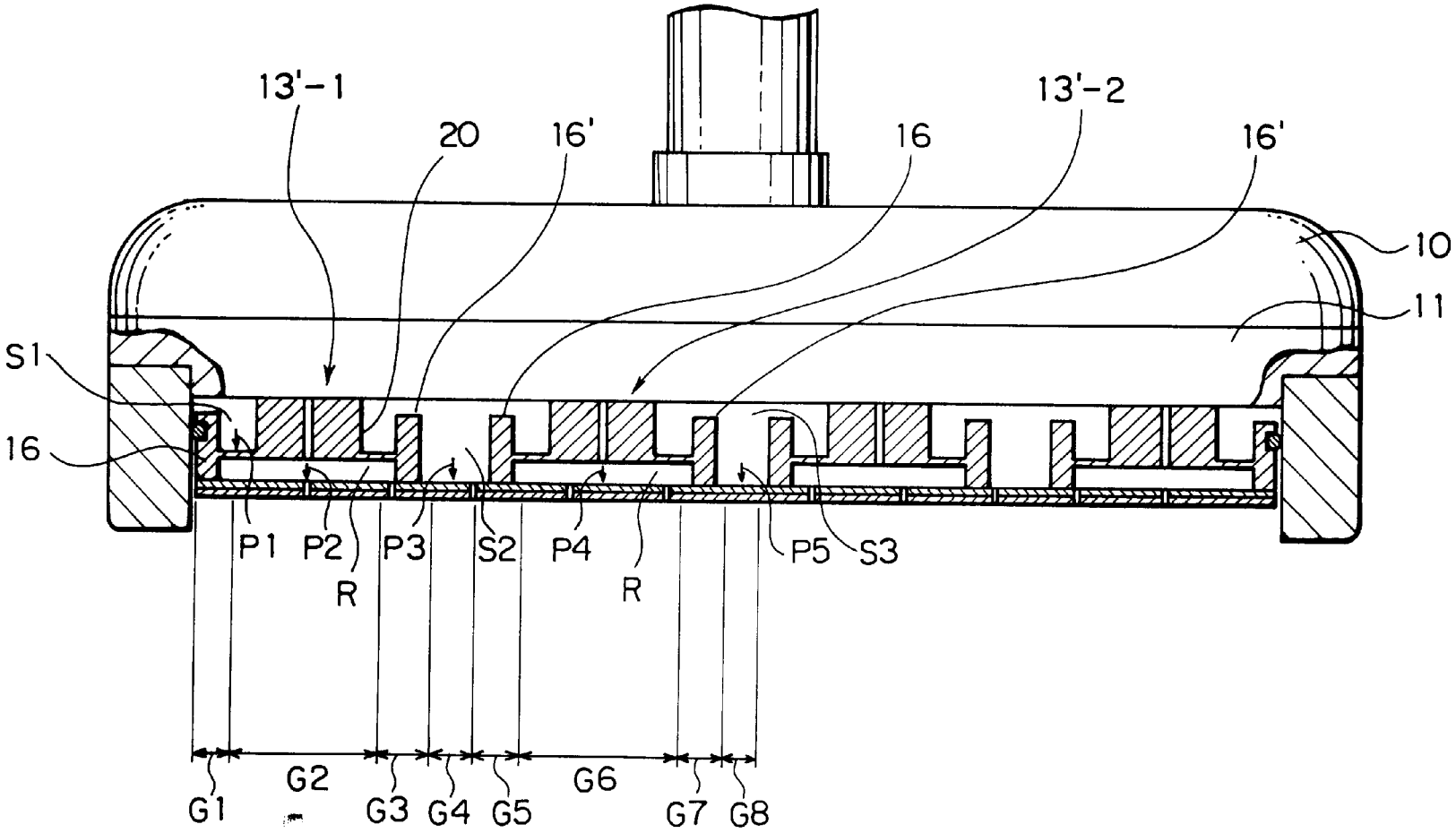
FIG. 18 is a sectional view of a carrier of a CMP apparatus according to a fifth embodiment of the present invention.
Figure 19:
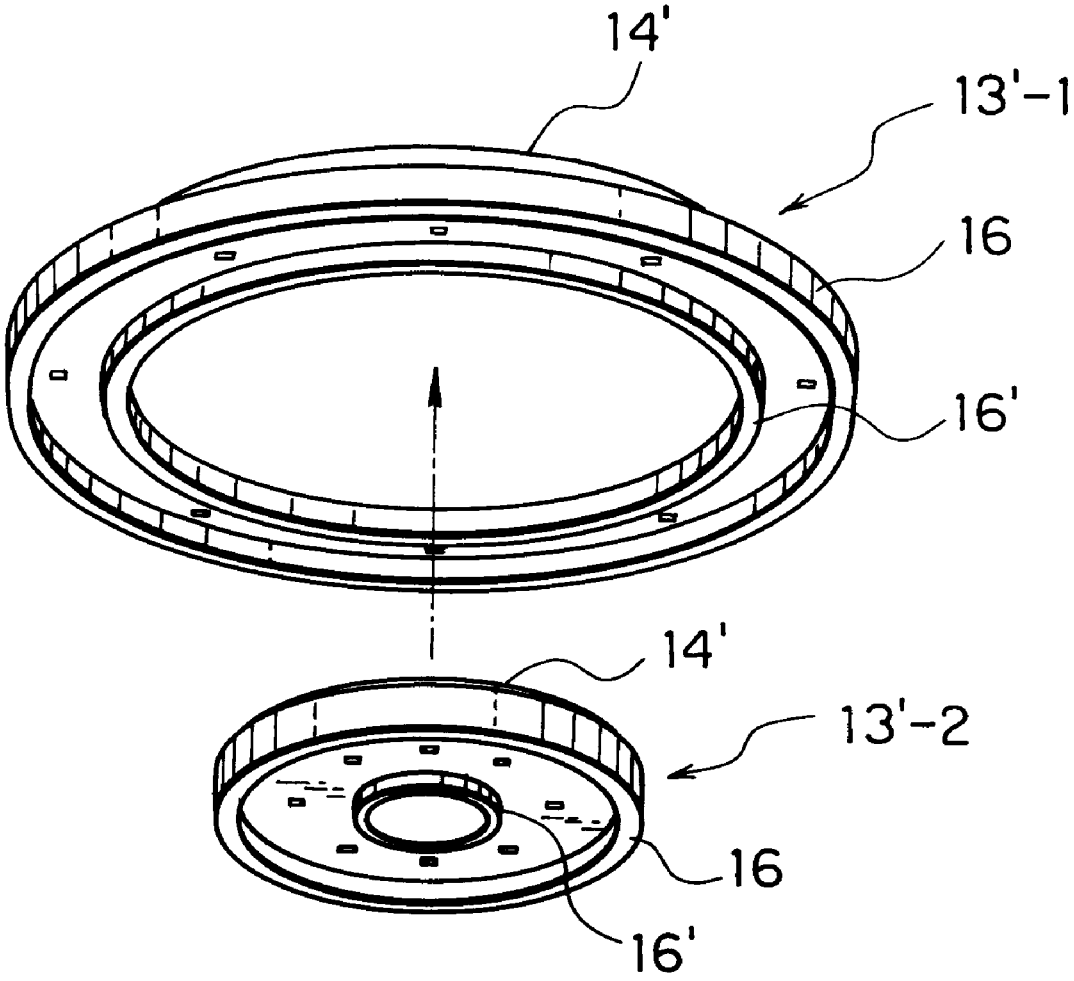
FIG. 19 is a perspective view of a sheet supporter applied in the fifth embodiment.

FIG. 18 is a sectional view of a carrier of a CMP apparatus according to a fifth embodiment of the present invention, while FIG. 19 is a perspective view of a sheet supporter applied in the fifth embodiment.

As shown in FIG. 18 and FIG. 19, this embodiment differs from the fourth embodiment in the point of arranging two sheet supporters 13'-1 and 13'-2 with different diameters concentrically in the carrier.

Specifically, the sheet supporter 13'-2 is arranged in the inner hole 20 of the large diameter sheet supporter 13'-1 a predetermined distance apart so that the edge rings 16' and 16 do not contact each other. These sheet supporters 13'-1 and 13'-2 are affixed to the carrier base 11.

By this configuration, it is possible to apply the pressing force corresponding to the pressure difference between the pressure P1 inside the pressure chamber S1 and the pressure P2 in the pressure chamber R of the sheet supporter 13'-1 to the region G1. It is possible to apply the pressing force corresponding to the pressure P2 in the pressure chamber R to the region G2. It is possible to apply the pressing force corresponding to the pressure difference between the pressure P3 inside the pressure chamber S2 and the pressure P2 in the pressure chamber R of the sheet supporter 13'-1 to the region G3. It is possible to apply the pressing force corresponding to the pressure P3 inside the pressure chamber S2 to the region G4. It is possible to apply the pressing force corresponding to the pressure difference between the pressure P3 inside the pressure chamber S2 and the pressure P4 in the pressure chamber R of the sheet supporter 13'-2 to the region G5. It is possible to apply the pressing force corresponding to the pressure P4 inside the pressure chamber R to the region G6. It is possible to apply the pressing force corresponding to the pressure difference between the pressure P4 inside the pressure chamber R and the pressure P5 in the center pressure chamber S3 to the region G7. And it is possible to apply the pressing force corresponding to the pressure P5 inside the pressure chamber S3 to the region G8. Accordingly, it is possible to control the polishing rate of the surface of the wafer W more finely.

The rest of the configuration, action, effect, and modifications are the same as the fourth embodiment, so explanations thereof will be omitted.

(Sixth Embodiment)

Figure 20:
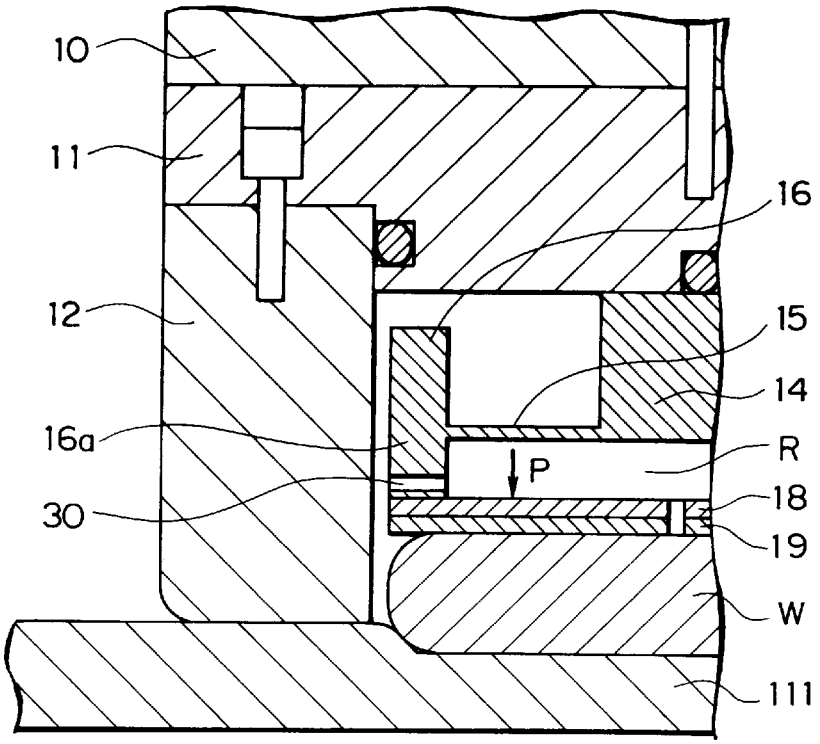
FIG. 20 is a sectional view of a carrier of a CMP apparatus according to a sixth embodiment of the present invention.
Figure 21:
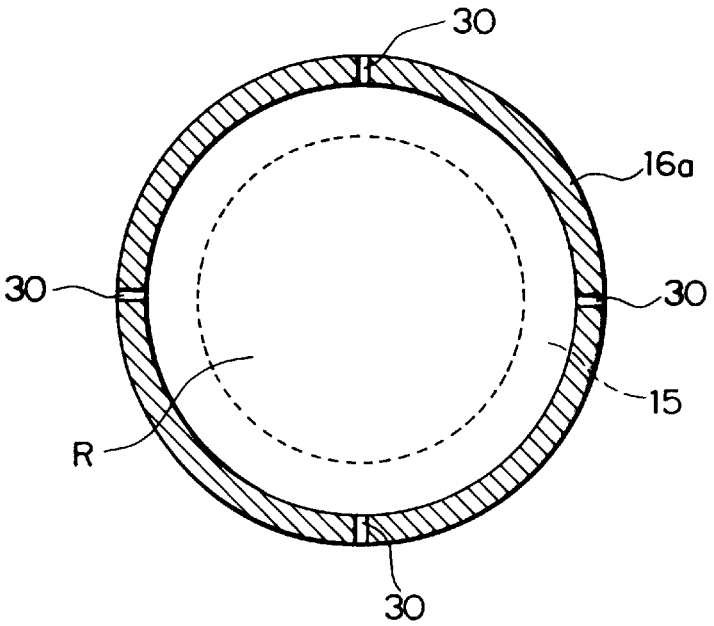
FIG. 21 is a sectional view of the state of arrangement of through holes.
Figure 22:
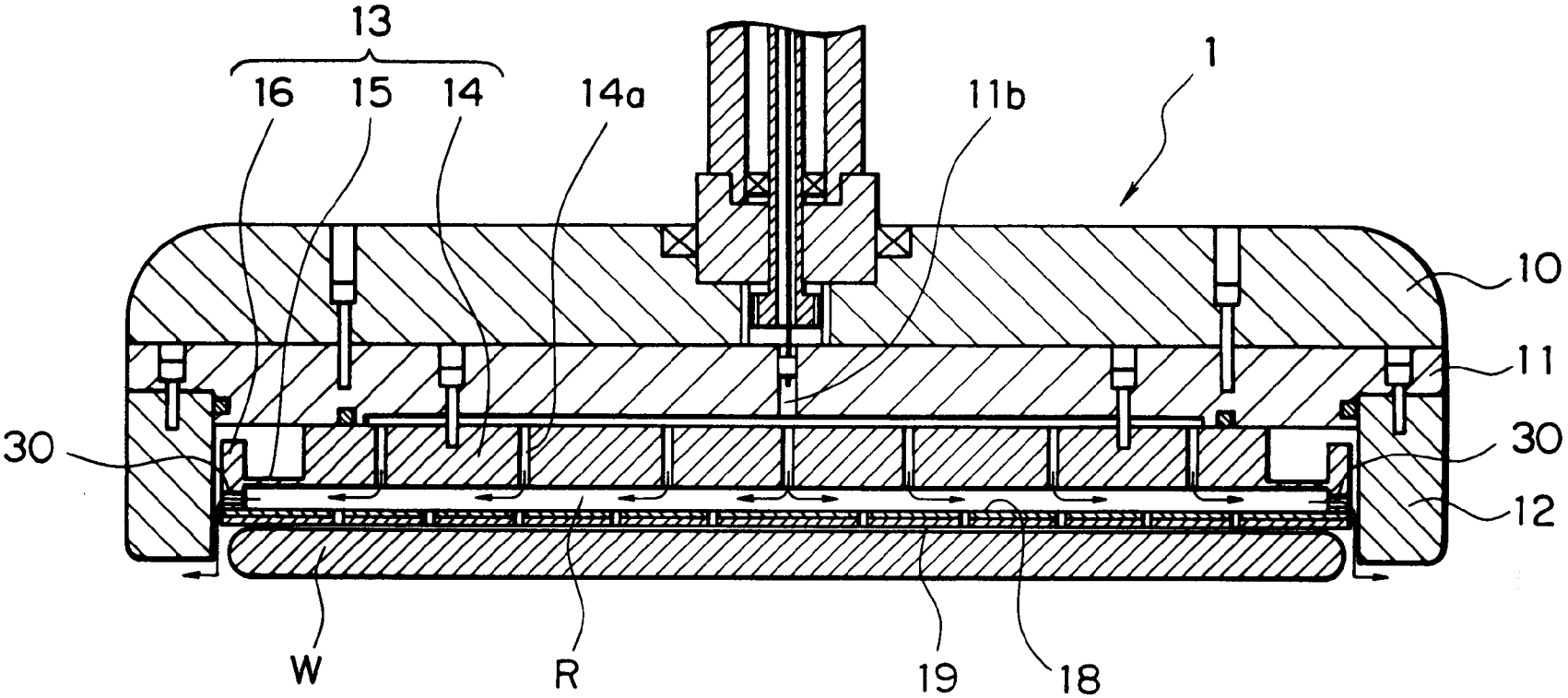
FIG. 22 is a sectional view of the flow of the air in the pressure chamber.

FIG. 20 is a sectional view of a carrier of a CMP apparatus according to a sixth embodiment of the present invention; FIG. 21 is a sectional view of the state of arrangement of through holes; and FIG. 22 is a sectional view of the flow of the air in the pressure chamber.

This embodiment differs from the above embodiments in the point that it is structured to stabilize the flow of air in the pressure chamber R.

In the carrier 1 shown in FIG. 3, if air continues to be supplied inside the air-tight pressure chamber R, the carrier 1 will rotate at a high speed, so the air in the pressure chamber R moves to the outer peripheral side of the pressure chamber R due to the centrifugal force.

Therefore, the density of the air at the outer peripheral side of the pressure chamber R may become high, turbulence may be created at the outer periphery, and the air pressure P applied to the outer periphery of the hard sheet 18 may end up different from the air pressure at other portions.

Figure 23A:
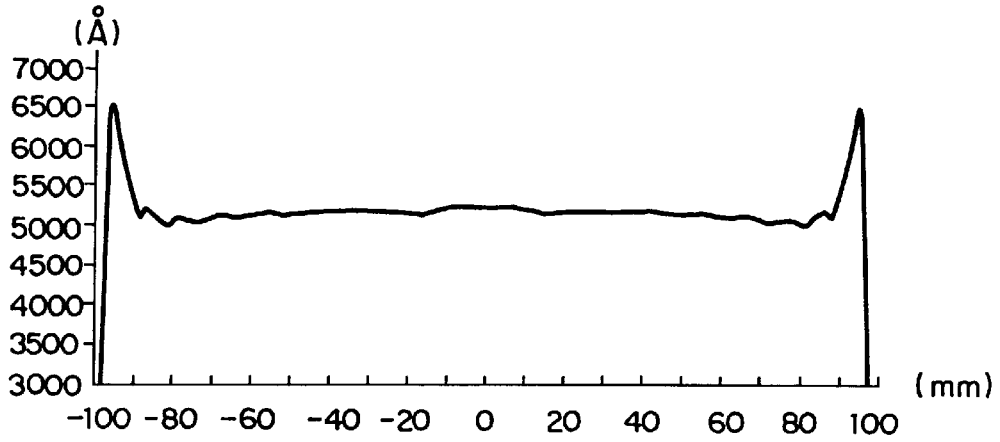
FIG. 23A is a graph showing the state of residual oxide film at the outer peripheral side of the wafer when using a double layer structure sheet.

In particular, if structured with a double layer structure sheet comprised of the hard sheet 18 and the soft backing sheet 19 as with the carrier 1 affixed to the edge ring 16, the air pressure P applied to the outer peripheral side of the wafer W may become small and, as shown in FIG. 23A, the outer periphery of the wafer W may end up remaining thick.

Therefore, in this embodiment, as shown in FIG. 20, small diameter through holes 30 communicating with the outer periphery of the carrier 1 of the pressure chamber R are formed at the lower portion of the lower side projection 16*a* of the edge ring 16. Specifically, as shown in FIG. 21, four through holes 30 are formed at 90 degree intervals in the circumferential direction of the lower side projection 16*a*.

Due to this, the air supplied in the pressure chamber R, as shown in FIG. 22, flows toward the outer periphery of the pressure chamber R, passes through the through holes 30, passes through the space between the inner peripheral surface of the retainer ring 12 and the outer peripheral surface of the edge ring 16, and flows out to the outside of the carrier 1.

As a result, a stable path is formed for the air in a substantially laminar flow state in the pressure chamber R and the density of the air in the pressure chamber R becomes uniform.

Figure 23B:
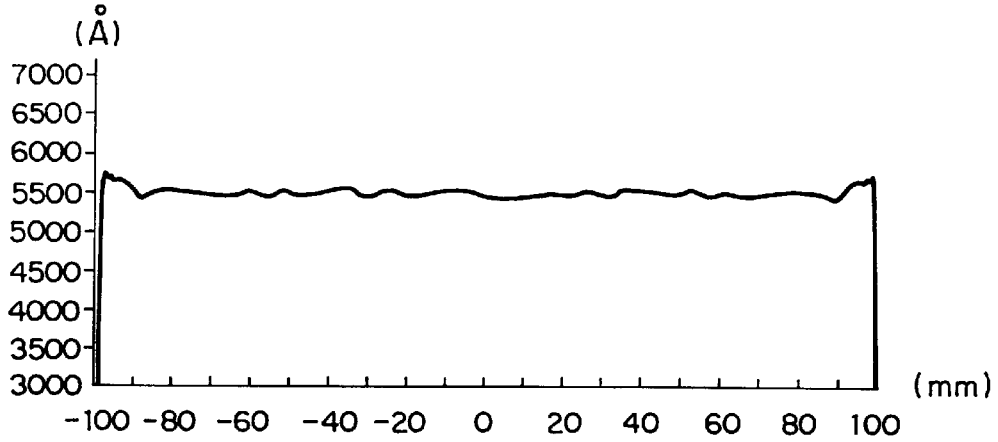
FIG. 23B is a graph showing the state of polishing of the oxide film by the sixth embodiment.

The inventor used the carrier 1 shown in FIG. 20 to polish a wafer W having a diameter of 200 mm and having on its surface an oxide film of a thickness of 10000 angstroms for 3 minutes. As shown in FIG. 23B, the thickness of the oxide film at the outer periphery of the wafer W became about 5700 angstroms or almost no different from the thickness at other portions.

In this way, according to this embodiment, it is possible to make the distribution of the air pressure P in the pressure chamber R reliably uniform and possible to further improve the uniformity of polishing of the wafer The rest of the configuration, action, and effect are the same as the first to fifth embodiments, so explanations thereof will be omitted.

(Seventh Embodiment)

Figure 24:
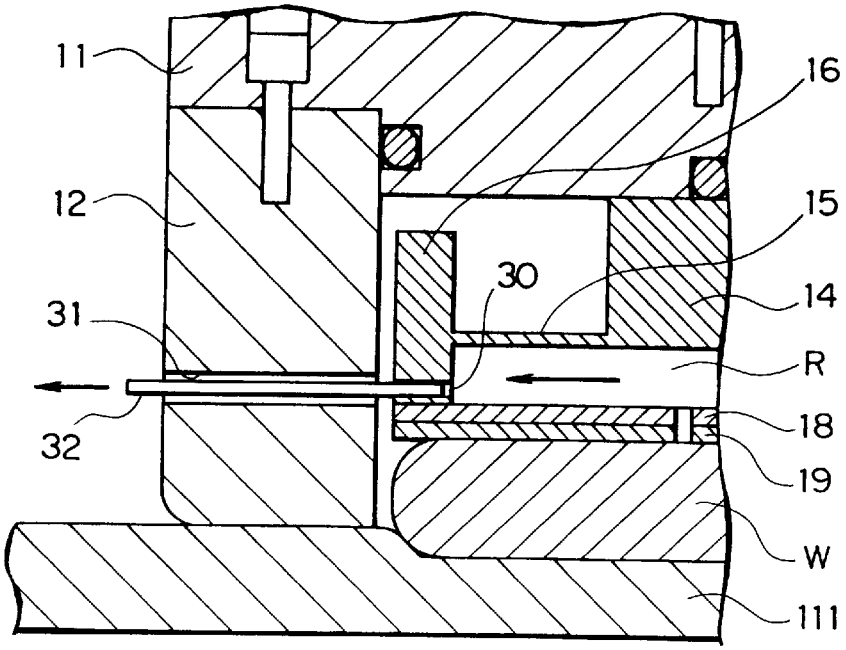
FIG. 24 is a sectional view of essential portions of a CMP apparatus according to a seventh embodiment of the present invention.

FIG. 24 is a sectional view of essential portions of a CMP apparatus according to a seventh embodiment of the present invention.

The CMP apparatus of this embodiment is an improvement over the CMP apparatus of the above sixth embodiment.

In the above sixth embodiment, the air passing through the through holes 30 flowed through the gap between the edge ring 16 and the retainer ring 12, so the polishing fluid entering this gap may be dried by the air resulting in the abrasive depositing in that space and preventing the edge ring 16 from moving.

Therefore, in this embodiment, as shown in FIG. 24, holes 31 passing through the width direction are formed in the retainer ring 12 at locations facing the through holes 30. The front ends of tubes 32 passing through the holes 31 are press-fit into the through holes 30 of the edge ring 16.

Due to this, the air in the pressure chamber R flows through the tubes 32 to the outside of the carrier 1 without leaking to the gap between the edge ring 16 and the retainer ring 12 and it is possible to prevent the situation of abrasive depositing in the gap between the edge ring 16 and the retainer ring 12.

The rest of the configuration, action, and effect are the same as the sixth embodiment, so explanations thereof will be omitted.

(Eighth Embodiment)

Figure 25:
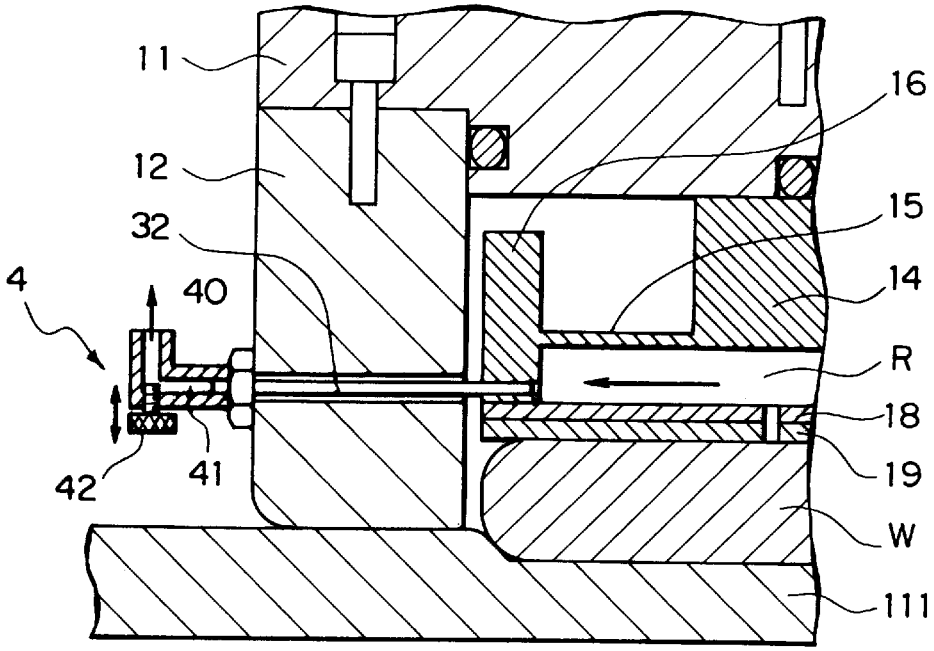
FIG. 25 is a sectional view of essential portions of a CMP apparatus according to an eighth embodiment of the present invention.

FIG. 25 is a sectional view of essential portions of a CMP apparatus according to an eighth embodiment of the present invention.

This embodiment differs from the CMP apparatus of the above seventh embodiment in that it is structured to enable control of the flow rate of the air from the pressure chamber R to the outside of the carrier 1 in the seventh embodiment.

In the above seventh embodiment, air in the pressure chamber R was made to flow out from tubes 32 inserted into the four holes 31 formed at 90 degree intervals in the circumferential direction of the retainer ring 12 so as to enable uniform distribution of the air pressure P in the pressure chamber R, but error in manufacture of the carrier 1 results in the flow rate of the air flowing out from the tubes 32 differing for each carrier 1. Therefore, the uniformity of air pressure in the pressure chamber R and the polishing rate of the wafer W may differ for each carrier 1. In such a case, it may be considered to control the air pressure P in the pressure chamber R of each carrier 1 while maintaining the relationship of the pressing force applied to the carrier 1 by the cylinder 80 being larger than the air pressure in the pressure chamber R so as to correct the manufacturing error, but this is difficult in practice.

Therefore, in this embodiment, as shown in FIG. 25, flow adjustment valves 4 are attached to the opening portions of the holes 31 of the retainer ring 12 and the air outflow ends of the tubes 32 are connected to these flow adjustment valves 4.

The flow adjustment valves 4 are known valves and open or close the flow paths 41 in the valve bodies 40 connected with the tubes 32 by adjustment knobs 42 so as to enable control of the flow rate of the air from the openings of the flow paths 41.

Due to this, by adjusting the adjustment knobs 42 to adjust the flow rates of the air from the pressure chamber R to the outside of the carrier 1 for each carrier 1, it is possible to correct manufacturing error and possible to achieve identical air pressures in the pressure chambers R of all of the carriers 1 and identical polishing rates of the wafers W.

The rest of the configuration, action, and effect are the same as the seventh embodiment, so explanations thereof will be omitted.

(Ninth Embodiment)

Figure 26:
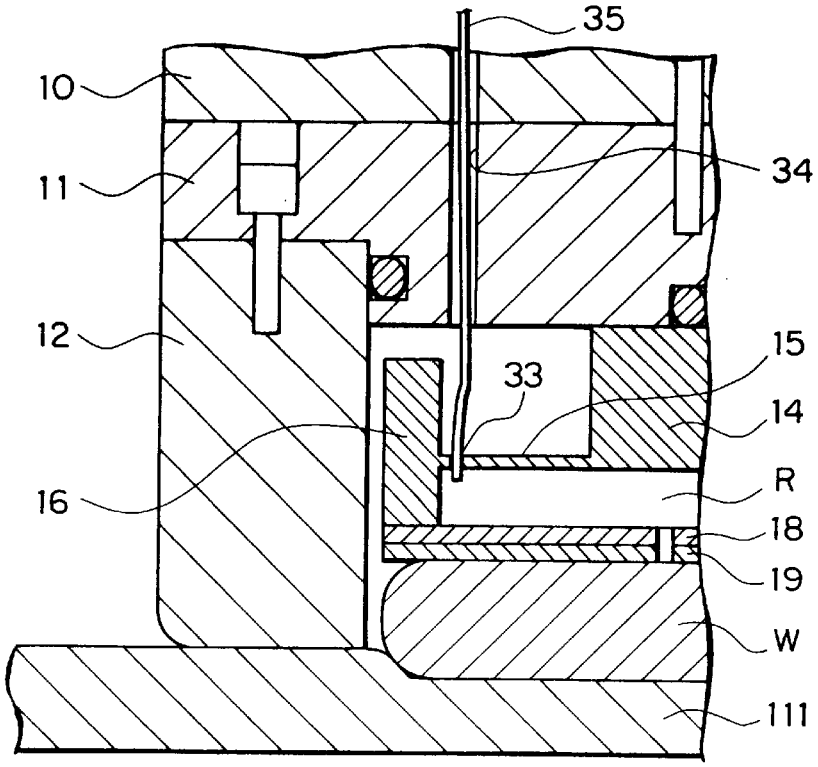
FIG. 26 is a sectional view of essential portions of a CMP apparatus according to a ninth embodiment of the present invention.

FIG. 26 is a sectional view of essential portions of a CMP apparatus according to a ninth embodiment of the present invention.

This embodiment differs from the above sixth and seventh embodiments in that it is structured to make the air in the pressure chamber R flow to the outside from the diaphragm 15 side.

That is, as shown in FIG. 26, holes 33 are formed in the diaphragm 15 at locations near the edge ring 16. Directly above the holes 33, through holes 34 passing through the carrier base 12 and the not shown housing 10 and opening to the outside are provided. Tubes 35 inserted in the through holes 34 are press-fit into the holes 33.

Due to this, the air in the pressure chamber R passes through the tubes 35 press-fit in the holes 33 of the diaphragm 15 and flow to the outside of the carrier 1.

Figure 23C:
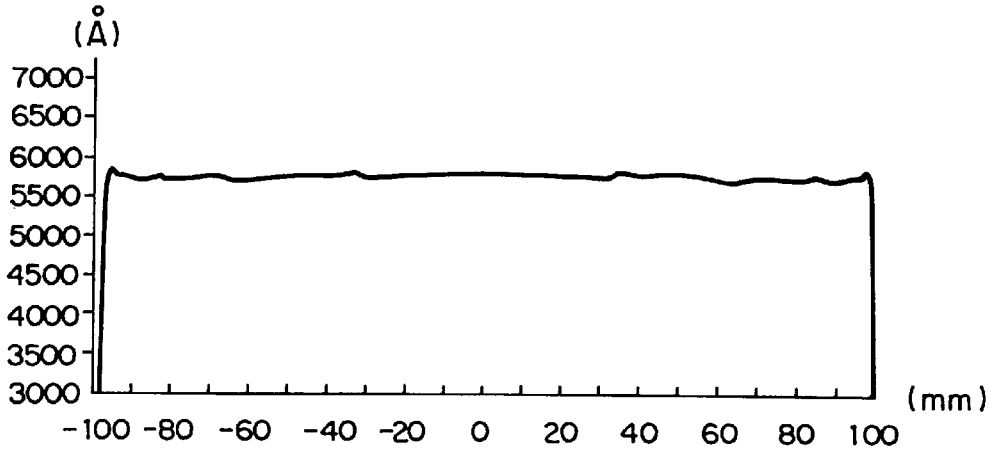
FIG. 23C is a graph showing the state of polishing of the oxide film by a ninth embodiment.

The inventors used the carrier 1 shown in FIG. 26 to polish a wafer W having a diameter of 200 mm and having on its surface an oxide film of a thickness of 10000 angstroms for 3 minutes. As shown in FIG. 23C, the thickness of the oxide film at the outer periphery of the wafer W became about 5700 angstroms or almost no different from the thickness at other portions in this case as well.

The rest of the configuration, action, and effect are the same as the sixth and seventh embodiments, so explanations thereof will be omitted.

(10th Embodiment)

Figure 27:
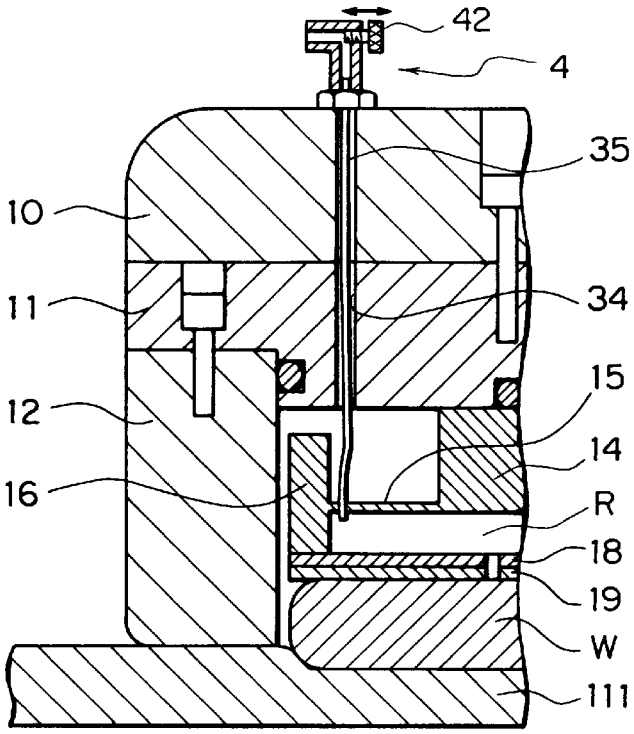
FIG. 27 is a sectional view of essential portions of a CMP apparatus according to a 10th embodiment of the present invention.

FIG. 27 is a sectional view of essential portions of a CMP apparatus according to a 10th embodiment of the present invention.

This embodiment improves on the CMP apparatus of the above ninth embodiment by enabling control of the flow rate of the air flowing from the pressure chamber R to the outside of the carrier 1.

That is, as shown in FIG. 27, the flow adjustment valves 4 used in the above eighth embodiment are attached to the opening portions of the holes 34 passing through the housing 10 and the carrier base 11 and the air outflow ends of the tubes 35 are connected to these flow adjustment valves 4.

Due to this, by adjusting the adjustment knobs 42 to adjust the flow rates of the air from the pressure chamber R to the outside of the carrier 1 for each carrier 1, it is possible to correct manufacturing error and possible to achieve identical air pressures in the pressure chambers R of all of the carriers 1 and identical polishing rates of the wafers W.

The rest of the configuration, action, and effect are the same as the ninth embodiment, so explanations thereof will be omitted.

(11th Embodiment)

Figure 28:
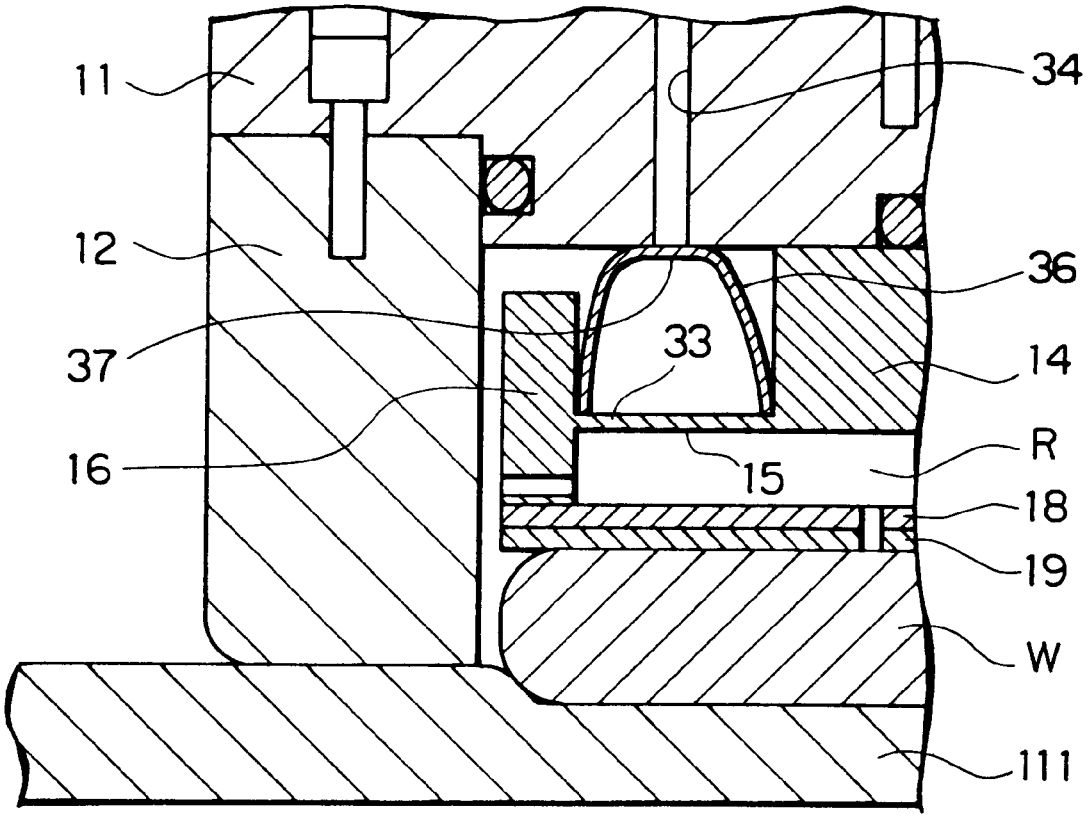
FIG. 28 is a sectional view of essential portions of a CMP apparatus according to an 11th embodiment of the present invention.

FIG. 28 is a sectional view of essential portions of a CMP apparatus according to an 11th embodiment of the present invention.

This embodiment differs from the above ninth embodiment in that instead of the tubes 35, use is made of ring members 36 formed by a flexible rubber material.

Specifically, as shown in FIG. 28, a substantially U-section ring material 36 is placed facing downward on the diaphragm 15 and the portion of contact of the lower end of the ring member 36 and the upper surface of the diaphragm 15 and the portion of contact of the upper surface of the ring member 36 and the lower surface of the carrier base 11 are affixed air-tightly by an adhesive.

Further, holes 37 communicating with the through holes 34 are formed at the upper portion of the ring members 36 at locations corresponding to the through holes 34.

Due to this, the air in the pressure chamber R enters the spaces inside the ring members 36 from the holes 33 of the diaphragm 15 and flows out through the holes 37 of the ring members 36 and the through holes 34 of the housing 10 and the carrier base 11 to the outside of the carrier 1.

The rest of the configuration, action, and effect are the same as the ninth embodiment, so explanations thereof will be omitted.

(12th Embodiment)

Figure 29:
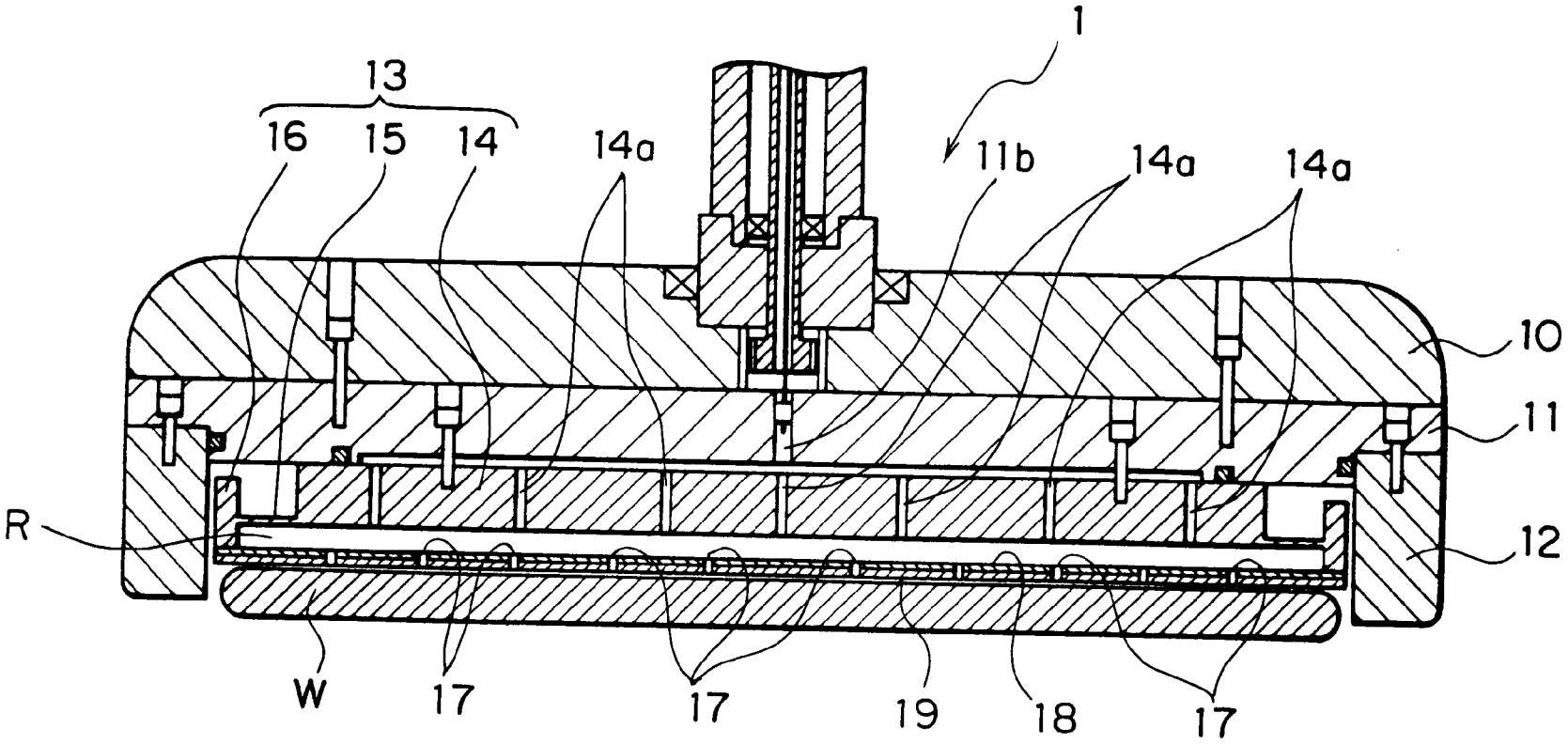
FIG. 29 is a sectional view of a carrier of a CMP apparatus according to a 12th embodiment of the present invention.

FIG. 29 is a sectional view of a carrier of a CMP apparatus according to a 12th embodiment of the present invention.

The CMP apparatus of this embodiment differs from the above embodiments in that an air layer is formed between the soft backing sheet 19 and the wafer W in the carrier 1 shown in FIG. 3.

As shown in FIG. 29, a plurality of air holes 14*a* of the supporter body 14 and a plurality of holes 17 passing through the hard sheet 18 and the soft backing sheet 19 are arranged facing each other.

Figure 30:
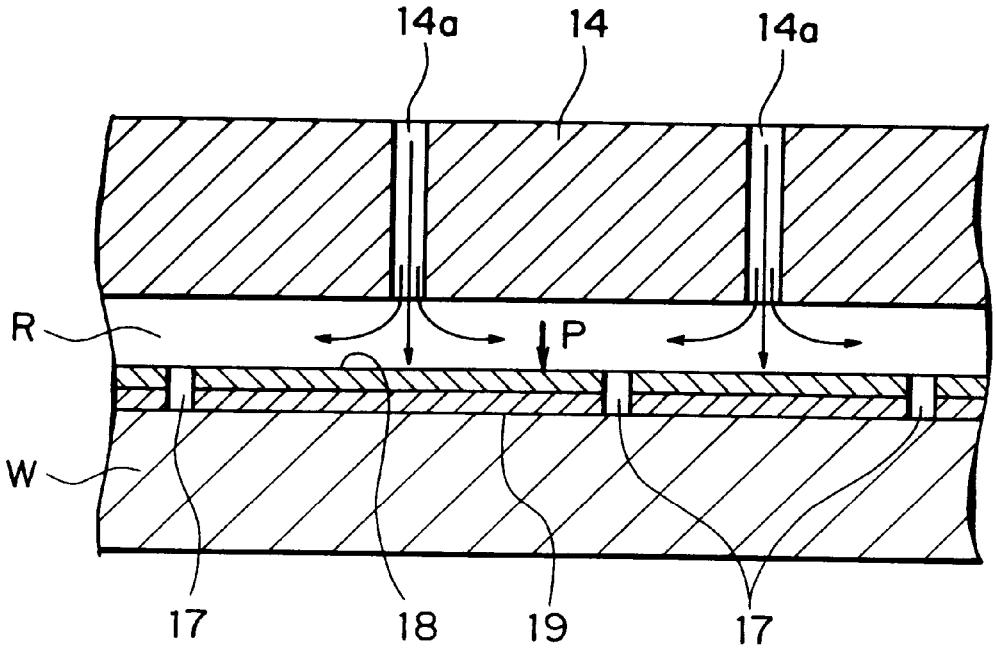
FIG. 30 is a sectional view of the state where the through holes of the supporter body and the holes of the sheet are off from each other.

As shown in FIG. 30, when air is supplied from the air holes 14*a* of the supporter body 14 to the inside of the pressure chamber R, the hard sheet 18 and the soft backing sheet 19 are pressed by the air pressure P.

At this time, as shown in the figure, if the air holes 14*a* and the holes 17 are off from each other, the soft backing sheet 19 will press against the wafer W by the air pressure P in the pressure chamber R and it will become difficult for the air in the pressure chamber R to enter between the soft backing sheet 19 and the wafer W from the holes 17.

Figure 31:
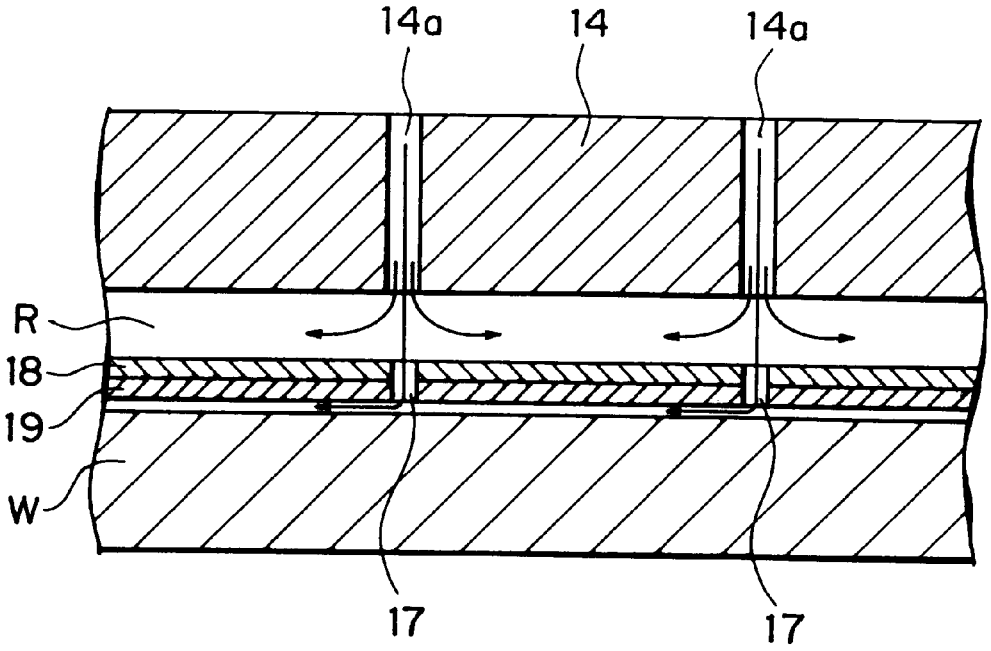
FIG. 31 is a sectional view of the state where the through holes of the supporter body and the holes of the sheet are aligned with each other.

Therefore, the air holes 14*a* and the holes 17 are made to face each other so that the air holes 14*a* come substantially directly above the holes 17 and the air from the air holes 14*a* directly enters the holes 17. Accordingly, the air pressure in the holes 17 becomes larger than the air pressure P in the pressure chamber R and, as shown by the arrow in FIG. 31, the air from the holes 17 will flow between the soft backing sheet 19 and the wafer W.

By this configuration, the air supplied from the air holes 14*a* of the supporter body 14 to the inside of the pressure chamber R fills the inside of the pressure chamber R and flows through the holes 17 to between the soft backing sheet 19 and the wafer W, so a layer of air of a certain thickness is formed between the soft backing sheet 19 and the wafer W.

As a result, the wafer W directly receives the pressure by the air layer and the distribution of air pressure to the entire surface of the wafer W becomes substantially completely uniform.

(13th Embodiment)

Figure 32:
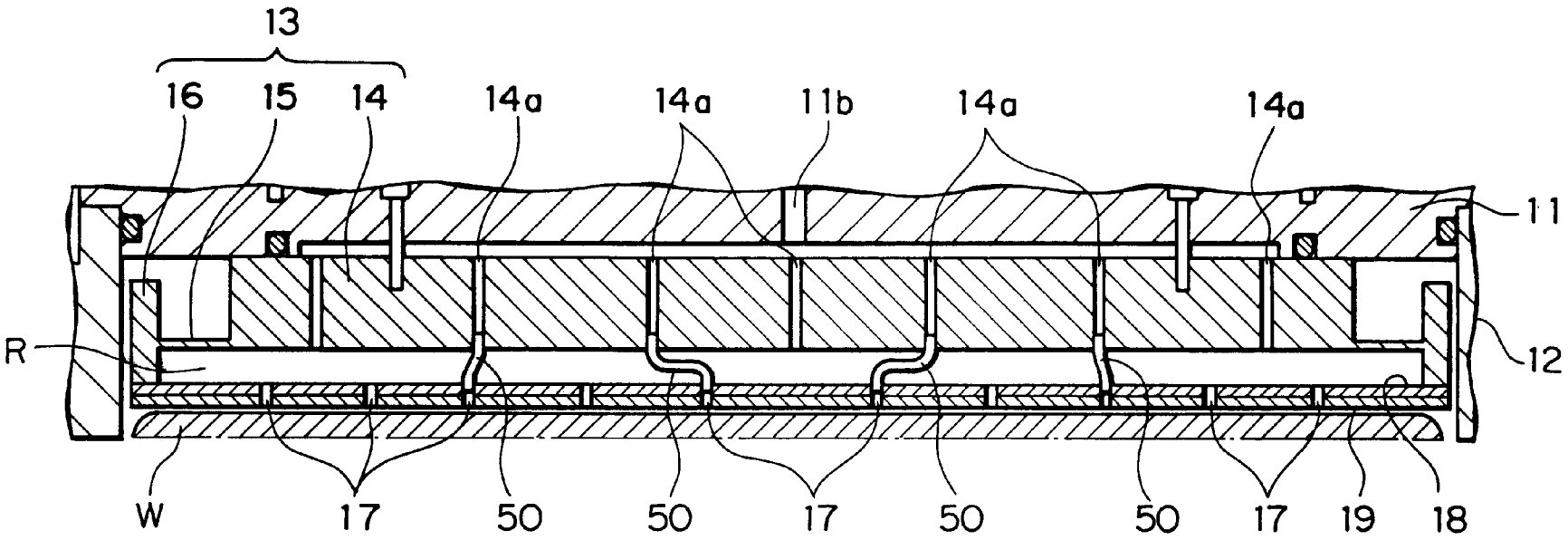
FIG. 32 is a sectional view of essential portions of the carrier of a CMP apparatus according to a 13th embodiment of the present invention.

FIG. 32 is a sectional view of essential portions of the carrier of a CMP apparatus according to a 13th embodiment of the present invention.

In manufacturing the carrier of the above 12th embodiment, it is sometimes difficult to position the air holes 14*a* with the holes 17.

Therefore, this embodiment is constructed so that part of the plurality of air holes 14*a* provided in the supporter body 14 are connected by tubes 50 to part of the plurality of holes 17 passing through the hard sheet 18 and the soft backing sheet 19 in the carrier 1 shown in FIG. 3.

Due to this configuration, air from the air holes 14*a* is directly supplied to the holes 17 and a stable layer of air is formed between the soft backing sheet 19 and the wafer W.

(14th Embodiment)

Figure 33:
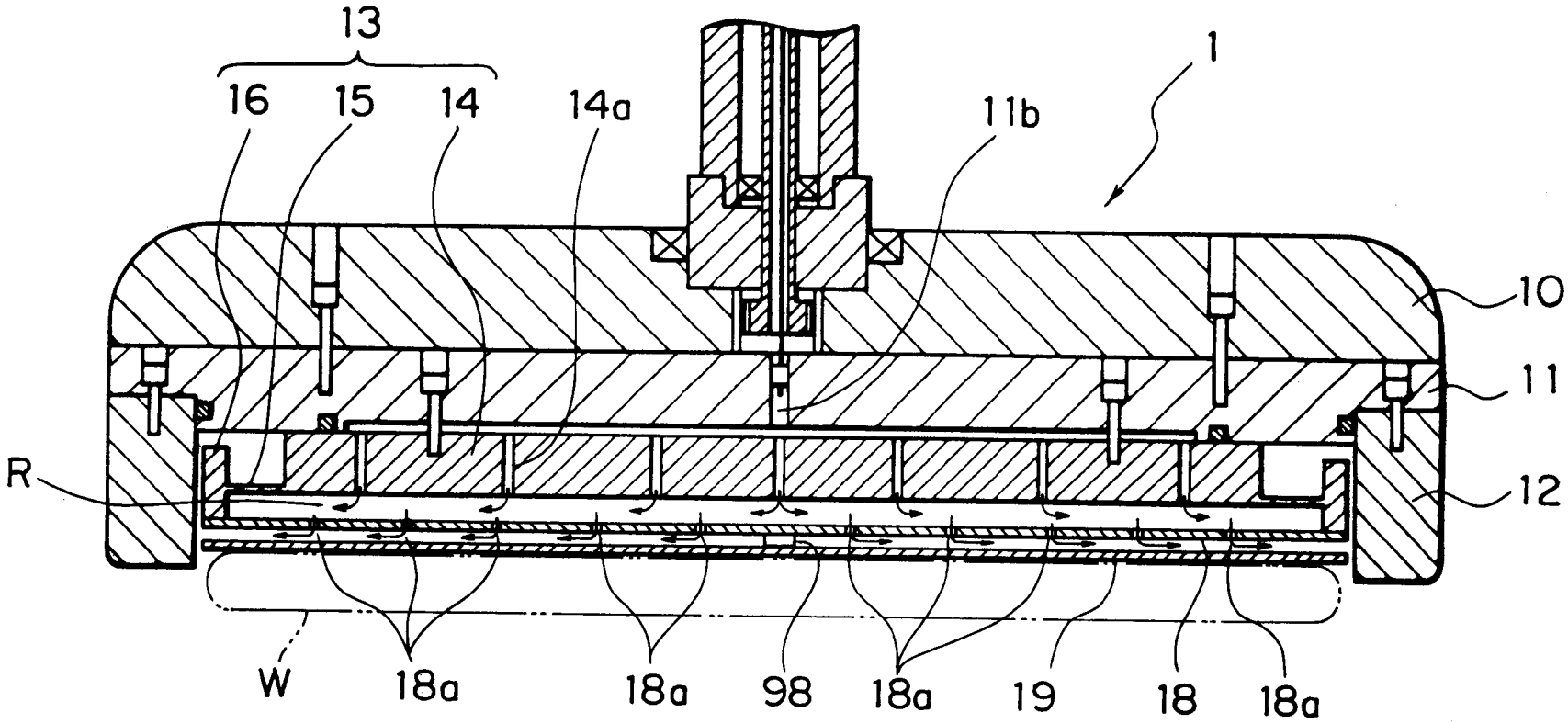
FIG. 33 is a sectional view of a carrier of a CMP apparatus according to a 14th embodiment of the present invention.

FIG. 33 is a sectional view of a carrier of a CMP apparatus according to a 14th embodiment of the present invention.

This carrier is characterized in the structure of the hard sheet 18 and the soft backing sheet 19.

That is, it is structured with the hard sheet 18 having a plurality of holes 18*a* affixed to the lower surface of the edge ring 16 of the sheet supporter 13 and with the center of the upper surface of the soft backing sheet 19 adhered by an adhesive 98 to the center of the lower surface of the hard sheet 18.

By partially adhering the soft backing sheet 19 with no holes to the center of the hard sheet 18, the air inside the pressure chamber R flows from the holes 18*a* of the hard sheet 18 and enters between the hard sheet 18 and the soft backing sheet 19 to form an air layer between the hard sheet 18 and the soft backing sheet 19. As a result, the entire surface of the wafer W is pressed uniformly through the soft backing sheet 19 by the air layer.

The rest of the configuration, action, and effect are the same as the 13th and 14th embodiments, so explanations hereof will be omitted.

(15th Embodiment)

Polishing a wafer to a desired quality requires that the pressure inside the carrier be maintained at a predetermined pressure.

Therefore, in the past, a manometer etc. was attached at a stationary location such as the air hose avoiding rotating locations such as the carrier. Further, the manometer and other meters were monitored to estimate the value of the pressure inside the carrier and control the pressure inside the carrier.

In such a pressure control system, however, it is not possible to measure the actual pressure inside the carrier. In particular, in carriers structured to leak the air in the pressure chamber to the outside such as those of the sixth to 11th embodiments shown in FIG. 20 to FIG. 28, a large error ended up occurring between the actual pressure inside the carrier and the measured pressure.

Accordingly, in this embodiment, provision is made of a pressure control system enabling measurement and control of the actual pressure inside the pressure chamber of the carrier.

Figure 34:
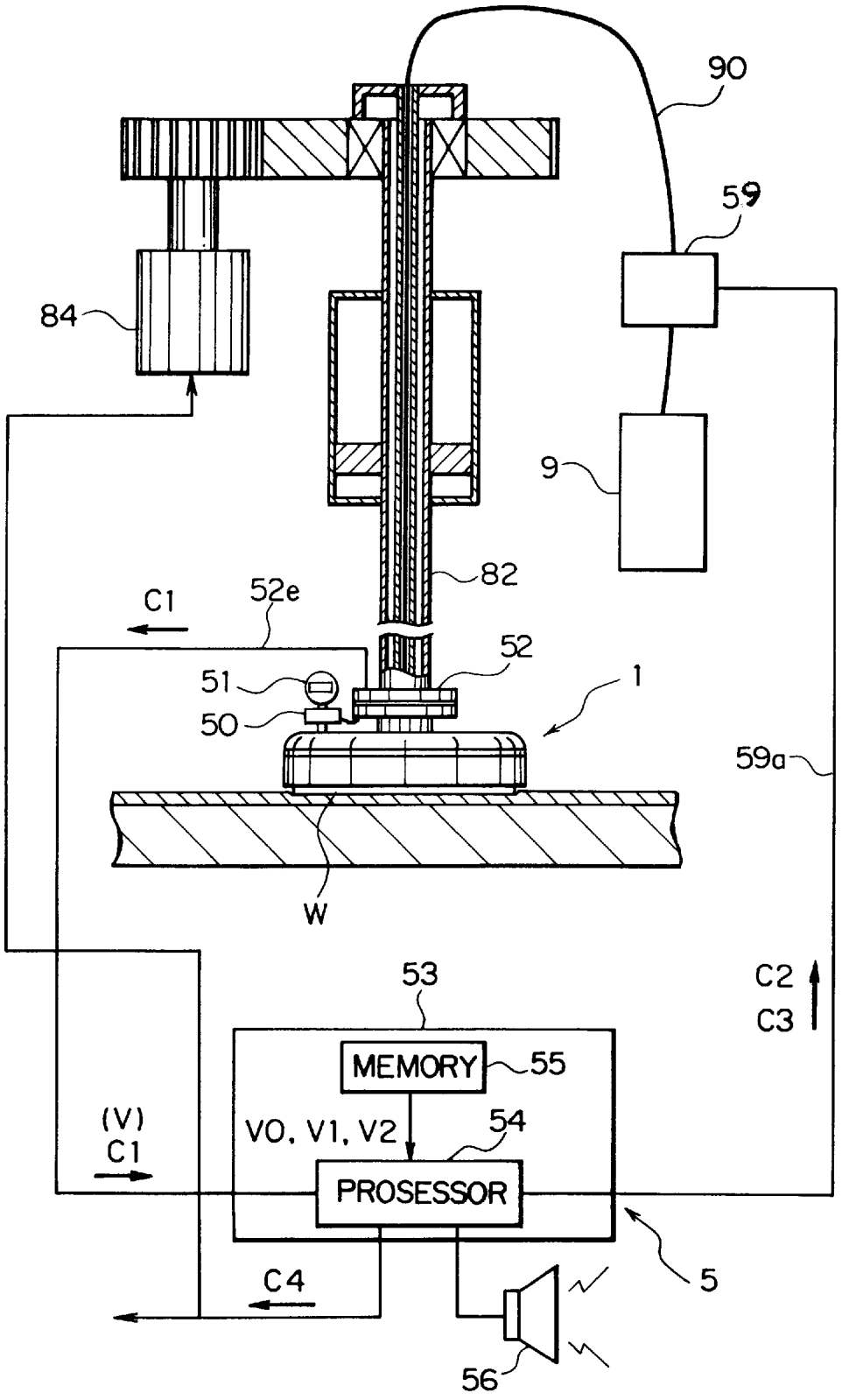
FIG. 34 is a block diagram of essential portions of a CMP apparatus according to a 15th embodiment of the present invention.

FIG. 34 is a block diagram of essential portions of a CMP apparatus according to a 15th embodiment of the present invention. Reference numeral 5 indicates the pressure control system.

The pressure control system 5 is for controlling the pressure in the pressure chamber of the carrier 1 to the desired pressure value and is comprised of a manometer 50, a comparator/controller 53, and a regulator 59 as a pressure regulator.

Figure 35:
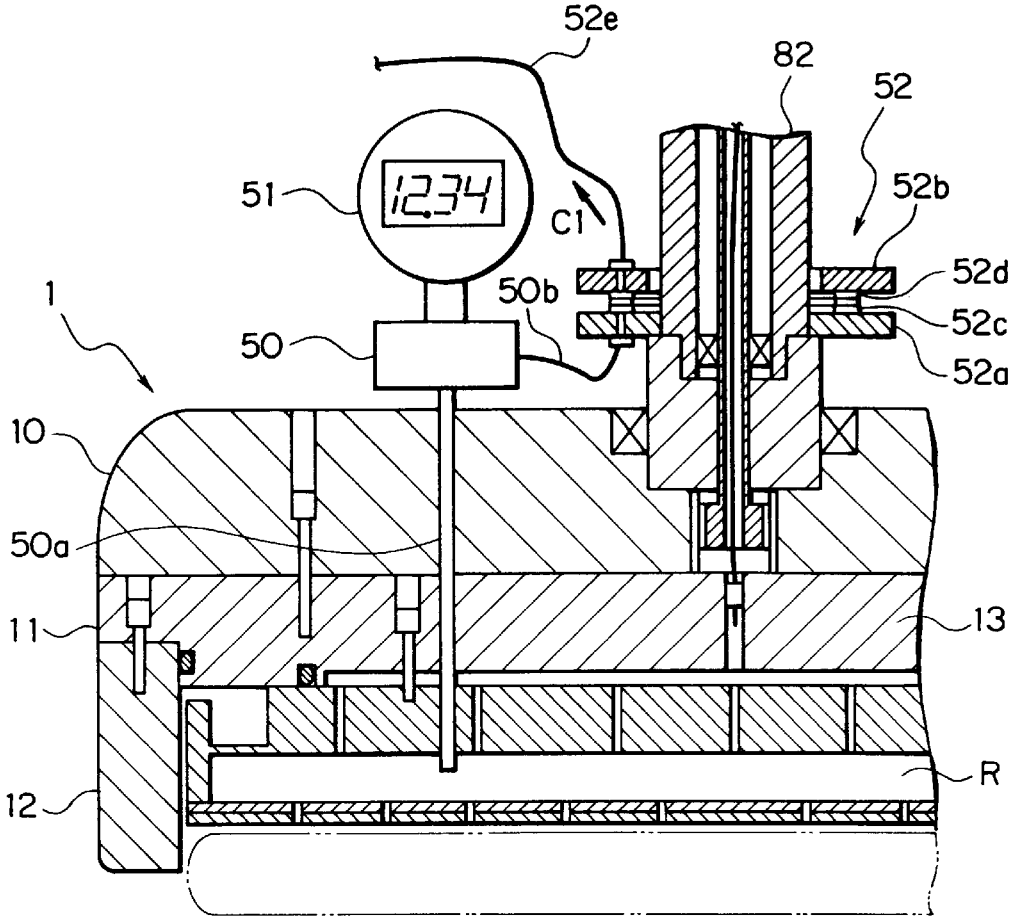
FIG. 35 is a partial sectional view of the state of attachment of a manometer.

The manometer 50, as shown in FIG. 35, is attached to the carrier 1. A sensor portion 50*a* is inserted through the housing 10, carrier base 41, and sheet supporter 13 into the pressure chamber R.

Due to this, the sensor portion 50*a* detects the actual pressure inside the pressure chamber R and outputs the detected pressure value V converted to an electrical signal C1.

Further, the manometer 50 is provided with a digital display 51 as the display unit which indicates the pressure value at the time of detection. The display 51 may be analog in addition to digital, but here a digital type easy to view at the time of rotation is employed since the manometer is attached to the carrier 1.

The output side of this manometer 50, as shown in FIG. 34, is connected to the input side of the comparator/controller 53 through a rotary joint 52.

The rotary joint 52, as shown in FIG. 35, has a rotating plate 52*a* affixed to the piston rod 82 rotating integrally with the carrier 1 and a stationary plate 52*b* affixed to the outer side of the piston rod 82. The rotating plate 52*a* has a ring-shaped terminal 52*c* on its upper surface. This ring shaped terminal 52*c* is connected electrically to the output side of the manometer 50 through a conductor 50*b*. On the other hand, the stationary plate 52*b* has a brush 52*d* implanted in a ring fashion on its lower surface. The brush 52*d* is pressed against the ring-shaped terminal 52*c*. The brush 52*d* is electrically connected to the input side of the comparator/controller 53 through the conductor 52*e*.

Due to this, the electrical signal C1 from the manometer 50 is input through the conductor 50*b*, rotary joint 52, and conductor 52*e* to the comparator/controller 53.

The comparator/controller 53, as shown in FIG. 34, has a processor 54 and a memory 55.

The processor 54, when the electrical signal C1 from the manometer 50 is input, reads from the memory 55 a predetermined reference pressure value V0, a first pressure level value V1 much higher than the reference pressure value V0, and a second pressure level value V2 much lower than the reference pressure value V0 and compares the detected pressure value V with the reference pressure value V0, the first pressure level value V1, and the second pressure level value V2.

Figure 36:
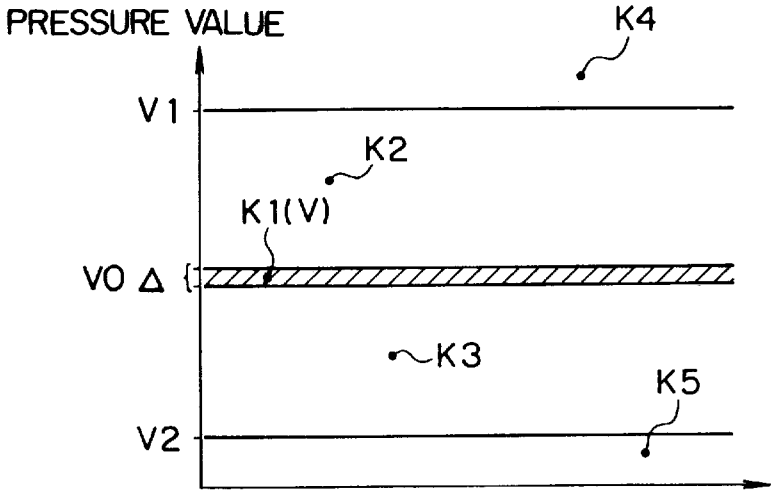
FIG. 36 is a graph of the reference pressure value and first and second pressure level values.

FIG. 36 is a graph of the reference pressure value V0, the first pressure level value V1, and the second pressure level value V2.

As shown in FIG. 36, the reference pressure value V0 is the desired pressure in the pressure chamber R and has a desired pressure level margin Δ. As opposed to this, the first pressure level value V1 is the pressure value where, when the pressure inside the pressure chamber R is above it, the polishing rate of the wafer W ends up becoming remarkably high. The second pressure level value V2 is the pressure value where, when the pressure inside the pressure chamber R is below it, the polishing rate of the wafer W ends up becoming remarkably low.

The processor 54 compares the detected pressure value V indicated by the input electrical signal C1 with the reference pressure value V0. The processor 54 does not output a control signal when, as shown by the point K1 in FIG. 36, the detected pressure value V is within the pressure level margin Δ of the reference pressure value V0.

As opposed to this, when, as shown by the point K2, the detected pressure value V is larger than the reference pressure value V0 and smaller than the first pressure level value V1, the processor 54 outputs a pressure reduction control signal C2 indicating the pressure difference of the detected pressure value V and the average pressure value of the reference pressure value V0. Further, when, as shown by the point K3, the detected pressure value V is smaller than the reference pressure value V0 and larger than the second pressure level value V2, the processor 54 outputs a pressure increase control signal C3 indicating the pressure difference between the detected pressure value V and the average pressure_value of the reference pressure value V0. Further, when, as shown by the point K4 or the point K5, the detected pressure value V is larger than the first pressure level value V1 or smaller than the second pressure level value V2, the processor 54 sounds an alarm from a speaker 56 and sends a stop signal C4 to the motors 84 and 112 to make the motors 84 and 112 stop.

The regulator 59, as shown in FIG. 34, is electrically connected to the output side of the comparator/controller 53 through the conductor 59*a* and receives as input the pressure reduction control signal C2 or the pressure increase control signal C3 output from the comparator/controller 53.

The regulator 59 is provided at the air hose 90 and functions to regulate the flow rate of the air supplied from the air hose 90 to the pressure chamber R of the carrier 1 based on the pressure reduction control signal C2 or the pressure increase control signal C3.

Specifically, when the pressure reduction control signal C2 is input, the regulator 59 reduces the flow rate of air in the air hose 90 so as to reduce the pressure in the pressure chamber R by exactly the pressure difference indicated by the pressure reduction control signal C2. Further, when the pressure increase control signal C3 is input, the regulator 59 increases the flow rate of the air in the air hose 90 to increase the pressure in the pressure chamber R by exactly the pressure difference indicated by the pressure increase control signal C3.

By this configuration, when the pressure in the pressure chamber R of the carrier 1 changes, the actual pressure value V is detected by the manometer 50 and a pressure reduction control signal C2 or pressure increase control signal C3 corresponding to the pressure difference between the detected pressure value V and the reference pressure value V0 is sent to the regulator 59. Further, due to the air flow rate regulating ability of the regulator 59, the pressure inside the pressure chamber R is returned to within the pressure level margin Δ of the reference pressure value V0.

Since, according to this embodiment, it is possible to detect the actual pressure in the pressure chamber R and control it to a desired pressure value in the pressure chamber R in this way, extremely accurate pressure control becomes possible and a high quality wafer W can be produced.

Further, since an alarm is sounded and the CMP apparatus is stopped when the pressure inside the pressure chamber R becomes remarkably high or low, there is no waste of the wafers W due to over polishing etc.

Further, since the user can observe the actual pressure value at all times by the display 51 of the manometer 50, the apparatus is extremely convenient.

(16th Embodiment)

Figure 37:
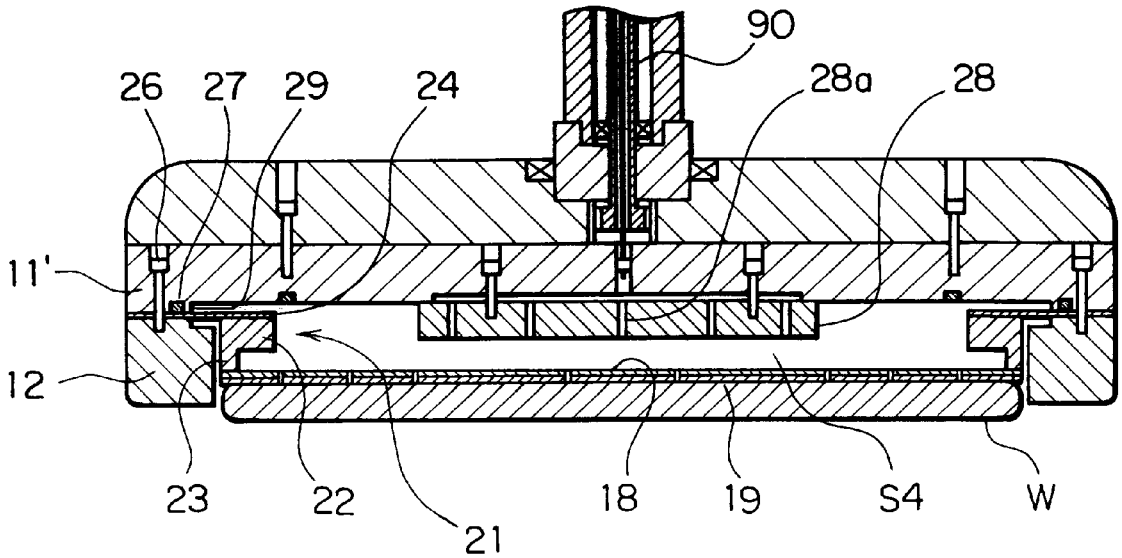
FIG. 37 is a sectional view of a carrier of a CMP apparatus according to a 16th embodiment of the present invention.

FIG. 37 is a sectional view of a carrier of a CMP apparatus according to a 16th embodiment of the present invention.

The carrier of this embodiment differs from those of the first to 14th embodiments in the structure of the sheet supporter.

In FIG. 37, reference numeral 21 indicates a sheet supporter. This sheet supporter 21 has a ring-shaped supporter body 22 and an edge 23 projecting from the outer periphery of the lower surface of the supporter body 22. The support body 22 is held by a ring-shaped diaphragm 24 having flexibility.

Specifically, the outer periphery of the diaphragm 24 is affixed by screws 26 in a state gripped by the carrier base 11' and the retainer ring 12. An O-ring 27 is fit between the carrier base 11' and the diaphragm 24. At the lower surface of the inner circumference of the diaphragm 24, the upper surface of the supporter body 22 is fused with the edge 23 facing down. At the lower surface of the edge 23, the outer periphery of the hard sheet 18 is fused. At the lower surface of the hard sheet 18, the soft backing sheet 19 is adhered. Further, at the inner circumferential surfaces of the carrier base 11' and the retainer ring 12, ring-shaped grooves 29 allowing flexing of the diaphragm 24 are cut. Due to this, the hard sheet 18, the sheet supporter 21, and the carrier base 11' define the air-tight pressure chamber S4. The compressed air from the air hose 90 is supplied from the air opening 28*a* of the plate 28 attached to the lower surface of the carrier base 11' into the pressure chamber S4.

Next, the operation of the carrier of the CMP apparatus of this embodiment will be explained.

Figure 38:
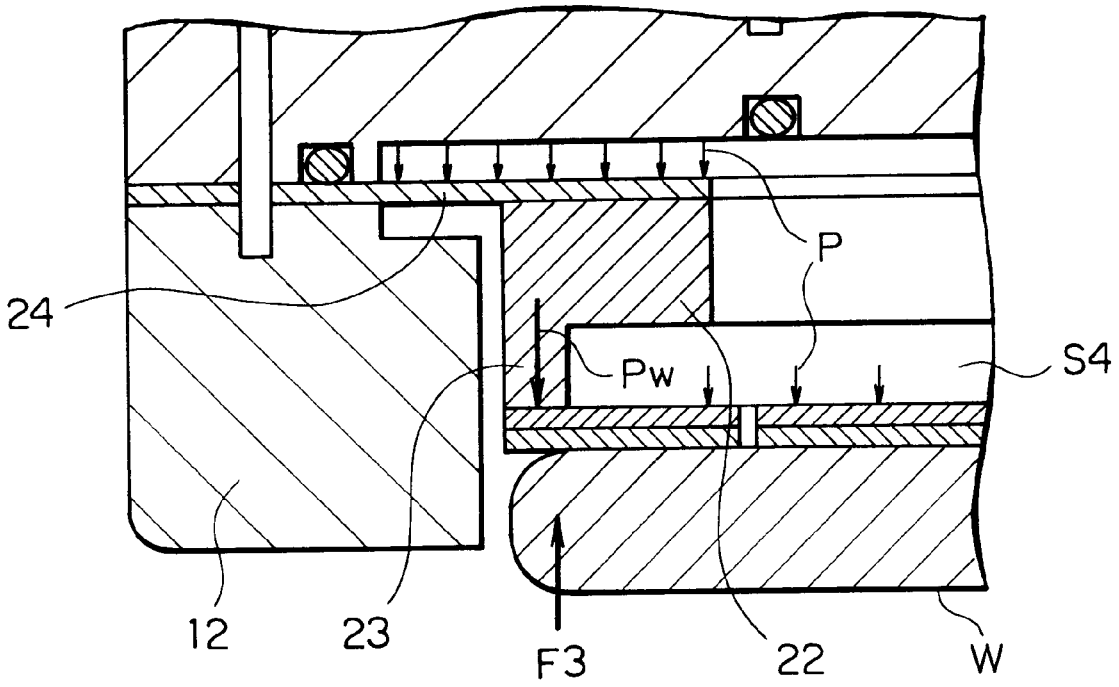
FIG. 38 is a sectional view for explaining the operation of the carrier of the 16th embodiment.

FIG. 38 is a sectional view for explaining the operation of the carrier of this embodiment.

As shown in FIG. 38, the air pressure P in the pressure chamber S4 is applied to the upper surface of the diaphragm 24 and the pressing force of the product of the area of the diaphragm 24 and the air pressure P is applied through the edge 23 to the outer periphery of the wafer W. At this time, since the sectional area of the edge 23 is smaller than the area of the diaphragm 24, the pressure PW applied to the outer peripheral rim of the wafer W becomes larger than the pressure P applied to other portions and the outer periphery of the wafer W is strongly pressed by the edge 23.

Accordingly, even when a lateral direction force is applied to the wafer W during the polishing work, the wafer W will not shift to the lateral direction due to that force.

The amount of projection Δ of the wafer W is initially set and the wafer W polished so that the polishing rate of the outer peripheral rim of the wafer W and the polishing rate of other portions become substantially equal in that state.

In the state where the retainer ring 12 is not worn down, the force F3 (pressure) received by the outer peripheral rim of the wafer W from the polishing pad 111 (not shown) is equal to the pressure PW.

When the retainer ring 12 is worn down, however, the increase in the amount of projection Δ causes the force F3 to start to increase.

Since the diaphragm 24 has flexibility, however, it flexes upward as a result of the increase of the force F3 and therefore relieves the increase in the force F3.

Accordingly, the wafer W as a whole moves upward corresponding to the amount of wear of the retainer ring 12 to make the force F3 and the pressure PW equal and maintain the amount of projection Δ of the wafer W at the initial state.

That is, the pressing force F to the carrier is constantly applied only to the retainer ring 12 and is almost never applied to the sheet supporter 21, so there is no need to consider changes in the polishing rate of the outer peripheral rim of the wafer W due to the wear of the retainer ring 12. As a result, even if the retainer ring 12 becomes worn, there is no need to adjust the retainer ring 12 and the operating rate of the CMP apparatus is strikingly improved.

The rest of the configuration, action, and effects are the same as those of the first to 14th embodiments, so explanations of the same will be omitted.

Note that the present invention is not limited to the above embodiments and includes various modifications and changes within the technical scope of the invention.

For example, in the above embodiments, air was used as the fluid, but it is also possible to use an oil or other liquid and uniformly press the wafer W by oil pressure etc.

Figure 39:
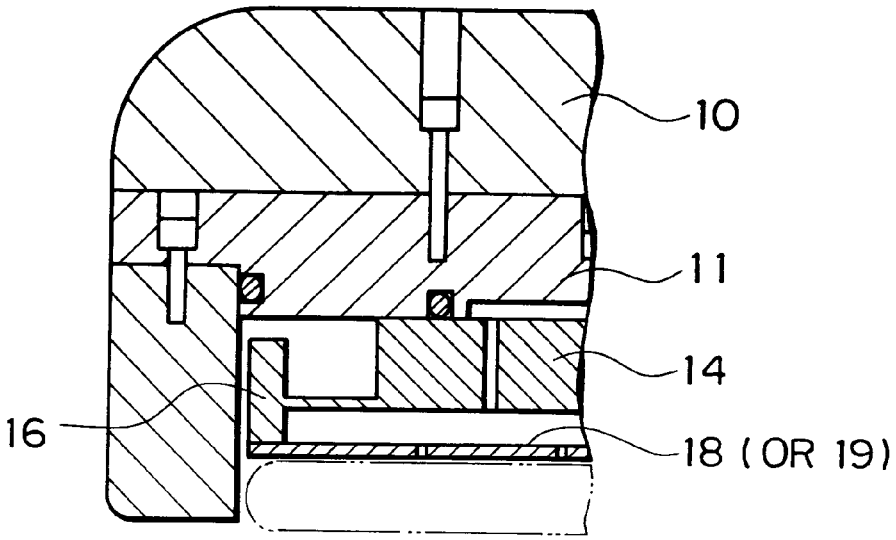
FIG. 39 is a sectional view of a first modification of the embodiments.

Further, in the above embodiments, use was made of a double layer structure sheet comprised of the hard sheet 18 and the soft backing sheet 19 as the flexible sheet, but as shown in FIG. 39, it is also possible to arrange either of the hard sheet 18 or the soft backing sheet 19 on the lower surface of the edge ring 16 and affix the outer periphery of the upper surface of the hard sheet 18 or the soft backing sheet 19 to the edge ring 16 air-tightly.

Figure 40:
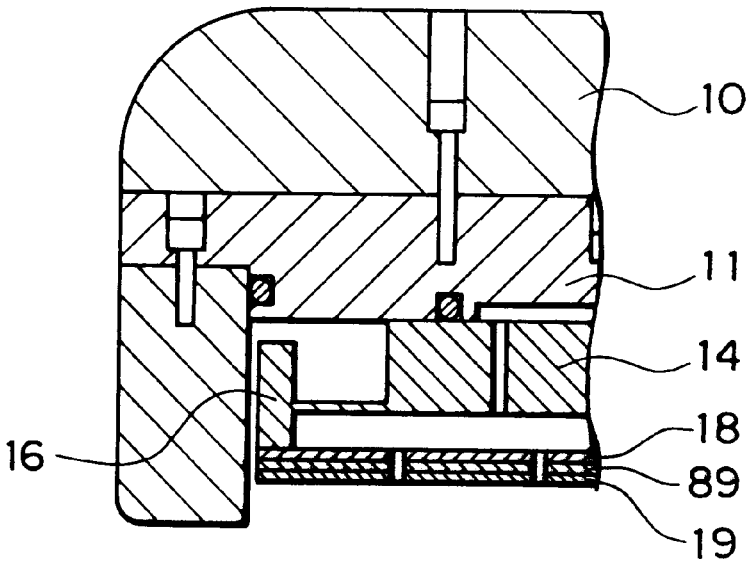
FIG. 40 is a sectional view of a second modification of the embodiments.
Figure 41:
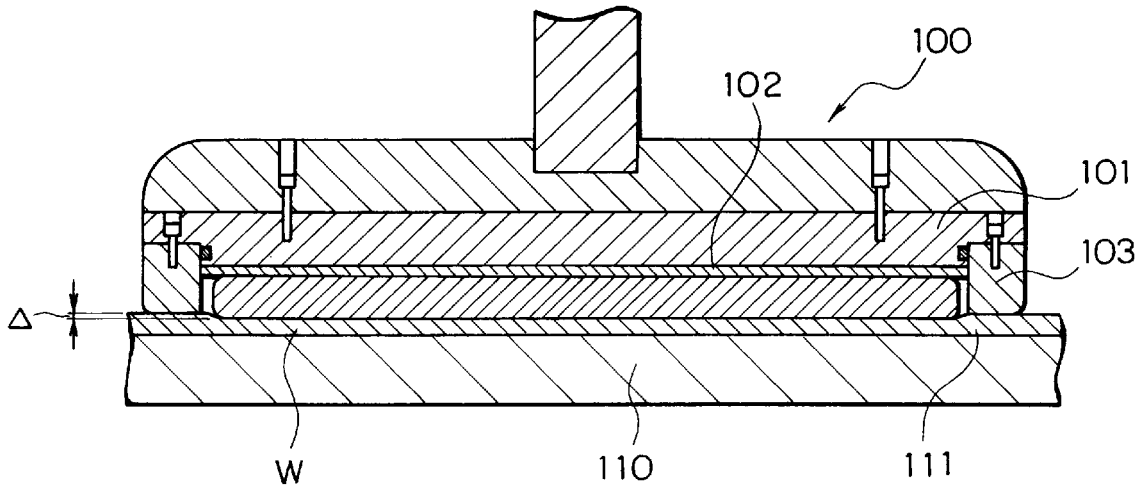
FIG. 41 is a sectional view of a carrier of a general CMP apparatus.
Figure 42:
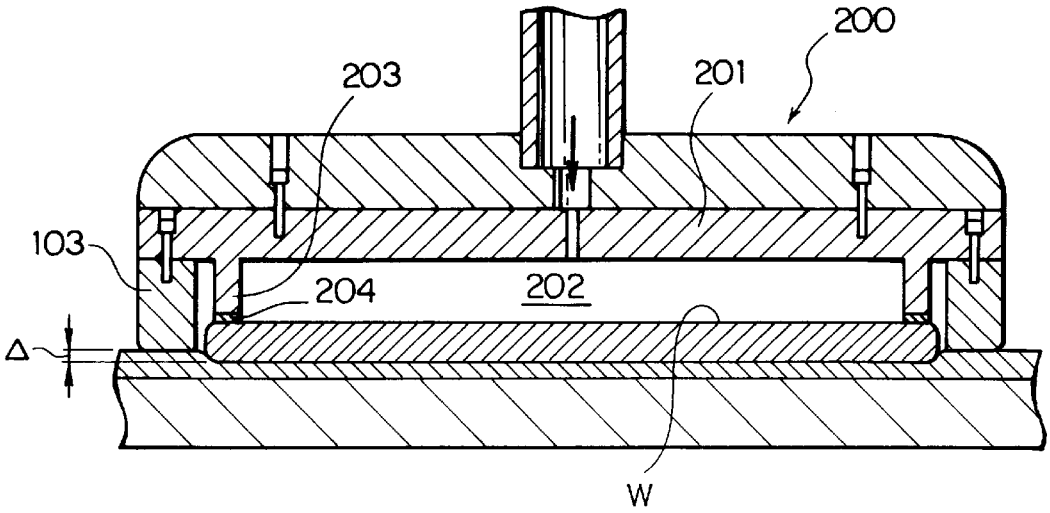
FIG. 42 is a sectional view of a carrier of a CMP apparatus of the air pressure system according to a first example of the related art.
Figure 43:
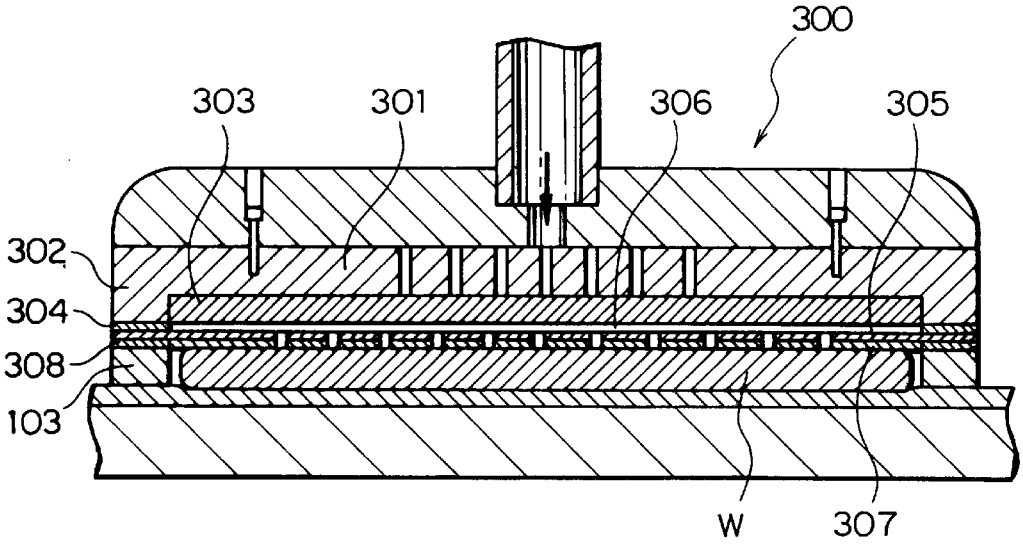
FIG. 43 is a sectional view of a carrier of a CMP apparatus of the air pressure system according to a second example of the related art.
Figure 44:
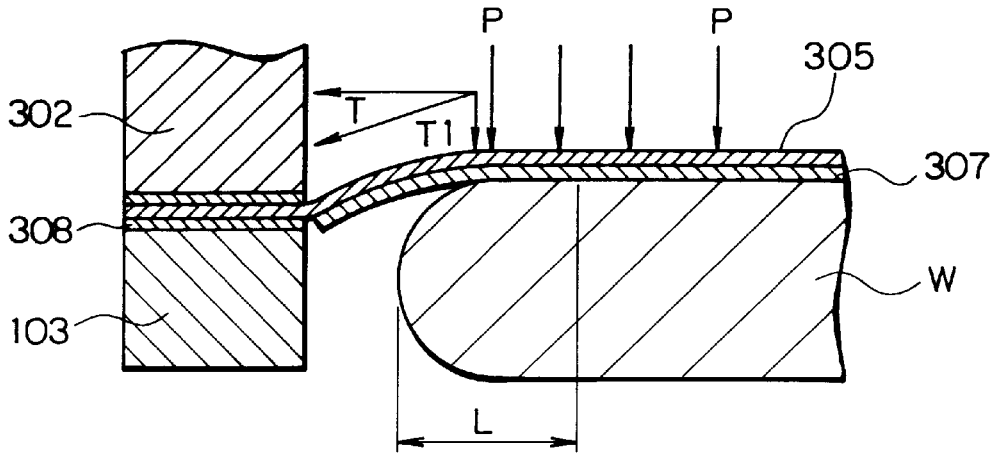
FIG. 44 is an enlarged sectional view of a state of over polishing.
Figure 45:
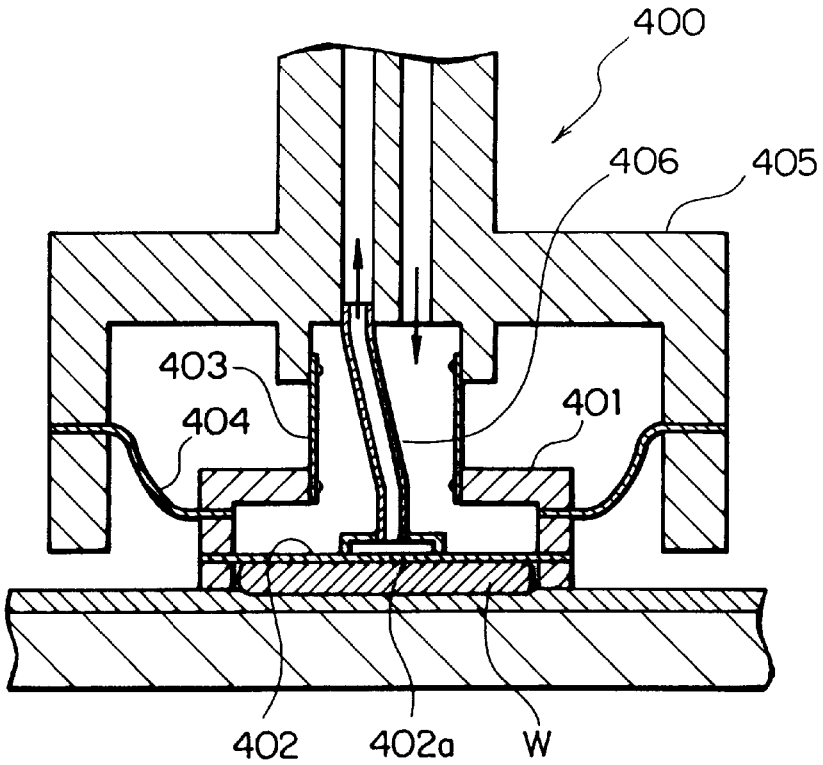
FIG. 45 is a sectional view of a carrier of a CMP apparatus of the air pressure system according to a third example of the related art.

Further, as shown in FIG. 40, it is also possible to adhere the hard sheet 18 and the soft backing sheet 9 through an intermediate sheet 89 such as a two-sided adhesive tape and affix the outer periphery of the upper surface of the hard sheet 18 to the edge ring 16 air-tightly.

Further, the above fourth and fifth embodiments, like the sixth to the 11th embodiments, may be structured to release the inside air to the outside at the outer peripheral side of the pressure chamber R and may be structured with the provision of a flow rate adjustment valve 4 to enable the flow rate of the exhausted air to be adjusted.

Further, the second to the 11th embodiments, like the 12th to 14th embodiments, may be structured to form an air layer at the lower side of the sheet to uniformly press against the wafer W.

Further, the 15th embodiment was structured to transmit the electrical signal C1, the pressure reduction control signal C2, and the pressure increase control signal C3 through wires, but it is also possible to provide a transmitter at the manometer 50, a transmitter/receiver at the comparator/controller 53, and a receiver at the regulator 59 and send the electrical signal C1, the pressure reduction control signal C2, and the pressure increase control signal C3 by radio waves.

Further, the 16th embodiment, like the sixth to eighth and the 10th embodiments, may be structured to release the inside air to the outside at the outer peripheral side of the pressure chamber S4 and may be structured with the provision of a flow rate adjustment valve 4 to enable the flow rate of the exhausted air to be adjusted.

Further, the 16th embodiment, like the 12th to the 14th embodiments, may be structured to form an air layer at the lower side of the sheet to press the wafer W uniformly and may be provided with a pressure control system like the 15th embodiment.

As explained in detail above, according to the aspects of the invention, it is possible to apply fluid pressure uniformly across the entire surface of the workpiece, including the outer peripheral rim, so there is the effect that it is possible to improve the uniformity of polishing of the workpiece.

Further, since the outer diaphragm acts to enable the reduction of the rate of increase of the polishing rate at the outer peripheral rim of the workpiece with respect to the amount of wear of the retainer ring, the margin of the amount of wear of the retainer ring can be increased. As a result, it is possible to operate the CMP apparatus for a longer time and improve the operating rate compared with the CMP apparatuses of the first to third examples of the related art.

Further, since the sheet is affixed air-tightly to the end of the outer edge, there is no leakage of the fluid in the pressure chamber to the outside and as a result it is possible to completely prevent the situation of unevenness occurring in the pressure applied to the outer peripheral rim of the workpiece as in the first example of the related art.

Further, since the sheet contacting the workpiece is affixed to the outer edge projecting out from the outer rim of the flexible outer diaphragm to the outer peripheral rim side of the workpiece, the problem of pulling of the outer periphery of the sheet at the time of pressing of the carrier such as in the second example of the related art does not arise.

Further, since there is no need to provide a flexible hose or other excess member in the pressure chamber as in the third example of the related art, it is possible to maintain the uniformity of the fluid pressure. Further, since the carrier is configured by the combination of the carrier base, retainer ring, sheet supporter, and sheet, the carrier does not become large in size and the fluid pressure in the pressure chamber can be freely adjusted.

Further, according to another aspects of the invention, since the fluid pressure at the two sides of the outer diaphragm can be made equal, there is the effect that it is possible to prevent any effect on the flexing of the outer diaphragm by the fluid pressure.

Further, according to another aspects of the invention, since it is possible to control the pressure difference between the fluid pressure in the space and the fluid pressure in the pressure chamber to adjust the fluid pressure applied to the outer diaphragm, there is the effect that it is possible to freely control the direction of flexing and the amount of flexing of the outer diaphragm and as a result is possible to freely adjust the polishing rate of the outer peripheral rim of the workpiece.

Further, according to another aspects of the invention, since it is possible to form an air-tight chamber at the outside of the center pressure chamber, there is the effect that it is possible to adjust the polishing rate in accordance with the warping and unevenness of the workpiece by making the fluid pressures in the chambers different.

Further, according to another aspects of the invention, there is the effect that it is possible to more finely adjust the polishing rate in accordance with the unevenness of the workpiece.

Further, according to another aspects of the invention, it is possible to stabilize the flow in the pressure chamber and further improve the uniformity of the distribution of pressure applied to the workpiece.

Further, according to another aspects of the invention, since the fluid in the pressure chamber flows out to the outside of the carrier without leaking between the retainer ring and the outer edge, it is possible to prevent deposition of abrasive due to drying of the polishing fluid.

Further, according to another aspects of the invention, since it is possible to correct the manufacturing error in the distribution of pressure by adjusting the flow rate of the fluid flowing from the pressure chamber to the outside of the carrier by a valve, it is possible to achieve identical fluid pressures in the pressure chambers of all of the carriers and identical polishing rates with respect to all of the workpiece.

Further, according to another aspects of the invention, since a certain layer of fluid is formed between the sheet and the workpiece, it is possible to directly press against the workpiece by this fluid layer and possible to make the distribution of the fluid pressure to the entire surface of the workpiece substantially completely uniform.

Further, according to another aspects of the invention, since the fluid from the fluid openings directly enters the holes in the sheet, it is possible to reliably form a stable layer of fluid between the sheet and the workpiece.

Further, according to another aspects of the invention, since it is possible to form a certain layer of fluid between the hard sheet and the soft sheet, it is possible to uniformly press against the entire surface of the workplace through the soft sheet by this fluid layer.

Further, according to another aspects of the invention, not only does the pressure applied to the entire surface of the workpiece become uniform, but also the pressing force to the carrier is applied only to the retainer ring and is not applied to the outer peripheral rim of the workpiece, so there is no need to consider the change in the polishing rate of the outer peripheral rim of the workpiece due to the wear of the retainer ring. Therefore, there is almost no need to adjust the worn retainer ring and as a result there is the effect that it is possible to strikingly improve the operating rate of the CMP apparatus.

Further, according to another aspects of the invention, it is possible to manage and control the pressing force to the workpiece to become the optimal reference pressure.

What is claimed is:

1. A carrier comprising:

a carrier base having a fluid outlet/inlet;

a retainer ring attached to an outer periphery of said carrier base and defining a space for holding a workpiece;

a sheet supporter having a body having at least one fluid opening communicating with said fluid outlet/inlet and provided inside the space for holding said workpiece, a flexible outer diaphragm extending from an outer peripheral surface of said body to a position corresponding to the outer peripheral rim of the workpiece, and a ring-shaped outer edge projecting from an outer rim of the outer diaphragm to the outer peripheral rim of the workpiece; and a flexible sheet with an ou-er peripheral rim air-tightly affixed to an end of said outer edge and defining a pressure chamber communicating with said fluid opening together with said sheet supporter.

2. A carrier as set forth in claim 1, wherein a seal member allowing movement of said outer edge is interposed between said outer edge and said retainer ring or carrier base so as to make air-tight the space existing at the opposite side of said pressure chamber from said outer diaphragm, and holes are formed in said outer diaphragm to communicate said space and pressure chamber.

3. A carrier as set forth in claim 1, wherein a seal member allowing movement of said outer edge is interposed between said outer edge and said retainer ring or carrier base so as to make air-tight the space existing at the opposite side of said pressure chamber from said outer diaphragm, and a fluid outlet/inlet communicating with the space is provided at either of said carrier base or said body of said sheet supporter.

4. A carrier as set forth in claim 1, wherein an inner hole of a predetermined diameter is provided at a center of said body of said sheet supporter, and inside said inner hole there are formed a flexible inner diaphragm extending from the inner peripheral surface of said inner hole toward the center and a ring-shaped inner edge projecting from the inner rim of said inner diaphragm to the sheet side and air-tightly fixed at its end to said sheet.

5. A carrier as set forth in claim 4, wherein at least two sheet supports with different diameters are arranged concentrically so that the inner edge of one does not contact with the outer edge of the other.

6. A carrier as set forth in claim 1, wherein said sheet is formed by a single hard sheet or soft sheet, and the outer periphery of the upper surface of said hard sheet or soft sheet is air-tightly affixed to the lower surface of the outer edge of said sheet supporter.

7. A carrier as set forth in claim 6, wherein a soft sheet is bonded to the lower surface of said hard sheet.

8. A carrier as set forth in claim 7, wherein said hard sheet and soft sheet are bonded via an intermediate sheet having an adhesive at its upper and lower surfaces.

9. A carrier as set forth in claim 1, wherein a through hole communicating said pressure chamber and outside is provided at an outer edge positioned at the outer peripheral side of the workpiece.

10. A carrier as set forth in claim 9, wherein a tube inserted through a hole passing through said retainer ring in the width direction is inserted into a through hole of said outer edge air-tightly.

11. A carrier as set forth in claim 1, wherein a hole is provided in said outer diaphragm positioned at the outer peripheral side of the workpiece and a through hole is provided in said carrier base communicating to the ou-side, and a tube inserted through a through hole of said carrier base is inserted into a hole of said outer diaphragm air-tightly.

12. A carrier as set forth in claim 1, wherein the portion above said outer diaphragm positioned at the outer peripheral side of the workpiece is covered by a flexible ring member to define an air-tight space, and a hole communicating with said space is provided in said outer diaphragm, a hole is provided in a portion of said ring member in contact with the lower surface of said carrier base, and a through hole communicating said hole and the outside is provided in said carrier base.

13. A carrier as set forth in claim 10, wherein a valve for controlling the flow rate of a fluid is attached at the fluid outflow side end of said tube.

14. A carrier as set forth in claim 1, wherein said sheet is provided with at least one hole communicating with said pressure chamber, and the fluid in said pressure chamber is made to flow out from said at least one hole to between said sheet and workpiece.

15. A carrier as set forth in claim 14, wherein said at least one hole of said sheet is arranged to be substantially facing the pressure side opening of at least one fluid opening provided at said body of said sheet supporter.

16. A carrier as set forth in claim 14, wherein part of said holes of said sheet are communicated through tubes with part of said fluid openings provided in said body of said sheet supporter.

17. A carrier as set forth in claim 7, wherein the centers of said hard sheet and said soft sheet are partially bonded together, at least one hole communicating with said pressure chamber is provided in said soft sheet, and the fluid in said pressure chamber is made to flow out from said at least one hole to between said hard sheet and said soft sheet.

18. A carrier comprising:

a carrier base having a fluid outlet/inlet;

a retainer ring attached to an outer periphery of said carrier base and defining a space for holding a workpiece;

a sheet supporter having a ring-shaped body arranged in said space for holding the workpiece, a flexible diaphragm for holding said body, and a ring-shaped edge projecting from an outer rim of said body to the outer peripheral rim side of the workpiece; and a flexible sheet with an outer peripheral rim air-tightly affixed to an end of said edge and defining a pressure chamber communicating with said fluid outlet/inlet.

19. A carrier as set forth in claim 18, wherein said sheet is formed by a single hard sheet or soft sheet, and the outer periphery of the upper surface of said hard sheet or soft sheet is air-tightly affixed to the lower surface of said edge of said sheet supporter.

20. A carrier as set forth in claim 19, wherein a soft sheet is bonded to the lower surface of said hard sheet.

21. A carrier as set forth in claim 20, wherein said hard sheet and soft sheet are bonded via an intermediate sheet having an adhesive at its upper and lower surfaces.

22. A carrier as set forth in claim 18, wherein a through hole communicating said pressure chamber and outside is provided at said edge.

23. A carrier as set forth in claim 22, wherein a tube inserted through a hole passing through said retainer ring in the width direction is inserted into a through hole of said edge air-tightly.

24. A carrier as set forth in claim 23, wherein a valve for controlling the flow rate of a fluid is attached at the fluid outflow side end of said tube.

25. A carrier as set forth in claim 18, wherein said sheet is provided with at least one hole communicating with said pressure chamber, and the fluid in said pressure chamber is made to flow out from said at least one hole to between said sheet and workpiece.

26. A carrier as set forth in claim 25, wherein said at least one hole of said sheet is arranged to be substantially facing the pressure side opening of at least one fluid opening provided at said carrier base.

27. A carrier as set forth in claim 25, wherein part of said holes of said sheet are communicated through tubes with part of said fluid openings provided in said carrier base.

28. A carrier as set forth in claim 20, wherein the centers of said hard sheet and said soft sheet are partially bonded together, at least one hole communicating with said pressure chamber is provided in said soft sheet, and the fluid in said pressure chamber is made to flow out from said at least one hole to between said hard sheet and said soft sheet.

29. A CMP apparatus comprising:

a platen having a polishing pad attached to its surface;

a carrier rotatable in a state holding a workpiece on said polishing pad of said platen;

a fluid supplying means capable of supplying a fluid of a desired pressure to said carrier; and a rotational driving means for rotating said carrier while pressing against said platen; wherein said carrier comprising:

a carrier base having a fluid outlet/inlet through which a fluid supplied from said fluid supply means can flow;

a retainer ring attached to an outer periphery of said carrier base and defining a space for holding a workpiece;

a sheet supporter having a body having at least one fluid opening communicating with said fluid outlet/inlet and provided inside said space for holding said workpiece, a flexible outer diaphragm extending from an outer peripheral surface of said body to a position corresponding to the outer peripheral rim of the workpiece, and a ring-shaped outer edge projecting from an outer rim of said outer diaphragm to the outer peripheral rim of the workpiece; and a flexible sheet with an outer peripheral rim air-tightly affixed to an end of said outer edge and defining a pressure chamber communicating with said fluid opening together with said sheet supporter.

30. A CMP apparatus as set forth in claim 29, wherein a seal member allowing movement of said outer edge of said seal supporter in said carrier is interposed between said outer edge and said retainer ring or carrier base so as to make air-tight the space existing at the opposite side of said pressure chamber from said outer diaphragm, and holes are formed in said outer diaphragm to communicate said space and pressure chamber.

31. A CMP apparatus as set forth in claim 29, wherein a seal member allowing movement of said outer edge of said sheet supporter is interposed between said outer edge and said retainer ring or carrier base so as to make air-tight the space existing at the opposite side of said pressure chamber from said outer diaphragm, and a fluid outlet/inlet communicating with the space is provided at either of said carrier base or said body of said sheet supporter.

32. A CMP apparatus as set forth in claim 29, wherein an inner hole of a predetermined diameter is provided at a center of said body of said sheet supporter in said carrier, inside said inner hole there are formed a flexible inner diaphragm extending from the inner peripheral surface of said inner hole toward the center and a ring-shaped inner edge projecting from the inner rim of said inner diaphragm to the sheet side and air-tightly fixed at its end to said sheet, and fluid of a desired pressure is supplied from said fluid supply means to each of the plurality of chambers defined by said sheet supporter, carrier base, retainer ring, and sheet.

33. A CMP apparatus as set forth in claim 32, wherein at least two sheet supports with different diameters in said carrier are arranged concentrically so that said inner edge of one does not contact said outer edge of the other, and fluid of a desired pressure is supplied from said fluid supply means to each of the plurality of chambers defined by said sheet supporter, carrier base, retainer ring, and sheet.

34. A CMP apparatus as set forth in claim 29, wherein a through hole communicating said pressure chamber and outside is provided at an outer edge positioned at the outer peripheral side of the workpiece held by said carrier and the fluid in said pressure chamber is leaked to the outside through said through hole.

35. A CMP apparatus as set forth in claim 34, wherein a tube inserted through a hole passing through said retainer ring of said carrier in the width direction is inserted into a through hole of said outer edge air-tightly and the fluid in said pressure chamber is leaked to the outside through said tube.

36. A CMP apparatus as set forth in claim 29, wherein a hole is provided in said outer diaphragm positioned at the outer peripheral side of the workpiece held in said carrier and a through hole is provided in said carrier base communicating to the outside, and a tube inserted through a through hole of said carrier base is inserted into a hole of said outer diaphragm air-tightly.

37. A CMP apparatus as set forth in claim 29, wherein the portion above said outer diaphragm positioned at the outer peripheral side of the workpiece held in said carrier is covered by a flexible ring member to define an air-tight space, and a hole communicating with the space is provided in said outer diaphragm, a hole is provided in a portion of said ring member in contact with the lower surface of said carrier base, a through hole communicating said hole and the outside is provided in said carrier base, and the fluid in said pressure chamber is leaked to the outside through said hole of said outer diaphragm, said hole of said ring member, and said through hole of said carrier base.

38. A CMP apparatus as set forth in claim 35, wherein a valve for controlling the flow rate of a fluid is attached at the fluid outflow side end of said tube of said carrier.

39. A CMP apparatus as set forth in claim 29, wherein said sheet of said carrier is provided with at least one hole communicating with said pressure chamber, and the fluid in said pressure chamber of said carrier is made to flow out from said at least one hole to between said sheet and workpiece.

40. A CMP apparatus as set forth in claim 39, wherein said at least one hole of said sheet of said carrier is arranged to be substantially facing the pressure side opening of at least one fluid opening provided at said body of said sheet supporter.

41. A CMP apparatus as set forth in claim 39, wherein part of said holes of said sheet of said carrier are communicated through tubes with part of said fluid openings provided in said body of said sheet supporter.

42. A CMP apparatus as set forth in claim 29, wherein said sheet of said carrier is made a double layer structure of a hard sheet and a soft sheet, said hard sheet is provided with at least one hole communicating with said pressure chamber and the outer periphery of the upper surface of said hard sheet is air-tightly affixed to the lower surface of the outer edge of said sheet supporter, the centers of said hard sheet and said soft sheet are partially bonded together, and the fluid in said pressure chamber is made to flow out from said at least one hole to between said hard sheet and said soft sheet.

43. A CMP apparatus as set forth in claim 29, further comprising:

a manometer attached to said carrier for detecting a fluid pressure in said pressure chamber;

a comparator/controller for comparing the detected output value of said manometer and a reference output value determined in advance, outputting a pressure reduction signal indicating the pressure difference when the detected pressure value is larger than the reference pressure value, and outputting a pressure increase signal indicating the pressure difference when the detected output value is smaller than the reference pressure value; and a pressure regulator for reducing the fluid pressure by said fluid supply means by exactly a pressure corresponding to the pressure difference indicated by the pressure reduction signal when the pressure reduction signal is input and increasing the fluid pressure by said fluid supply means by exactly a pressure difference indicated by the pressure increase signal when the pressure increase signal is input.

44. A CMP apparatus as set forth in claim 43, wherein further provision is made of a display for displaying the fluid output value detected by said pressure regulator.

45. A CMP apparatus as set forth in claim 43, wherein said comparator/controller sends out an alarm or stops said rotational driving means when the fluid pressure value is at least a first pressure level higher than said reference pressure value or not more than a second pressure level lower than said reference pressure value.

46. A CMP apparatus comprising:

a platen having a polishing pad attached to its surface;

a carrier rotatable in a state holding a workpiece on said polishing pad of said platen;

a fluid supplying means capable of supplying a fluid of a desired pressure to said carrier; and a rotational driving means for rotating said carrier while pressing against said platen; wherein said carrier comprising:

a carrier base having a fluid outlet/inlet through which a fluid supplied from said fluid supply means can flow;

a retainer ring attached to an outer periphery of said carrier base and defining a space for holding a workpiece;

a sheet supporter having a ring-shaped body arranged in the space for holding the workpiece, a flexible diaphragm for holding said body, and a ring-shaped edge projecting from an outer rim of said body to the outer peripheral rim side of the workpiece; and a flexible sheet with an outer peripheral rim air-tightly affixed to an end of said edge and defining a pressure chamber communicating with said fluid outlet/inlet.

47. A CMP apparatus as set forth in claim 46, wherein a through hole communicating said pressure chamber and outside is provided at said edge of said carrier.

48. A CMP apparatus as set forth in claim 47, wherein a tube inserted through a hole passing through said retainer ring of said carrier in the width direction is inserted into a through hole of said edge air-tightly.

49. A CMP apparatus as set forth in claim 48, wherein a valve for controlling the flow rate of a fluid is attached at the fluid outflow side end of said tube of said carrier.

50. A CMP apparatus as set forth in claim 46, wherein said sheet of said carrier is provided with at least one hole communicating with said pressure chamber, and the fluid in said pressure chamber is made to flow out from said at least one hole to between said sheet and workpiece.

51. A CMP apparatus as set forth in claim 50, wherein said at least one hole of said sheet of said carrier is arranged to be substantially facing the pressure side opening of said at least one fluid openings provided at said carrier base.

52. A CMP apparatus as set forth in claim 50, wherein part of said holes of said sheet of said carrier are communicated through tubes with part of said fluid openings provided in said carrier base.

53. A CMP apparatus as set forth in claim 46, wherein said sheet of said carrier is made a double layer structure of a hard sheet and a soft sheet, said hard sheet is provided with at least one hole communicating with said pressure chamber and the outer periphery of the upper surface is air-tightly affxed to the lower surface of the outer edge of said sheet supporter, the centers of said hard sheet and said soft sheet are partially bonded together, and the fluid in the pressure chamber is made to flow out from said at least one hole to between said hard sheet and said soft sheet.

54. A CMP apparatus as set forth in claim 46, further comprising:

a manometer attached to said carrier for detecting a fluid pressure in said pressure chamber;

a comparator/controller for comparing the detected output value of said manometer and a reference output value determined in advance, outputting a pressure reduction signal indicating the pressure difference when the detected pressure value is larger than the reference pressure value, and outputting a pressure increase signal indicating the pressure difference when the detected output value is smaller than the reference pressure value; and a pressure regulator for reducing the fluid pressure by said fluid supply means by exactly a pressure corresponding to the pressure difference indicated by the pressure reduction signal when the pressure reduction signal is input and increasing the fluid pressure by said fluid supply means by exactly a pressure difference indicated by the pressure increase signal when the pressure increase signal is input.

55. A CMP apparatus as set forth in claim 54, wherein further comprising a display for displaying the fluid output value detected by said pressure regulator.

56. A CMP apparatus as set forth in claim 54, wherein said comparator/controller sends out an alarm or stops said rotational driving means when the fluid pressure value is at least a first pressure level higher than said reference pressure value or not more than a second pressure level lower than said reference pressure value.

* * * * *